US011674269B2

(12) United States Patent
Harman

(10) Patent No.: US 11,674,269 B2
(45) Date of Patent: Jun. 13, 2023

(54) SYSTEM AND METHOD FOR PLACEMENT OF RAILROAD TIE PLATE

(71) Applicant: Genesis Rail Services II, LLC, Wilmington, DE (US)

(72) Inventor: Jeffrey Kyle Harman, Hiwassee, VA (US)

(73) Assignee: GENESIS RAIL SERVICES II, LLC, Wilmington, DE (US)

( * ) Notice: Subject to any disclaimer, the term of this patent is extended or adjusted under 35 U.S.C. 154(b) by 499 days.

(21) Appl. No.: 16/849,324

(22) Filed: Apr. 15, 2020

(65) Prior Publication Data

US 2020/0332475 A1 Oct. 22, 2020

Related U.S. Application Data

(60) Provisional application No. 62/834,840, filed on Apr. 16, 2019.

(51) Int. Cl.
*E01B 29/32* (2006.01)

(52) U.S. Cl.
CPC ..... *E01B 29/32* (2013.01)

(58) Field of Classification Search
CPC ... E01B 9/38; E01B 9/40; E01B 29/24; E01B 29/32; E01B 31/00
See application file for complete search history.

(56) References Cited

U.S. PATENT DOCUMENTS

| | | | | |
|---|---|---|---|---|
| 4,280,613 | A | 7/1981 | Stewart | |
| 4,974,518 | A | 12/1990 | Cotic et al. | |
| 6,595,140 | B1 | 7/2003 | Madison et al. | |
| 8,132,512 | B2 | 3/2012 | Helmick | |
| 8,166,883 | B1 | 5/2012 | Coots | |
| 9,156,623 | B1 * | 10/2015 | Buzdum | E01B 29/32 |
| 2013/0247794 | A1 | 9/2013 | Coots | |
| 2014/0251175 | A1 | 9/2014 | Harman | |

* cited by examiner

*Primary Examiner* — Robert J McCarry, Jr.
(74) *Attorney, Agent, or Firm* — Miller, Johnson, Snell & Cummiskey, P.L.C.; Brandon Griffith

(57) ABSTRACT

A railroad tie plate placement system facilitates or enables a railroad crew to minimize interaction with railroad tie plates while placing railroad tie plates in a proper orientation on a railroad or railway track in preparation for insertion under a rail. Thus, the described railroad tie plate placement system reduces labor costs and decreases risk of injury while providing for consistent placement of tie plates.

21 Claims, 51 Drawing Sheets

SYSTEM AND METHOD FOR PLACEMENT OF RAILROAD TIE PLATE

CROSS-REFERENCE TO RELATED APPLICATIONS

This application claims the benefit of priority to U.S. Provisional Patent Application No. 62/834,840, filed on Apr. 16, 2019, which is hereby incorporated by reference in its entirety.

TECHNICAL FIELD

This disclosure relates to systems for placing a railroad tie plate on a railroad track.

BACKGROUND

A railroad bed includes a pair of parallel metal rails interconnected and held in place by a plurality of crossties, also called railroad ties or ties, along a path of rocks or ballast. The rails are held in place on the ties by positioning railroad tie plates 10 between the rails and the ties. Railroad tie plates 10, examples of which are shown in FIGS. 1 and 2, increase the load bearing surface area on the tie for a load on the rail generated by rail supported vehicles, such as, for example, train engines, train cars, and rail-mounted work vehicles. The load on the rail is transferred from the rail to the tie through railroad tie plate 10. In the past, metal railroad spikes were used to hold both railroad tie plates 10 and rails in position on the ties. Today, spikes or lag bolts can be used to attach railroad tie plate 10 to the tie while the rail can be attached to the tie plate using a fastener, such as a clip.

Historically, railroads were built using hand tools and manual labor. The equipment first used in the railroad construction industry was for clearing and preparing railway beds, i.e., the surface that support ties and rails, which can be earth or ground, an elevated bed, or other surfaces. Later, purpose built, custom built, or specialty equipment specifically designed for railroad construction was developed and used to construct railroads. Currently, the steps involved in building a railroad, including the setting of ties, laying of rail, grading of ballast, and driving spikes, are all accomplished by railroad construction equipment specifically designed for such tasks. There is also railroad construction equipment that can effect repairs, such as tie replacement equipment that removes a tie from under the rails of an existing railroad track and then inserts a new tie, which is later spiked to a tie plate attached to the rails.

Purpose built railroad construction equipment is typically supported in the task of building railways, railroad beds, and/or railroad tracks by other material handling equipment. For example, front-end loaders and dump trucks preposition ballast for railway ballast grading equipment. In another example, excavators with mechanical claws preposition ties for railway tie setting equipment. Regardless of the equipment custom built to build railroads, manual labor is still used to preposition railway tie plates 10 for railway tie plate installation equipment. That is, manual labor is done to specifically position a pair of railway tie plates 10 near, on, or between the rails so that railway tie plate installation equipment can later acquire railway tie plates 10 and install railway tie plates 10 between the ties and the rails.

One challenge with railroad tie plates 10 is that they come in several common sizes. Current systems that load a straight ramp to deposit railroad tie plates on railroad ties do not try to maintain orientation of tie plates 10, which means that tie plates 10 can rotate or be placed on a ramp in different orientations, and tie plates 10 can land on a tie in multiple orientations.

SUMMARY

This disclosure provides a railroad tie plate placement system comprising a vehicle, a vibratory tie plate distributor, and a tie plate ejector. The vehicle is configured to travel on a railroad track having a pair of railroad rails supported by a plurality of railroad ties. The vibratory tie plate distributor includes an input at an upper end of the vibratory tie plate distributor, a bottom end, and a ramp extending around a periphery of the vibratory tie plate distributor. The ramp connects the input to the bottom end. The tie plate ejector is positioned adjacent to the bottom end, and the tie plate ejector is configured to eject a tie plate in a predetermined orientation of a field side of the tie plate independent of the orientation of the tie plate when the tie plate is positioned in the tie plate ejector.

This disclosure also provides a railroad tie plate placement system comprising a vehicle, a first tie plate magazine, and a tie plate distributor. The vehicle is configured to travel on a railroad track having a pair of railroad rails supported by a plurality of railroad ties. The vehicle has a bed having a maximum width. The first tie plate magazine is attached to the vehicle at a location within the bed maximum width, and the first tie plate magazine extends vertically such that a top end of the first tie plate magazine is located above the vehicle bed and a bottom end of the first tie plate magazine is located below the vehicle bed. The tie plate distributor is configured to deposit tie plates into the top end of the first tie plate magazine.

This disclosure also provides a railroad tie plate placement system comprising a vehicle and a tie plate distributor. The vehicle is configured to travel on a railroad track having a pair of railroad rails supported by a plurality of railroad ties. The tie plate distributor is configured to receive tie plates at a first end and to distribute tie plates at a second end. The tie plate distributor includes a plurality of diverters. The plurality of diverters includes a first diverter to flip an upside down tie plate so that a top side of the tie plate is oriented upwardly, and a second diverter to orient the tie plate in a predetermined orientation as the tie plate is ejected by the tie plate distributor.

Advantages and features of the embodiments of this disclosure will become more apparent from the following detailed description of exemplary embodiments when viewed in conjunction with the accompanying drawings.

DETAILED DESCRIPTION

Figure 1:
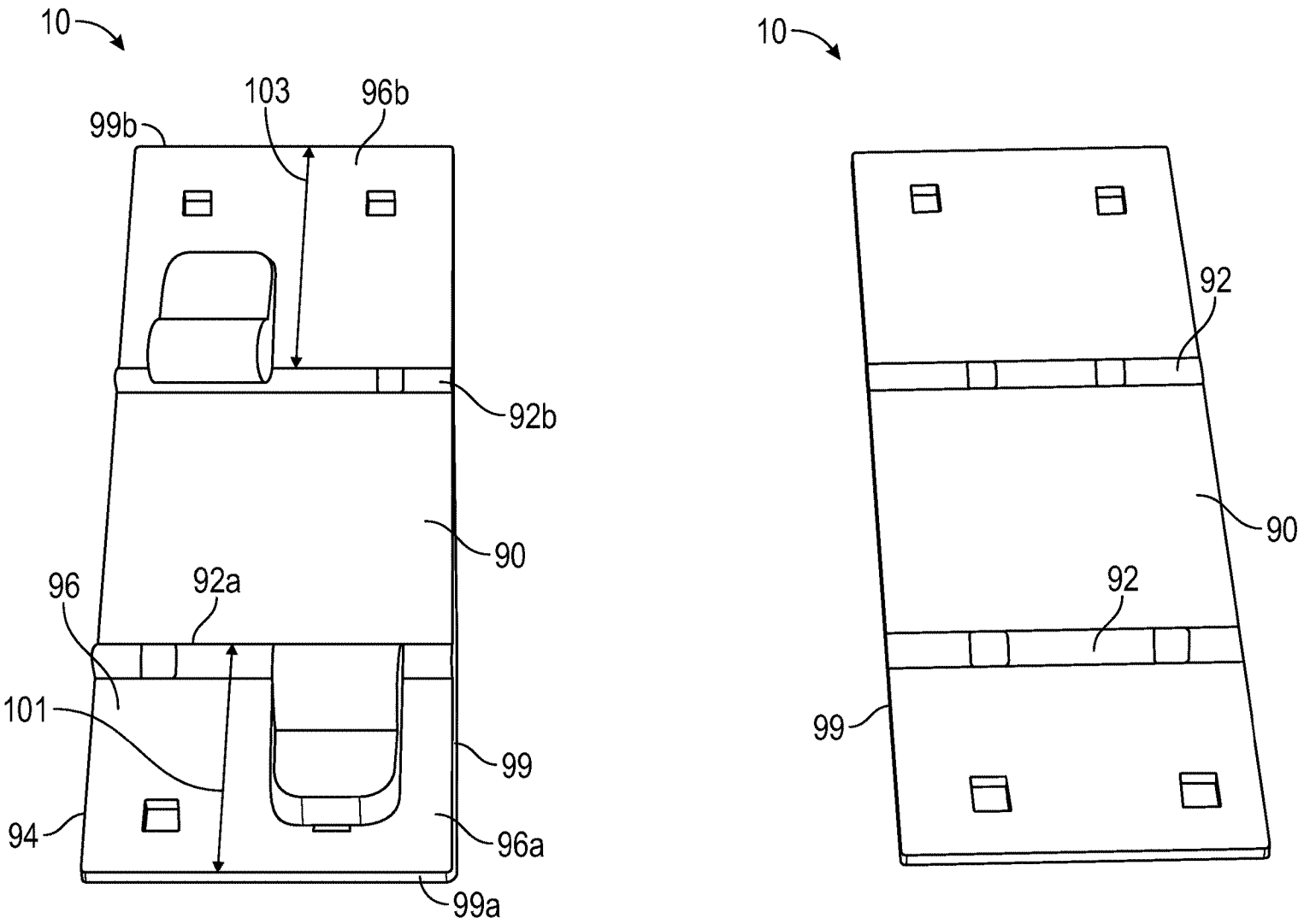
FIG. 1 Prior Art
FIG. 1 shows a perspective view of conventional railroad tie plates.

Conventional manual placement of railroad tie plates has been the standard practice for placement of railroad tie plates for decades. However, such placement, while accurate, is labor and cost intensive. Furthermore, the risk of injury in such placement is high, leading to employee absenteeism due to injury, as well as the attendant medical and worker's compensation costs. The railroad tie plate placement systems of the present disclosure facilitate or enable a single person of a railroad crew to place railroad tie plates in a proper position and orientation on a railroad track in preparation for insertion under a rail by purpose built equipment. In an exemplary embodiment, placement may be on a railroad tie of the railroad track. Thus, the railroad tie plate placement systems of the present disclosure reduce labor costs and decrease risk of injury while providing for consistent placement of tie plates.

In the included figures, the thicknesses of layers and regions may be exaggerated for clarity. In addition, perspectives may be distorted for clarity. Accordingly, the included figures are not to scale. Furthermore, it should be understood that like reference numerals in the embodiments of the figures denote like elements. Further yet, the term railroad and railway may be used synonymously in the context of this disclosure.

Figure 2:
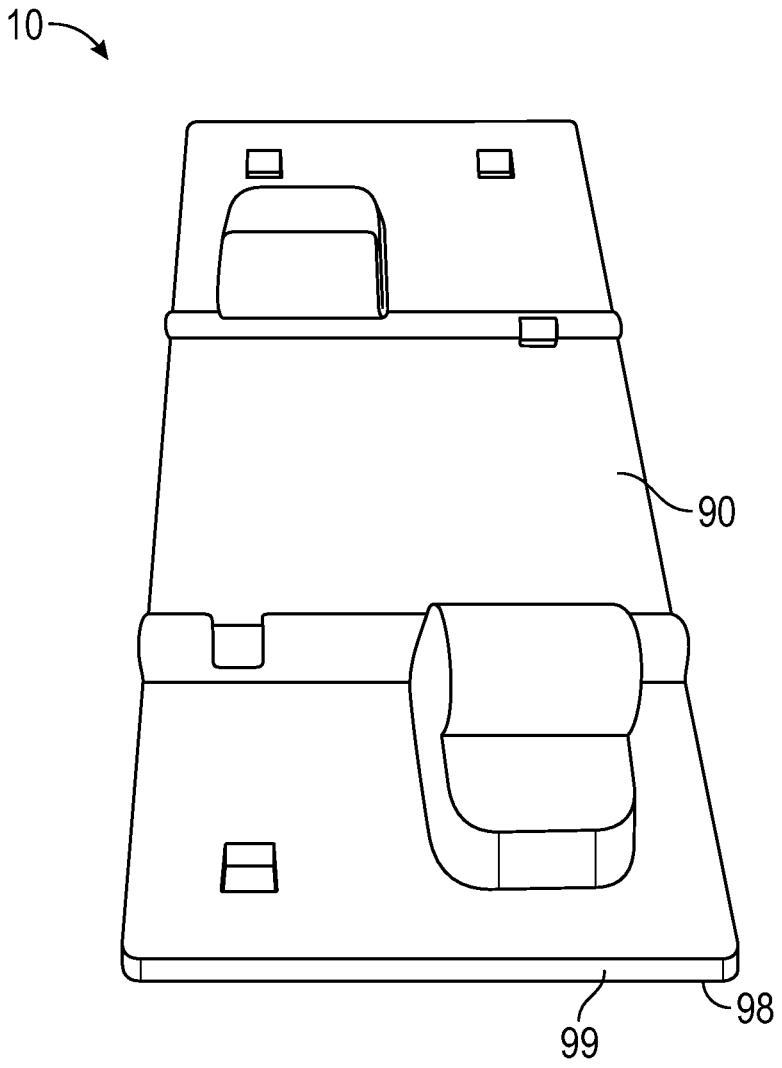
FIG. 2 Prior Art
FIG. 2 shows another perspective view of conventional railroad ties plates.

FIGS. 1 and 2 show general configurations of conventional tie plates 10. Tie plates 10 generally include a tie plate base 94. Tie plate base 94 includes an upper surface 96, where "upper" means a surface that faces away from a railroad or railroad bed, which would also be away from the ground. Similarly, tie plate base 94 includes a lower surface 98, with "lower" being a surface that faces toward the railroad or railway bed, which is conventionally formed on the ground. A plurality of tie plate sides 99 extend from upper surface 96 to lower surface 98, and thus tie plate sides are positioned directly between upper surface 96 and lower surface 98. In the context of this disclosure, formed on the ground can mean that a support structure is formed on the ground intermediate to tie plate 10, and such support structure can include concrete, gravel, a bridge or trestle, wood structures in addition to railroad ties, and other structures that are ultimately supported by the ground or earth.

Upper surface 96 of tie plate base 94 includes a rail pad or rail placement pad 90. Tie plate base 94 can also include one or more pad walls or protrusions 92 that extend from upper surface 96. Protrusions 92 help maintain a predetermined location for rails 60. As can be seen in, for example, FIG. 1, upper surface 96 can include two protrusions 92 and upper surface 96 extends from each protrusion 92 to one of the edges of tie plate 10. For illustration, FIG. 1 shows a tie plate 10 having a first protrusion 92*a*, and a second protrusion 92*b* positioned on opposite sides of rail pad 90. An upper surface 96*a* extends longitudinally a first distance or length 101 from first protrusion 92*a* in a direction along a longest dimension in plan view of tie plate 10 to a first edge 99*a*. Another upper surface 96*b* extends longitudinally a second distance or length 103 from second protrusion 92*b* to second edge 99*b* in a direction along a longest dimension in plan view of tie plate 10. Second edge 99*b* is at an opposite end of tie plate base 94 from first edge 99*a* along the longest dimension of tie plate 10 in the plan view of tie plate 10.

As should be apparent from FIGS. 1 and 2, second distance or length 103 is longer then first distance 101. Longer upper surface 96*b* of tie plate 10, i.e., upper surface 96*b* having second distance or length 103, is considered the field side or field end of tie plate 10. In other words, when tie plate 10 is positioned on a railroad tie 62, which can be seen in, for example, FIG. 4, the field side or end of tie plate 10, having upper surface 96*b*, is oriented away from both rails 60, and the opposite side or end of tie plate 10, i.e., a gauge side having upper surface 96*a*, is positioned between both rails 60. In view of the relationship of upper surface 96*b* and upper surface 96*a* to the field side and the gauge side, respectively, upper surface 96*b* can also be described as field surface 96*b*, or field side surface 96*b*, and upper surface 96*a* can also be described as gauge side surface 96*a*. See also FIG. 5, showing field side surface 96*b* oriented on the outward side of a system 100, i.e., the field side, and gauge side surface 96*a* oriented toward the inward side of system 100, i.e., the gauge side. Further, tie plates 10 on a same railroad tie 62 will be positioned so that upper surfaces 96*a* of the two tie plates 10 are oriented to be a closest location on the upper side of two tie plates to each other, and upper surfaces 96*b* of two tie plates 10 on a single railroad tie 62 are further from each other. Still further, when two tie plates 10 are on a same railroad tie 62, upper surfaces 96*b* are positioned near opposite ends of the same railroad tie 62.

For consistency, in plan view tie plate 10 includes a first dimension that extends generally perpendicular to first edge 99*a* and second edge 99*b* from first edge 99*a* to second edge 99*b*, and this dimension is considered a length in the context of this disclosure. It should be understood that length is perpendicular to a direction rails 60 extend when tie plate 10 is positioned on a railroad bed. Tie plate 10 includes a second dimension that extends generally parallel to first edge 99*a* and second edge 99*b*, and this second dimension is considered a width in the context of this disclosure.

Figure 3:
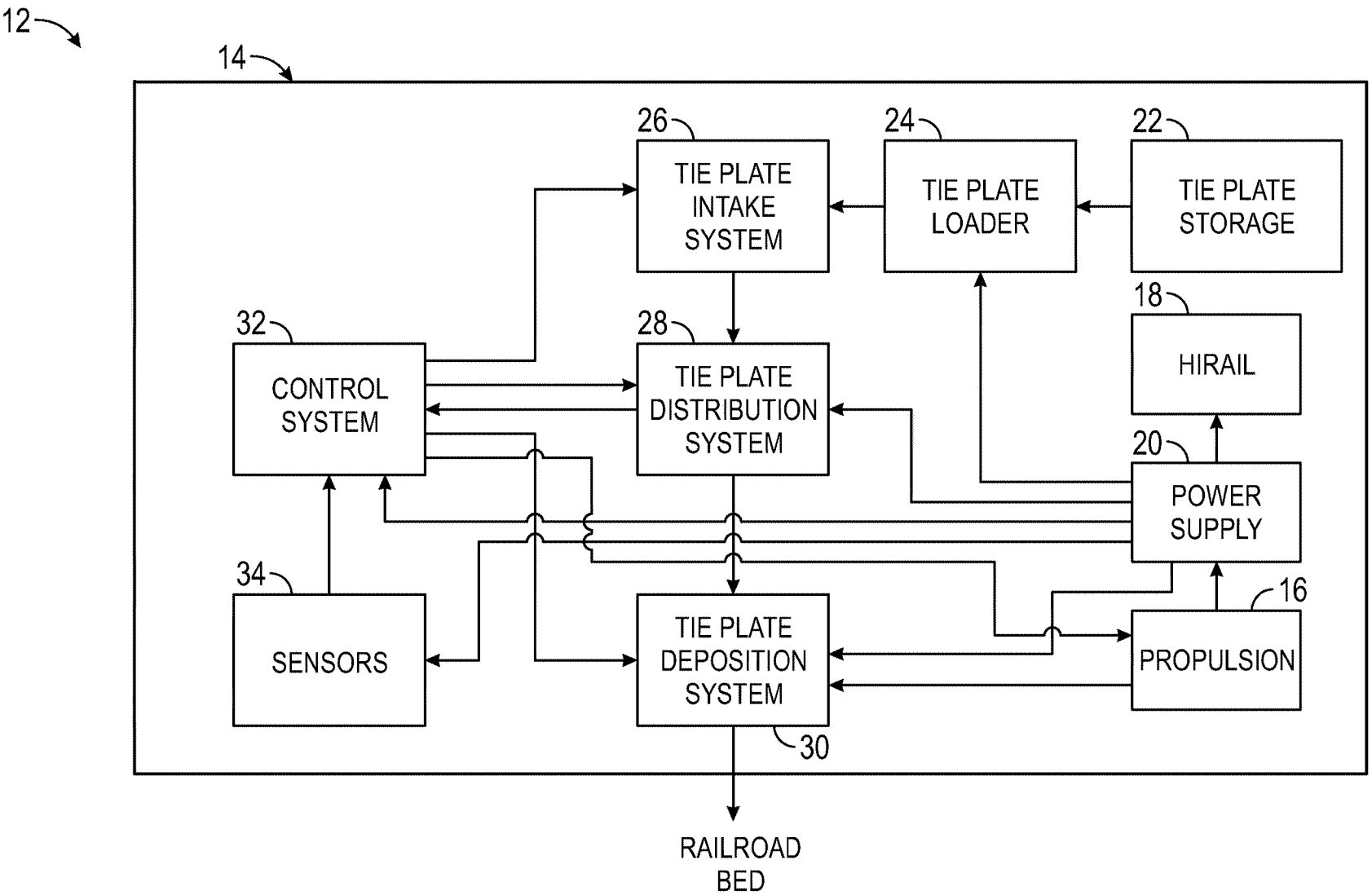
FIG. 3 shows a block diagram of a railroad tie plate delivery system in accordance with an exemplary embodiment of the present disclosure.
Figure 4:
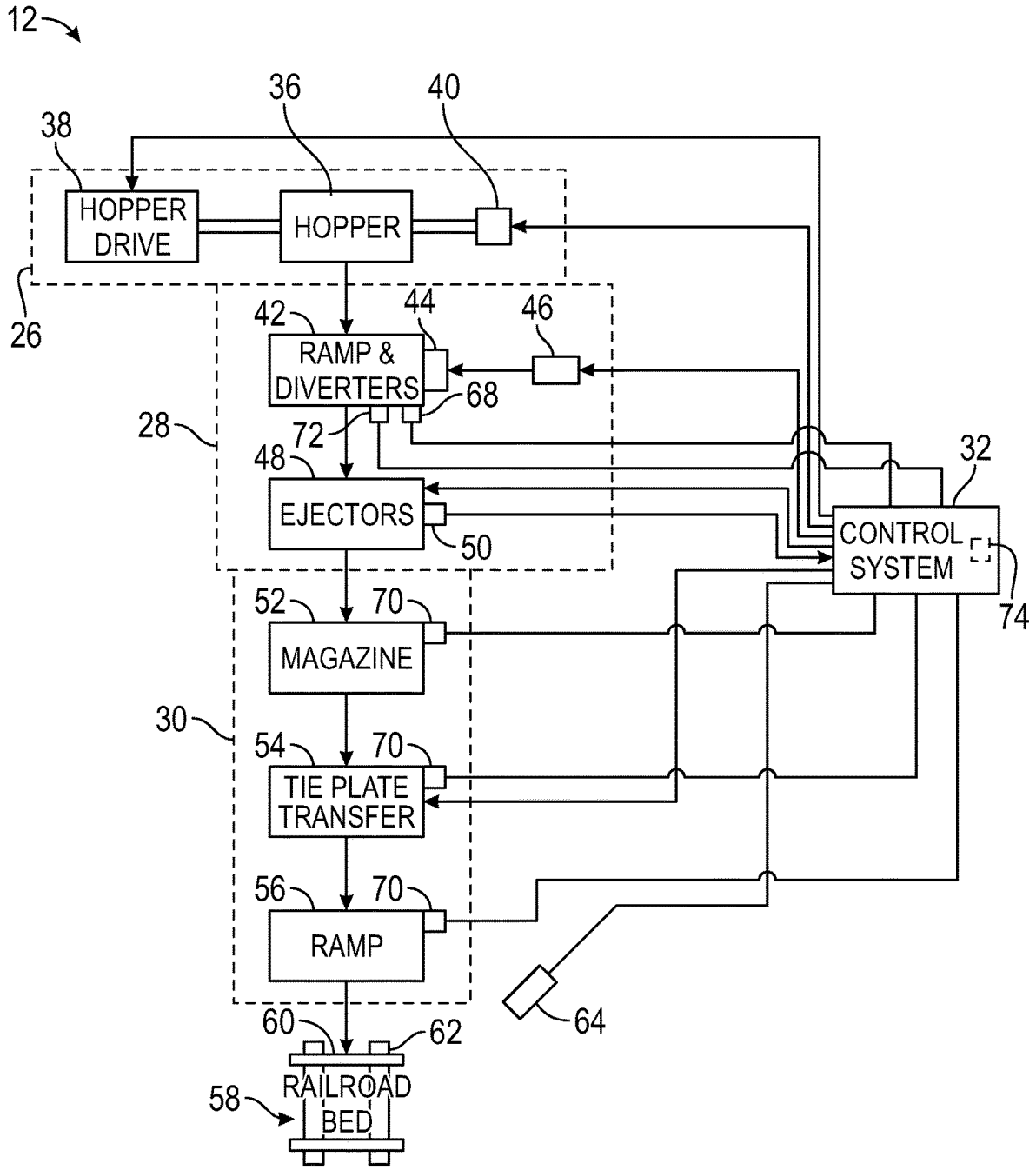
FIG. 4 shows a block diagram of a railroad tie plate delivery system in accordance with another exemplary embodiment of the present disclosure.
Figure 5:
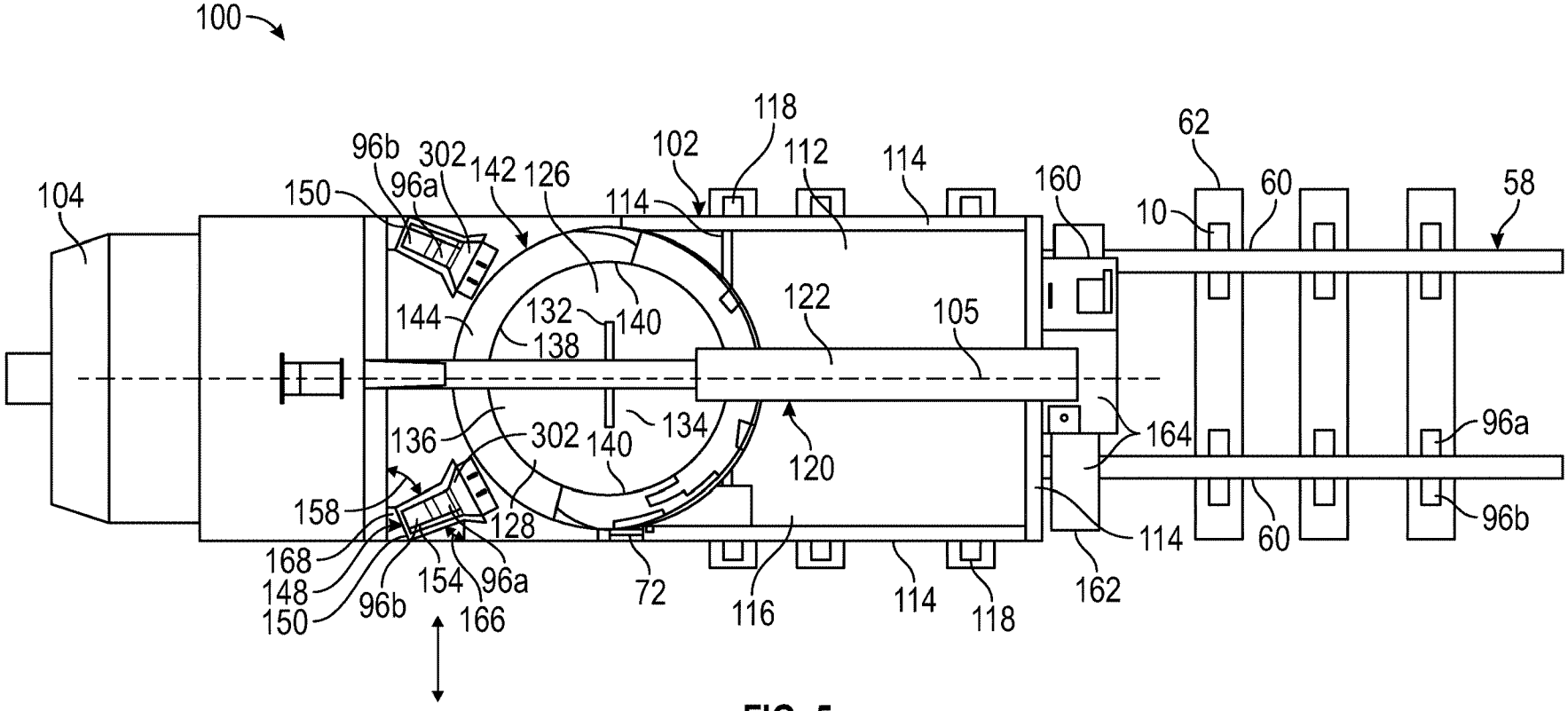
FIG. 5 shows a plan view of a railroad tie plate delivery system in accordance with a further exemplary embodiment of the present disclosure.

FIGS. 3 and 4 show block diagrams of railroad tie plate placement systems, indicated generally at 12, in accordance with an exemplary embodiment of the present disclosure. For the sake of brevity, railroad tie placement systems are described herein as placement systems. Placement system 12 includes a mobile platform 14. Mobile platform 14 may be, for example, a vehicle such as a truck. In another embodiment, mobile platform 14 may be a railroad car. As should be understood, mobile platform 14 has a plurality of flanged wheels for interfacing with the rails of a railroad track.

In an exemplary embodiment, mobile platform 14 includes a propulsion system 16. Propulsion system 16 can be, for example, an internal combustion engine, which can be a gasoline engine or a diesel engine. However, other types of propulsion systems can be used, including electric motors that can be powered by batteries, fuel cells, solar power, wind power, and the like. While propulsion system 16 can be positioned directly on mobile platform 14, propulsion system 16 can also be located on a separate propelling device, such as a locomotive.

In an exemplary embodiment, mobile platform 14 can include a plurality of fixed flanged wheels. In another exemplary embodiment, mobile platform 14 can include a conventional high-rail or hi-rail system 18 that includes flanged wheels that can be raised or lowered to permit mobile platform 14 to drive on streets if mobile platform is, for example, a truck that includes rubber-type tires suitable for paved road use. Mobile platform 14 can be self-propelled by wheels driven by propulsion system 16. As noted hereinabove, such wheels can be rubber-type tires. In another embodiment, propulsion system 16 can propel flanged wheels through a wheel motor arrangement.

Tie plate system 12 can also include a power supply 20 the serves to provide power to devices and apparatuses of tie plate system 12, as described in more detail hereinbelow. Tie plate system 12 can also include storage 22 for tie plates 10, a tie plate loader 24, a tie plate intake or input 26, a tie plate distributor 28, and a tie plate depositor or deposition system 30. Tie plate system 12 can also include a control system 32 configured to operate at least tie plate intake system 26, tie plate distributor 28, and tie plate depositor 30. Tie plate system 12 can also include sensors 34 described in more detail hereinbelow.

Generally, tie plate system 12 is configured to be operated by one person. The operator operates tie plate loader 24, which can be, for example, a crane that includes an electromagnetic, to lift tie plates 10 from tie plate storage 22 and transports tie plates 10 to tie plate intake system 26. Tie plate intake system 26 separates tie plates 10 from each other and guides tie plates 10 to tie plate distribution system 28. Tie plate distribution system 28 receives tie plates 10 from tie plate intake system 26, and guides tie plates 10 to tie plate deposition system 30. In an exemplary embodiment, tie plate distribution system 28 orients tie plates 10 to a predetermined orientation before transferring tie plates 10 to tie plate deposition system 30. Tie plate deposition system 30 receives tie plates 10 from tie plate distribution system 28, and positions tie plates 10 on the railroad bed or railroad track.

Control of the various element of tie plate system 12 is provided by control system 32, which can include one or more processors and a non-transitory computer- or machine-readable memory, as discussed in more detail herein. In an exemplary embodiment, control system 32 can control drives and actuators of tie plate intake system 26, tie plate distribution system 28, and tie plate deposition system 30. In an exemplary embodiment, control system 32 can control propulsion system 16 to control the speed of mobile platform 14 to assist in depositing tie plates 10 at specific locations on the railroad bed or railroad track.

Many aspects of the disclosure are described in terms of sequences of actions to be performed by elements of a computer system or other hardware capable of executing programmed instructions, for example, a general-purpose computer, special purpose computer, workstation, or other programmable data process apparatus. It will be recognized that in each of the embodiments, the various actions could be performed by specialized circuits (e.g., discrete logic gates interconnected to perform a specialized function), by program instructions (software), such as program modules, being executed by one or more processors (e.g., one or more microprocessors, a central processing unit (CPU), and/or application specific integrated circuit), or by a combination of both. For example, embodiments can be implemented in hardware, software, firmware, microcode, or any combination thereof. The instructions can be program code or code segments that perform necessary tasks and can be stored in a non-transitory machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

The non-transitory machine-readable medium can additionally be considered to be embodied within any tangible form of computer readable carrier, such as solid-state memory, magnetic disk, and optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information. It should be noted that the system of the present disclosure is illustrated and discussed herein as having various modules and units that perform particular functions.

It should be understood that these modules and units are merely described based on their function for clarity purposes, and do not necessarily represent specific hardware or software. In this regard, these modules, units, and other components may be hardware and/or software implemented to substantially perform their particular functions explained herein. The various functions of the different components can be combined or segregated as hardware and/or software modules in any manner, and can be useful separately or in combination. Input/output or I/O devices or user interfaces including, but not limited to, keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Sensors 34 can include sensors for determining the orientation of tie plates 10, and one or more cameras to identify locations of tie plates 10 as they are deposited on the railroad track or railroad bed. In an exemplary embodiment, the output of sensors 34 is transmitted to control system 32 to be used by the operator or user of railroad tie plate system 12 and/or control system 32 to automatically control operation of railroad tie plate system 12.

An exemplary embodiment of tie plate intake 26, tie plate distributor 28, and tie plate depositor 30 of tie plate system 12 is shown in more detail in FIG. 4.

Tie plate intake 26 can include a hopper 36 into which tie plates 10 are loaded. Hopper 36 can also be described as a bowl 36. Tie plate intake 26 can also include a hopper drive 38 used to drive a rotary plate described in more detail hereinbelow. In an exemplary embodiment, hopper drive 38 can include one or more wheel separators driven by a separator drive 40. The wheel separators help to disengage tie plates 10 from each other before tie plates 10 are transferred from hopper 36 to tie plate distributor 28. Tie plates 10 can also be separated from each other by way of a diverters, described in more detail herein.

Tie plate distributor 28 can include a plurality of ramps and tie plate diverters 42. To move tie plates 10 along the plurality of ramps and tie plate diverters 42, tie plate distributor 28 can be reciprocally vibrated by a plurality of vibrators 44. In an exemplary embodiment, vibrators 44 can be electromagnets driven by a power supply 46 that is controlled by control system 32. It should be noted that power supply 46 can be part of power supply 20, or can be a separate power supply from power supply 20. Tie plate distributor 28 can also include a plurality of ejectors 48 that can include sensors 50 to detect an orientation of tie plates 10 prior to transfer of tie plates 10 from tie plate distributor 28 to tie plate depositor 30 by ejectors 48.

In an exemplary embodiment, tie plate depositor 30 includes a magazine 52, a tie plate transfer 54, and a delivery ramp 56. After ejector 48 operates, tie plate 10 rotates as it leaves ejector 48 to be in proper orientation for entry into magazine 52. Magazine 52 receives and guides tie plate 10 into an upper end of magazine 52, where a plurality of tie plates 10 are positioned for feeding tie plate transfer 54. Tie plate transfer 54 moves each tie plate 10 from a bottom of magazine 52. Tie plate transfer 54 can deliver tie plates 10 directly to a railroad bed 58, which includes rails 60 and railroad ties 62, or tie plate transfer 54 can deliver tie plates 10 to ramp 56. When tie plate transfer 54 drops tie plate 10 onto railroad track, railroad bed, or rail bed 58, because of the position of magazine 52, tie plate 10 drops at a location that is outside of rails 60, i.e., in a location that is not between rails 60. A location that is outside or not between rails 60 is called a "field side" of railroad track 58. If optional ramp 56 is in use, tie plates 10 can be delivered between rails 60, a location known as being "in the gauge."

As described herein, a sensor 64 can be positioned in a location to sense or view tie plate 10 positioned on railroad track or bed 58. In an exemplary embodiment, sensor 64 can be, for example, a camera. However, in an alternative embodiment, sensor 64 can be an inductive, magnetic, or other sensor configured to detect a metallic object.

Figure 10:
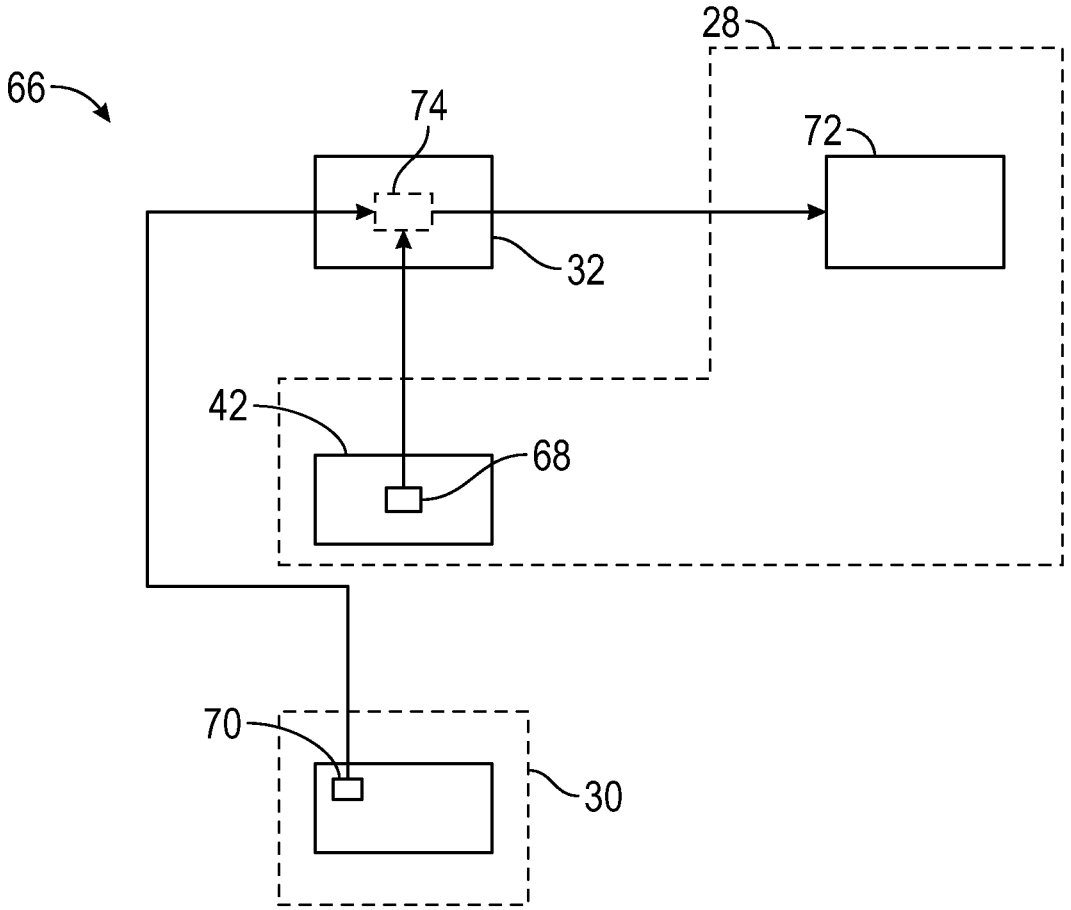
FIG. 10 shows a counting system of the railroad tie plate delivery system of FIG. 4 in accordance with an exemplary embodiment of the present disclosure.

As shown in FIG. 10, railroad tie plate system 12 can include a counting system 66 to maintain a pre-determined quantity of tie plates 10 in magazines 52. Counting system 66 can include a sensor 68, which can be, for example, an inductive sensor, that determines the number of tie plates travelling down ramps and diverters 42. Each time a tie plate 10 passes sensor 68, sensor 68 sends a signal to control system 32, which keeps track of the number of tie plates travelling along ramps and diverters 42 toward magazine 52. If magazine 52 is not depositing tie plates 10 on railroad track or bed 58, when the number of tie plates that has passed sensor 68 is sufficient to fill magazine 52, then control system 32 sends a signal to operate an actuator 72, which opens a bypass door, described further hereinbelow, to direct tie plates 10 to tie plate storage 22. Because actuator 72 is directly connected to ramp and diverters 42, actuator 72 is also part of tie plate distributor 28. In an exemplary embodiment, the vibrators of tie plate distribution system 28 operate continuously, which in an exemplary embodiment is preferable to maximize the life of vibrators 44. The bypass door remains open as long as the magazine is "full," meaning having a predetermined number of tie plates for a size of the tie plates, as described in more detail hereinbelow.

Counting system 66 also includes a sensor 70 positioned in an exemplary embodiment on tie plate magazine 52, in another exemplary embodiment on tie plate transfer 54, and in yet another exemplary embodiment on ramp 56. Sensor 70 can be, for example, a switch, a camera, and other sensors configured to determine proximity of tie plate 10. Sensor 70 is also part of tie plate depositor or deposition system 30 since sensor 70 is either directly or indirectly connected to tie plate depositor 30. As one tie plate 10 is moved from magazine 52 by tie plate transfer 54 to railroad track or bed 58, which can be by way of ramp 56, sensor 70 detects the passing of tie plate 10, and sensor 70 then transmits to control system 32, which is configured to receive the signal from sensor 70. Control system 32 includes a processor 74 that uses the signal from sensor 70 to decrement a counter indicating the number of tie plates 10 in magazine 52. Control system 32 recognizes magazine 52 is one tie plate below the predetermined number of tie plates because of the signal from sensor 70, so control system 32 sends a signal to actuator 72 to close the bypass door, which enables a next tie plate 10 to travel down ramps and diverters 42 to tie plate depositor 30. If only a single tie plate 10 is needed, control system 32 operates actuator 72 to open the bypass door after the single tie plate 10 passes sensor 68.

In an exemplary embodiment, magazine 52 is loaded with a predetermined number of tie plates 10. For example, if magazine 52 is configured to hold tie plates that are 18 inches wide from the gauge side to the field side, in an exemplary embodiment magazine 52 can be configured to hold eight tie plates 10. Because tie plates 10 can undesirably flip upside down or sideways during drop or fall from a top of magazine 52 to a bottom of magazine 52, preloading eight tie plates 10 virtually eliminates the risk that tie plate 10 will flip into an undesired orientation when receiving tie plate 10 from tie plate distributor 28. In another embodiment, five tie plates 10 that are 14 inches wide are positioned in magazine 52, which is considered a full load of tie plates 10 for 14-inch-wide ties plates. As described further herein, magazine 52 includes adjustments to change an internal width of magazine 52 to accommodate different width tie plates.

Figure 6:
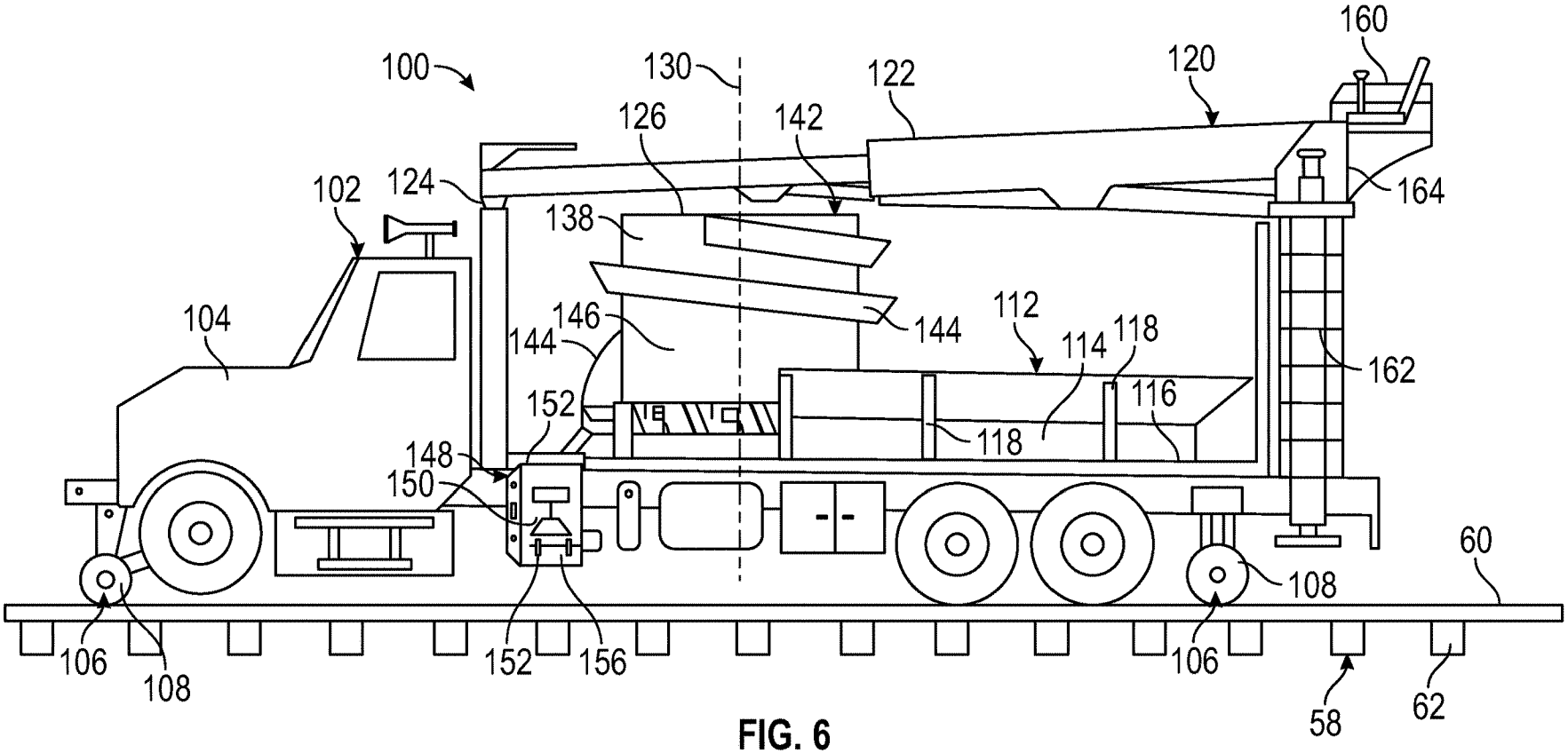
FIG. 6 shows an elevation view of the railroad tie plate delivery system shown in FIG. 5.

FIGS. 5 and 6 show views of a railroad tie plate delivery system 100 in accordance with a further exemplary embodiment of the present disclosure. System 100 includes a mobile platform 102 in the form of a truck. Truck 102 includes a propulsion system 104 in the form of an internal combustion engine. Propulsion system 104 can also include an electric motor, a steam engine, a fuel cell, a hydraulic drive, and other propulsion devices. Truck 102 also includes a high-rail 106 that includes a plurality of flanged wheels 108 that are sized and dimensioned to support truck 102 on rails 60.

Positioned on truck 102 is a storage area 112. Storage area 112 can be a separate bin or hopper that is mounted or positioned on truck 102. Storage area 112 can also be formed by positioning a plurality of walls 114 directly on a bed 116 formed as a part of truck 102. Walls 114 can be supported on truck bed 116 by a plurality of stakes 118 that extend into appropriately sized and dimensioned supports formed in or on truck bed 116.

System 100 includes a tie plate loader 120 in the form of a crane 122. Crane 122 supports an electromagnet 124 operable to pick up tie plates 10 from storage area 112. Crane 122 can be a conventional crane including hydraulic controls that raise, lower, extend, and rotate an end of crane 122 so that electromagnet 124 is moved to pick up tie plates 10 and to then deliver tie plates 10. It should be noted that crane 122 may also be used to replenish storage area 112 with tie plates 10 when the quantity of tie plates 10 in storage area 112 is such that replenishment is needed.

System 100 includes a tie plate intake or input 126 in the form of an open hopper or bowl. Tie plates 10 are loaded into hopper or bowl 126, which can be by way of crane 122. Bowl 126 includes a rotating base or bottom 128. Base or bottom 128 rotates around an axis 130 that is generally vertical, or perpendicular to bed 116. Base or bottom 128 is driven by a motor positioned internal to a vertical wall 146 of a tie plate distributor 142, described in more detail herein. Because of manufacturing tolerances, generally vertical or perpendicular can be within plus or minus ten degrees of vertical or perpendicular to bed 116, more preferably within plus or minus five degrees of vertical or perpendicular to bed 116, and most preferably within plus or minus 1 degree of vertical or perpendicular to bed 116. While truck 102 can be oriented at various angles with respect to railroad track or bed 58, on average truck 102 will be generally or approximately horizontal, meaning within a few degrees of horizontal.

Figure 11:
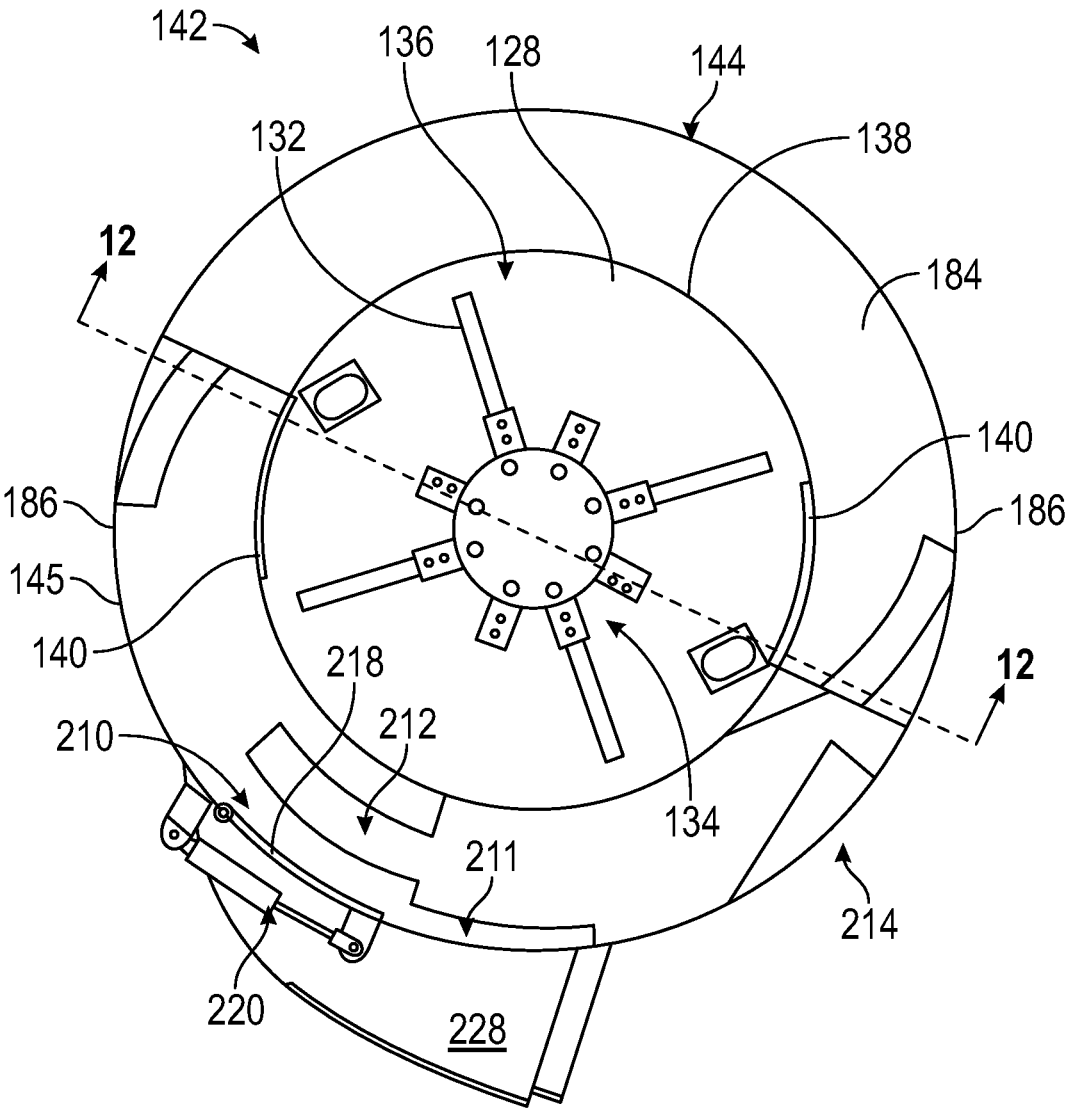
FIG. 11 shows a top plan view of a tie plate distributor in accordance with an exemplary embodiment of the present disclosure.
Figure 12:
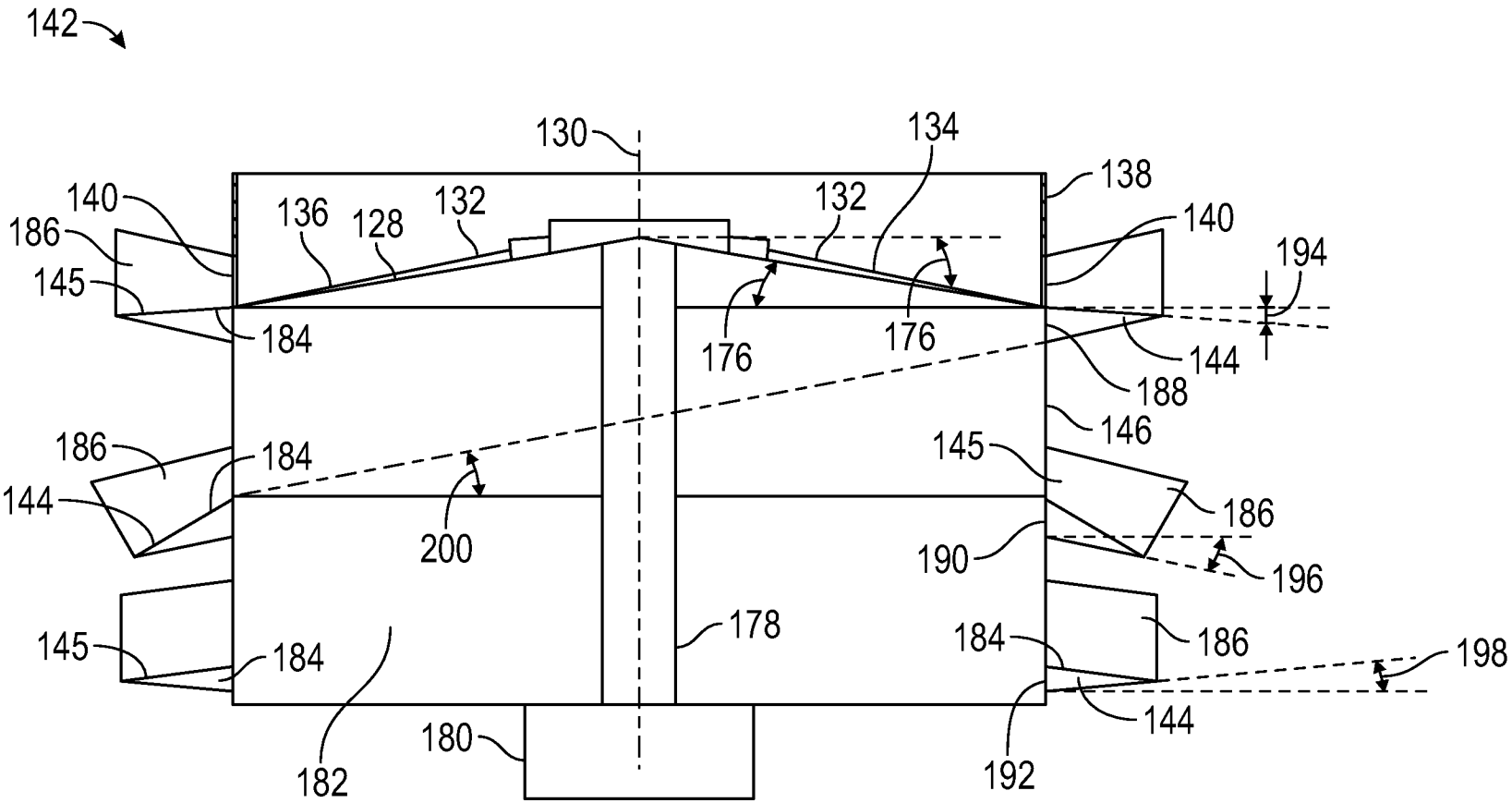
FIG. 12 shows a sectional view of the tie plate distributor of FIG. 11 along the lines 12-12.

Referring to FIGS. 11 and 12, tie plate distributor 142 includes a drive shaft and bearing assembly 178, which is driven by a motor 180. Drive shaft and bearing assembly 178 are drivingly connected to base or bottom 128. Such connection can be a direct connection, or a connection through brackets, frame pieces, and the like. Motor 180 can be directly supported by tie plate distributor 142, or motor 180 can be supported by, for example, truck bed 116 of truck 102. The bearings of drive shaft and bearing assembly 178 will have the greatest durability or life when rotation axis 130 is vertical as compared to a horizontal plane. Accordingly, if bed 116 is at an angle with respect to a true horizontal plane when truck 102 aligns with a horizontal plane, rotation axis 130 is preferably parallel to an earth normal direction rather than being perpendicular to bed 116.

Base or bottom 128 includes a plurality of arms 132 that extend along base or bottom 128. In an exemplary embodiment, base, or bottom 128 is shaped as a cone or convex shape, with the center of base or bottom 128 being the highest or furthest point from railroad track or bed 58. In an exemplary embodiment, an angle 176 of the cone is approximately 10 degrees from horizontal. However, as base or bottom 128 rotates, arms 132 in combination with gravity and vibration cause tie plates 10 to move outwardly from a center or central area 134 of rotating bottom 128 to a periphery or peripheral area 136 of rotating bottom 128. It should be apparent from FIG. 5 that hopper or bowl 126 includes a wall 138 that extends upwardly, being a direction that is away from railroad track 58, from base or bottom 128. When tie plate 10 encounters wall 138, arms 132 push tie plate 10 along wall 138. Wall 138 includes two openings 140, a bottom of each opening 140 is at or below base or bottom 128, described in more detail hereinbelow. When tie plate 10 encounters opening 140, tie plate 10 is driven through opening 140 through the force of gravity, vibration, and contact with arms 132. As tie plate 10 passes through opening 140, of which there are two in the exemplary embodiment of FIGS. 5 and 6, tie plate 10 passes from tie plate intake or input 126 to tie plate distributor 142.

In the exemplary embodiment of FIGS. 5 and 6, tie plate distributor 142 includes two concentric ramps 144 and 145, and a vertical wall 146, each ramp 144 and 145 extending from a respective opening 140 around a periphery of vertical wall 146 that extends downwardly from hopper wall 138 to a location near a bottom of tie plate distributor 142. In an exemplary embodiment, vertical wall 146 can be an extension of hopper wall 138. In another exemplary embodiment, vertical wall 146 can be a separate wall from hopper wall 138. Vertical wall 146 can serve multiple functions. One function is to provide structural support for ramps 144 and 145. Another function is to prevent access to an interior 182 of tie plate distributor 142, which could present a safety issue during operation of tie plate distributor 142.

After passing through opening 140, tie plate 10 enters one of ramps 144 and 145, which guides tie plate 10 downwardly from opening 140 to a tie plate depositor 148. Movement of tie plates 10 is accomplished by a combination of gravity and reciprocal vibration of tie plate distributor 142 around axis 130, an exemplary embodiment of which is described in more detail hereinbelow. The configuration of ramps 144 and 145 is such that tie plate 10 is oriented so that a long dimension of tie plate 10 from the field side to the gauge side extends along a direction of ramp 144 or ramp 145. In other words, a narrow or width dimension of tie plate 10 extends from an inside, inboard, or inner direction of ramp 144 or 145 to an outside, outboard, or outer direction of ramp 144 or 145 with respect to vertical wall 146.

It should be noted that tie plates 10 can enter ramp 144 or 145 either upside down or right side up, with the field side oriented on a forward side or a rear side with respect to a direction of travel of tie plate 10 along ramp 144 or 145. To position tie plate 10 for entry into tie plate depositor 148, tie plate distributor can include a plurality of features to properly orient tie plate 10 for deposition on railroad track or bed 58. One such function is to orient tie plate 10 so a bottom or railroad tie side of tie plate 10 is oriented to be against a bottom of ramp 144 or 145. Another function is to orient tie plate 10 for entry into tie plate depositor 148 so that the field side and the gauge side of tie plate 10 are properly oriented for deposition on rail bed 58. The orientation functions of railroad tie plate delivery system 100 are described in more detail hereinbelow.

As noted hereinabove, system 100 includes tie plate depositor or deposition system 148. Deposition system 100 includes a magazine 150, and a tie plate transfer 152, which is a drive device that moves or transfers tie plate 10 from a bottom of magazine 150 to rail bed 58 or to a delivery ramp (not shown in FIGS. 5 and 6) that is part of deposition system 148. Deposition system 148 receives tie plate 10 from tie plate distributor 142. More specifically, tie plate 10 is moved by tie plate distributor 142 to one of two magazines 150, each of which is located on an opposite side (left and right side) of truck 102. Each magazine 150 can hold a plurality of tie plates 10, and tie plate intake or input 126 and tie plate distributor 142 are configured to feed tie plates 10 to each magazine 150 at a rate that is, on average, higher than a rate at which tie plates 10 are deposited by tie plate depositor 148.

Each magazine 150 includes an upper, top, or first end 154 and a lower, bottom, or second end 156. Each magazine 150 receives tie plates 10 at upper end 154. Tie plate transfer 152 is positioned at lower end 156. Thus, tie plates 10 move under the force of gravity from first end 154 to second end 156, coming to rest on tie plate transfer 152. Tie plate transfer 152 moves horizontally under tie plates 10 stacked in magazine 150, pushing one tie plate 10 at a time from a bottom of magazine 150, depositing one tie plate 10 at a time to railroad bed 58 or to the delivery ramp (not shown in FIGS. 5 and 6).

It should be observed in FIG. 5 that bed 116 has an outer edge on each of a left side and a right side of truck 102. Bed 116 is essentially near a maximum width permissible for operation on streets and highways, which is typically 8.5 feet in width. Being able to deposit tie plates 10 in the gauge, or between rails 60, presents a challenge in that a ramp that extends from tie plate transfer 152 to a location between rails 60 that is excessively steep will cause tie plates to tumble or slide upon deposition on railroad track or bed 58. However, with magazines 150 facing each other, the distance ramps are able to extend is limited. However, since the width of bed 116 is near the 8.5 feet maximum width, to provide extra space for delivery ramps (not shown in FIGS. 5 and 6) to extend, and to provide an orientation that simplifies transfer from tie plate distributor 142, in an exemplary embodiment magazines 150 are oriented at an angle 158 from a transverse direction perpendicular to a front-back direction of truck 102 and at an angle 166 from a side or edge of bed 116.

Angle 158 is approximately 71 degrees, and angle 166 is approximately 19 degrees. However, it should be understood that in an exemplary embodiment, angle 158 can be in a range from 66 degrees to 76 degrees. In another exemplary embodiment, angle 158 can be in a range from 68 degrees to 74 degrees. In a most preferable embodiment, angle 158 can be in a range from 69 degrees to 72 degrees. In each case, angle 166 is generally complementary to angle 158. In this context, the term generally complementary means within two degrees of complementary.

Accordingly, if angle 158 is 71 degrees, angle 166 can be in a range from 17 degrees to 21 degrees. Such variation is possible due to manufacturing tolerances, which may cause angle 158 plus angle 166 to be in a range of about 88 degrees to 92 degrees.

To enable the position of magazines 150 shown in FIG. 5, bed 116 includes a cutout 168 at the location of magazines 150 so that most, and preferably all, of magazines 150 are located within a maximum width of bed 116. Thus, magazines 150 may extend slightly past bed 116, but will not extend such that a width between a furthest left location on left magazine 150 to a further right location on right magazine 150 is more than 8.5 feet. It should be understood that in an exemplary embodiment, all of magazines 150 in a plan view, i.e., looking downwardly on mobile platform 102 and bed 116, will be located such that magazines 150 are located within the width of bed 116. Accordingly, if bed 116 has width of 8 feet and 5 inches, a maximum distance from an outer edge of left magazine 150 to an outer edge of right magazine 150 is preferably less than or equal to 8 feet and 5 inches. More broadly, in an exemplary embodiment, a maximum distance from an outer edge of left magazine 150 to an outer edge of right magazine 150 is less than a maximum distance from the left side of bed 116 to the right side of bed 116 when viewing bed 116 and magazines 150 in a plan view.

FIGS. 5 and 6 show other features of truck 102. Truck 102 includes a system 100 operator platform 160 located at a back end of truck 102. Operator platform 160 is accessible by way of a ladder 162 and access walkway 164. Operator platform 160 includes all controls needed to operate system 100, which in an exemplary embodiment includes the ability to brake and control the speed of truck 102, which means that the operator or user occupying operator platform 160 is the only human needed to operate system 100. The ability to operate an entire tie plate delivery system such as system 100 with a single operator is a significant improvement in the cost of labor over conventional systems, which can require 3-5 operators, or more.

Figure 7:
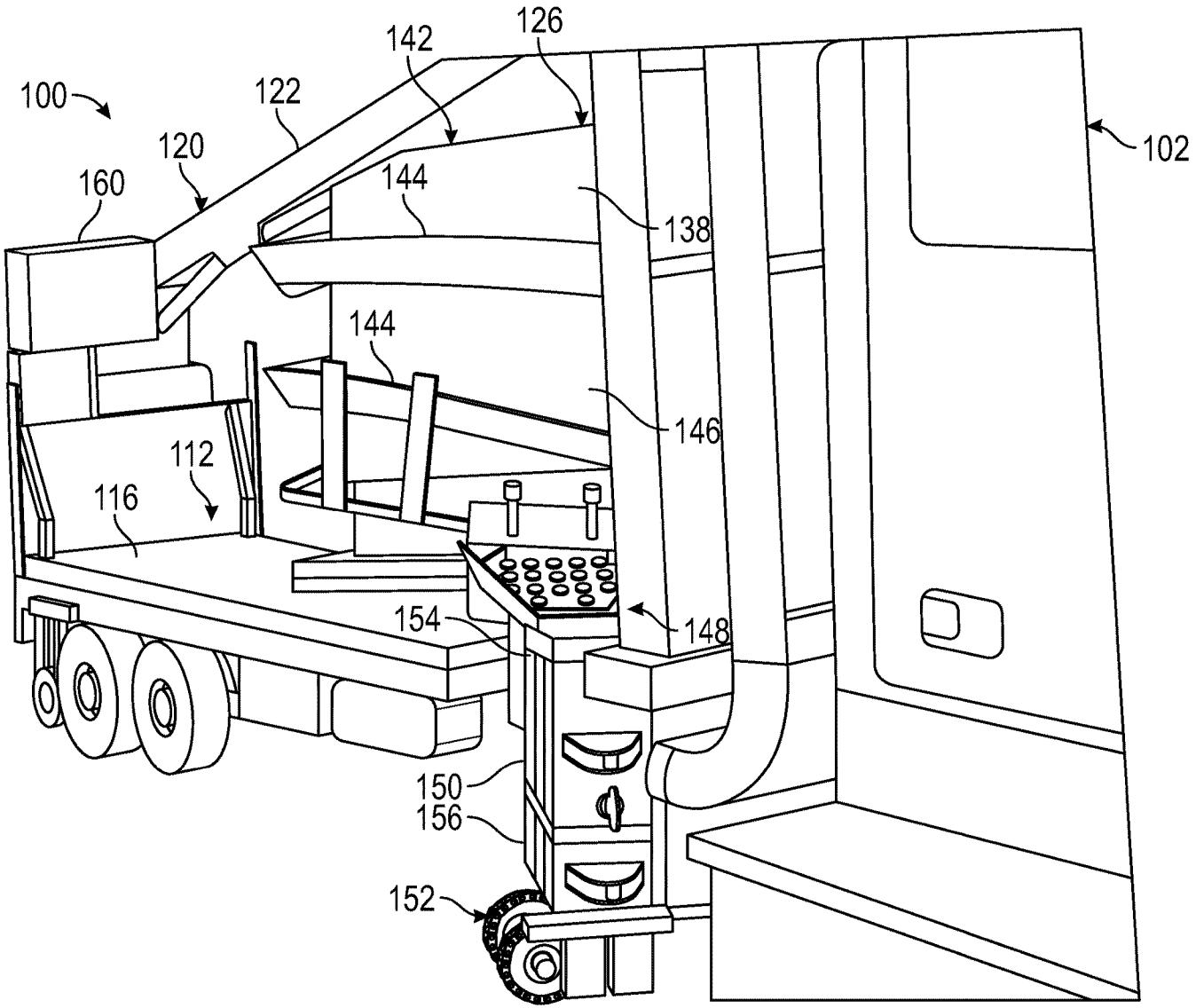
FIG. 7 shows a perspective view of the railroad tie plate delivery system of FIG. 5.

FIG. 7 show a perspective view of a right, rear side of railroad tie plate delivery system 100, showing certain features of system 100. Walls 114 of storage 112 are removed in the view of FIG. 7.

Figure 8:
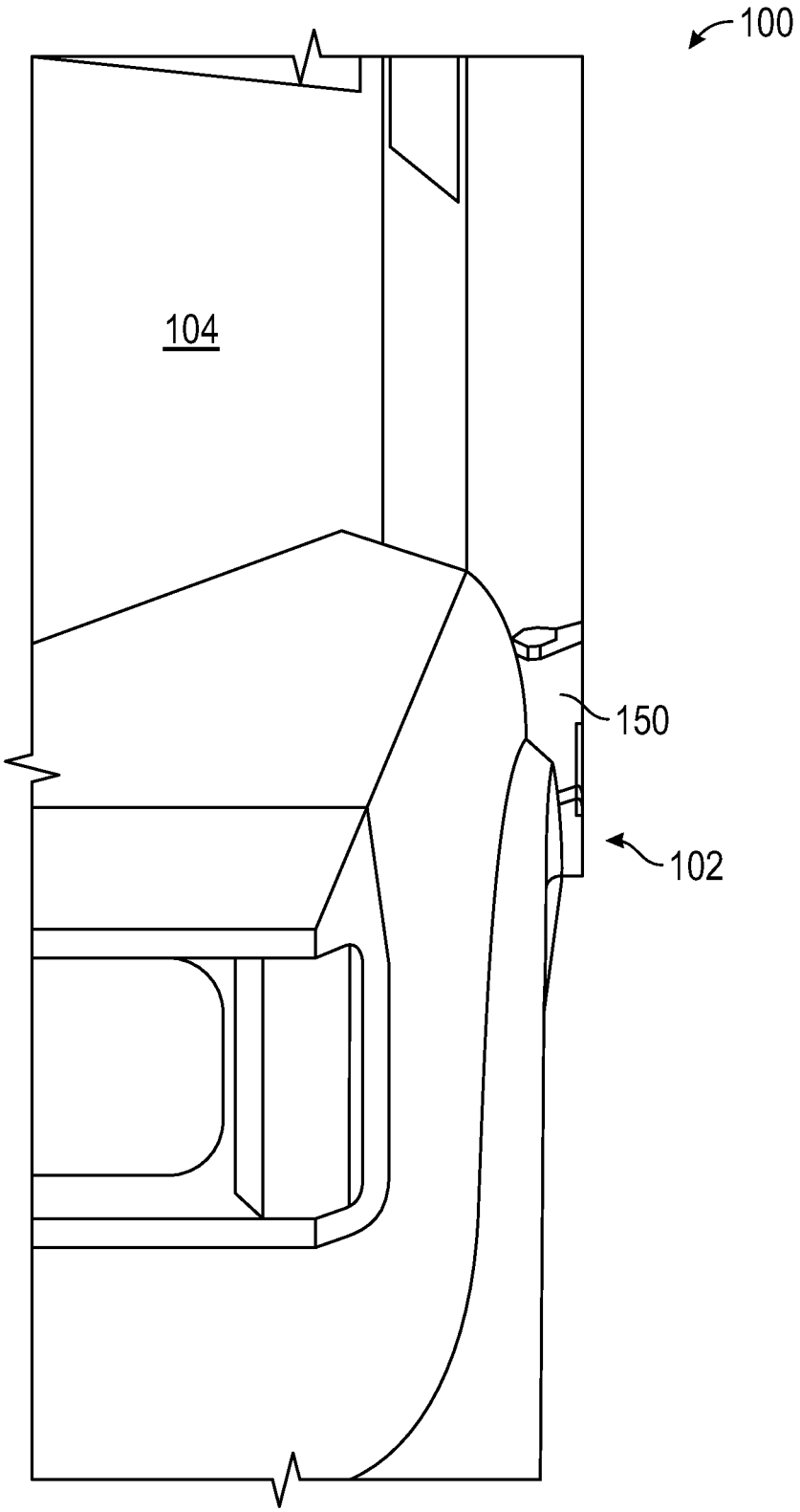
FIG. 8 shows a front elevation view of the railroad tie plate delivery system of FIG. 5.

FIG. 8 shows a view along a left side of railroad tie plate delivery system 100, showing that magazine 150 does not extend past a left side edge of bed 116.

Figure 9:
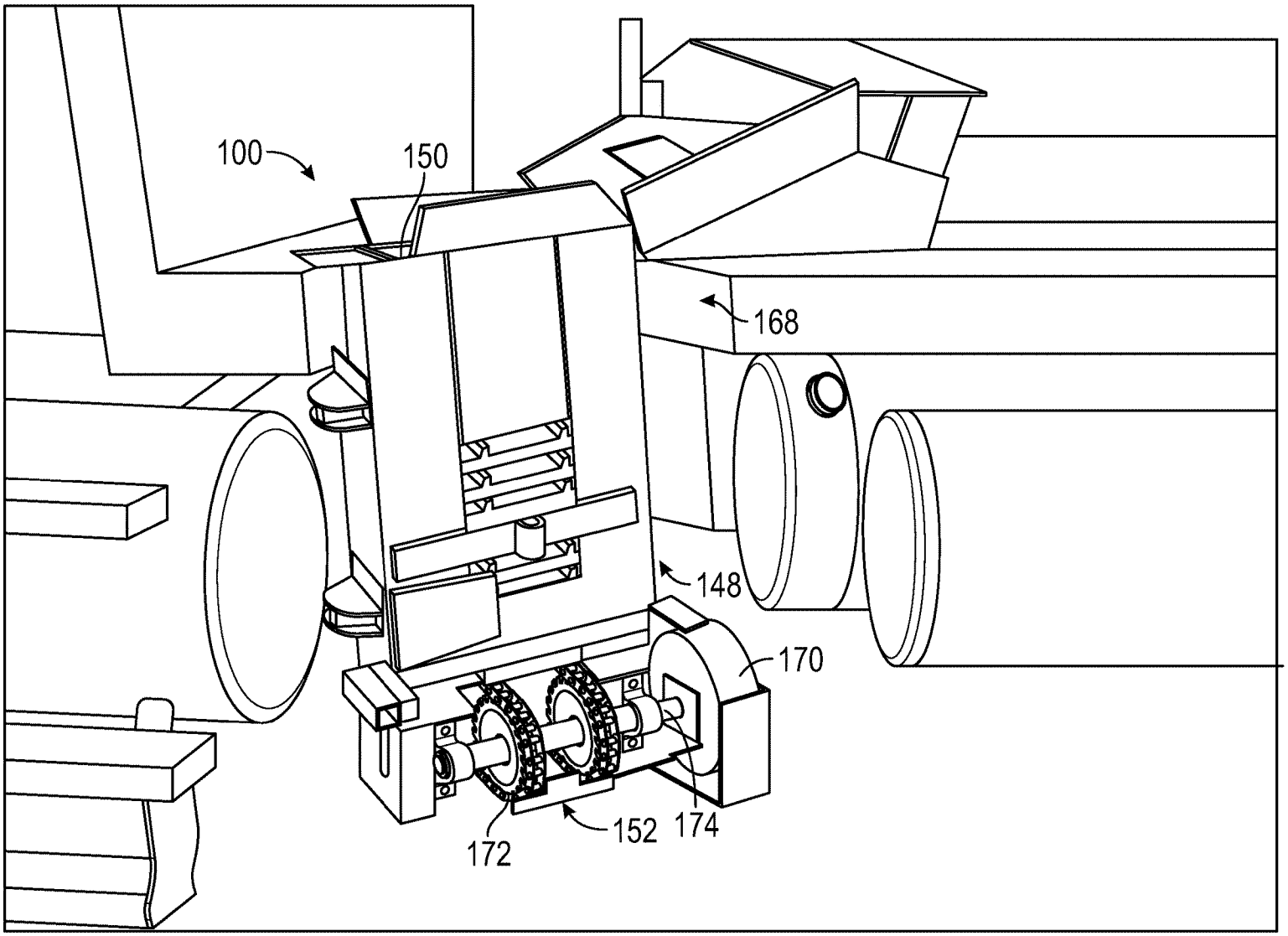
FIG. 9 shows a view of a portion of the railroad tie plate delivery system of FIG. 5.

FIG. 9 shows a view of tie plate depositor 148 and tie plate transfer 152. Tie plate transfer 152 includes a motor 170, a chain drive 172, and a drive shaft 174 that connects an output torque of motor 170 to chain drive 172. Additional details of tie plate transfer 152 are disclosed in U.S. Pat. No. 10,487,458, which is incorporated by reference in its entirety. Tie plate transfer 152 is driven by an electric motor in the embodiment of FIG. 9, but tie plate transfer 152 can also be driven by a hydraulic motor. The function of tie plate transfer 152 is to move or transfer tie plates 10 from magazine 150 to a delivery ramp (not shown in FIG. 9) or directly to railroad bed 58.

Referring to FIG. 12, each of ramps 144 and 145 can include a ramp floor, bottom, base, or bed 184, and a ramp wall 186. Ramp floor 184 can be angled from a horizontal plane as ramp floor extends radially outward from wall 146, and an angle of ramp floor 184 can change as each ramp 144 or 145 extends circumferentially around ramp wall 186. The angle of ramp floor 184 can have at least one specific purpose at each circumferential location on ramp wall 186. Ramp wall 186 is connected to ramp floor 184, and extends upwardly or vertically away a direction of gravity. However, in an exemplary embodiment ramp wall 186 can be parallel to an earth normal direction or can be at an angle to earth normal, which is an upward vertical direction. In another exemplary embodiment, ramp wall 186 can angle radially away from wall 146 as ramp wall 186 extends from ramp floor 184.

Wall 146 can be considered to include a top 188, a middle 190, and a bottom 192. The terms top, middle, and bottom are with reference to a vertical or earth normal direction, with top being vertically toward an up direction and bottom being toward a down direction. Near top 188, in an exemplary embodiment ramp bottom 184 of ramp 144 or 145 can be angled downwardly from top 188 of wall 146 at an upper ramp angle 194 that is approximately 3 degrees. In another embodiment, upper ramp angle 194 can be in a range that is about 1 degree to 10 degrees. Upper ramp angle 194 serves at least two functions. First, as tie plate 10 travels circumferentially around wall 146, upper ramp angle 194 causes tie plate 10 to move toward ramp wall 186. Additionally, upper ramp angle 194 is sufficient to cause tie plate 10 to enter the bypass opening, described in more detail hereinbelow.

As ramp floor 184 extends circumferentially around wall 146, the downward angle of ramp bottom 184 can increase to ramp angle 196, which in an exemplary embodiment can be approximately 30 degrees. Ramp angle 196 in combination with a downward angle 200 of ramp floor 184 around the circumference of wall 146 causes tie plates 10 to travel toward a bottom end of ramps 144 and 145 at a speed sufficient to replenish magazine 150 faster than tie plates 10 are transferred from magazine 150 to rail bed 58. As ramp floor 184 nears bottom 192 of wall 146, an angle 198 of ramp floor 184 reverses to move tie plate 10 away from ramp wall 186 toward vertical wall 146 in preparation for the entry of tie plate 10 into tie plate depositor 148. In an exemplary embodiment, bottom ramp angle 198 can be in a range of 1 degree to 3 degrees angled upwardly from vertical wall 146. In another exemplary embodiment, bottom ramp angle 198 can be in a range of 1 degree to 5 degrees angled upwardly from vertical wall 146.

Circumferential downward ramp angle 200 can vary as ramp bottom extends circumferentially from top 188 of wall 146 to bottom 192 of wall 146. In an exemplary embodiment, downward ramp angle 200 can be in a range from about 5 degrees to about 9 degrees. In another exemplary embodiment, downward ramp angle 200 can be in a range from about 4 degrees to about 15 degrees. It should be noted that ramp angle 200 can change with circumferential position, depending on manufacturing tolerances and depending on a particular speed needed to move tie plate 10 from one location on ramp 144 to another location on ramp 144.

Figure 13:
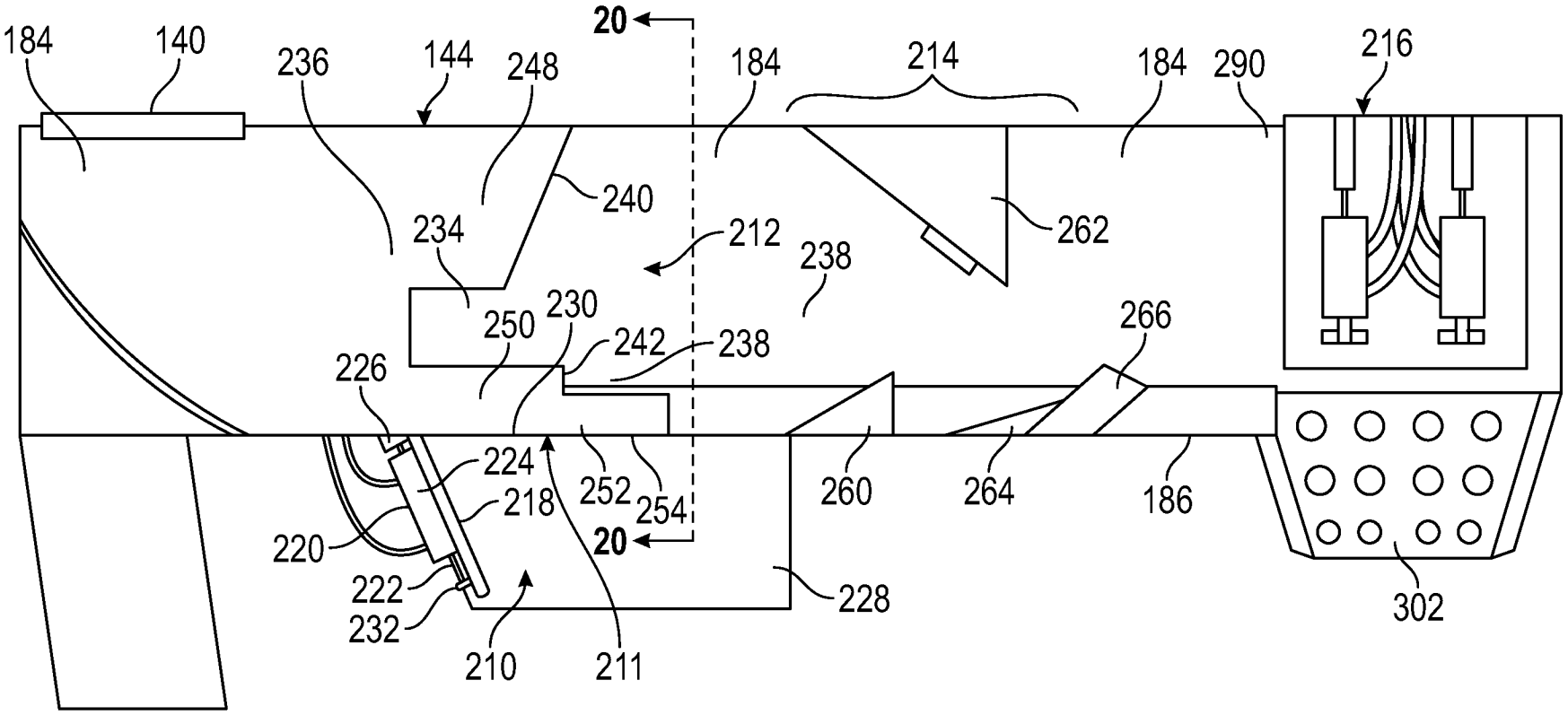
FIG. 13 shows a schematic view of tie plate diverters of the railroad tie plate delivery system of FIG. 4 in accordance with an exemplary embodiment of the present disclosure.

Railroad tie plate delivery system 100 includes a plurality of diverters for handling of tie plates 10. The diverters can be similar to diverters 42 used with tie plate system 12. Referring to FIG. 13, which shows a schematic view of one ramp 144 as though ramp 144 were straight rather than circumferential, the diverters can include a bypass diverter 210, a stacked tie plate diverter 211, a first flip diverter 212, a second flip diverter 214, and a field-gauge diverter 216.

Referring to FIGS. 11-19, tie plates 10 enter ramp 144 from opening 140 formed in tie plate distributor 142. Also as described hereinabove, if magazine 150 is full, a bypass door 218 is actuated by control system 32 to direct tie plates from ramp 144 to tie plate storage 22. More specifically, bypass diverter 210 includes an actuator 220 that is connected to a bypass door 218. In an exemplary embodiment, bypass door 218 is directly and rotatably attached to ramp structure 144, such as a bypass ramp 228, by way of a door hinge 244. In an exemplary embodiment, actuator 220 can be a pneumatic actuator controlled by control system 32. When actuator 220 is operated, a rod 222 is retracted into a body 224 of actuator 220. Actuator 220 is rotatably mounted on a hinge 226 that is fixedly connected to, for example, ramp wall 186 or to another fixed part of system 100, such as tie plate distributor 142. Rod 222 is movably attached to bypass door 218 by a door pivot 232, which enables relative motion between rod 222 and bypass door 218. When rod 222 is retracted into body 220 of actuator 220, the force of retraction causes bypass door 218 to swing open to the position shown in FIGS. 13 and 19 by rotating around a longitudinal axis of door hinge 144 until bypass door 218 contacts a door stop 246, which is directly mounted on bypass ramp 228. The opening of bypass door 218 connects ramp 144 with bypass ramp 228 by way of a bypass opening 230 formed in ramp wall 186. Bypass ramp 228 receives a tie plate 10 from ramp 144, where tie plate 10 has been sliding along and contacting ramp bottom 184 and ramp wall 186. Tie plate 10 contacts and slides along open bypass door 218, moving from ramp bottom 184 into bypass slide 228, which guides tie plate 10 to tie plate storage 22. Bypass ramp 228 is at or below ramp bottom 184 in an area of bypass ramp 228 that is directly adjacent to ramp bottom 184. From the location where ramp 228 is directly adjacent to ramp bottom 184, bypass ramp 228 extends at a downward angle. Thus, gravity and vibration help tie plate 10 move along bypass ramp 228 to return to tie plate storage 22, or another suitable location.

Immediately after bypass diverter 210 is stacked tie plate diverter 211. In an exemplary embodiment, stacked tie plate diverter 211 includes a wall 254 that is approximately 0.5 inches high and approximately 19 inches long that is positioned circumferentially at a same radius as ramp wall 186, which in an exemplary embodiment is about 42 inches from axis of rotation 130. When bypass door is closed, a downstream end of bypass door 218, meaning an end of bypass door 218 that is in a direction of movement of tie plates 10 when tie plate distributor 142 is operating, is approximately even or flush with stacked plate wall 254, so that a tie plate moving along upper ramp bottom 236 moves freely from contact with bypass door 218 to contact with stacked plate wall 254.

Because openings 140 through hopper wall 138 can be taller than two stacked tie plates 10 to reduce the risk of tie plates 10 binding as they travel from hopper base or bottom 128 to ramps 144 and 145, two tie plates 10 can pass through opening 140 stacked on top of each other. The function of stacked tie plate director 211 is to separate an upper tie plate 10 from a lower tie plate 10 so that lower tie plate 10 can continue to travel down ramp 144 or 145 while upper tie plate 10 can return to tie plate storage 22, such as, for example, by way of bypass ramp 228. As two tie plates travel along ramp bottom 184, bottom tie plate 10 is retained or restrained on ramp bottom 184, first upper ramp bottom 236 and then outer support 250, by stacked plate diverter wall 254, which extends upwardly from upper ramp bottom 236 and outer support 250. However, since the height of diverter wall 254 is less half the height of one tie plate 10, the upper tie plate 10 stacked on the lower tie plate 10 is not similarly retained. Further, and as described herein, each of ramp 144 and 145 is angled downwardly from horizontal at an angle that is approximately 10 degrees from vertical wall 146 at the location of diverter wall 254. Accordingly, under the force of gravity in combination with the vibration of tie plate distributor 142, the upper tie plate 10 slides from a top of the lower tie plate 10 over a top of diverter wall 254, and then onto bypass ramp 228 or directly into tie plate storage 22. Accordingly, only single tie plates 10 travel past stacked tie plate diverter 211.

After passing stacked tie plate diverter 211, the next diverter tie plate 10 encounters is first flip diverter 212. First flip diverter 212 includes a flip cutout 234 formed in an upper ramp bottom 236 that is a part of ramp 184. Cutout 234 includes an inner or inboard support 248 and outer or outboard support 250, each of which extend directly from upper ramp bottom 236, or can extend from below upper ramp bottom 236. As can be seen in FIG. 13, inner support 248 extends a shorter distance from upper ramp bottom 236 as compared to outer support 250, which aids in positioning of tie plates 10. In an exemplary embodiment, outer support 250 extends approximately 16.5 inches from ramp wall 186, and cutout 234 is approximately 3.5 inches wide. The width of outer support 250 and the width of cutout 234 is such that tie plate 10 is supported by outer support 250 and inner support 248 for at least a portion of the travel of tie plate 10 along ramp bottom 184. Outer support 250 extends approximately 5 inches from upper ramp bottom 236, after which a second outer support 252 having a width of about 2.5 inches extends from outer support 250 for approximately 28 inches.

Figure 14:
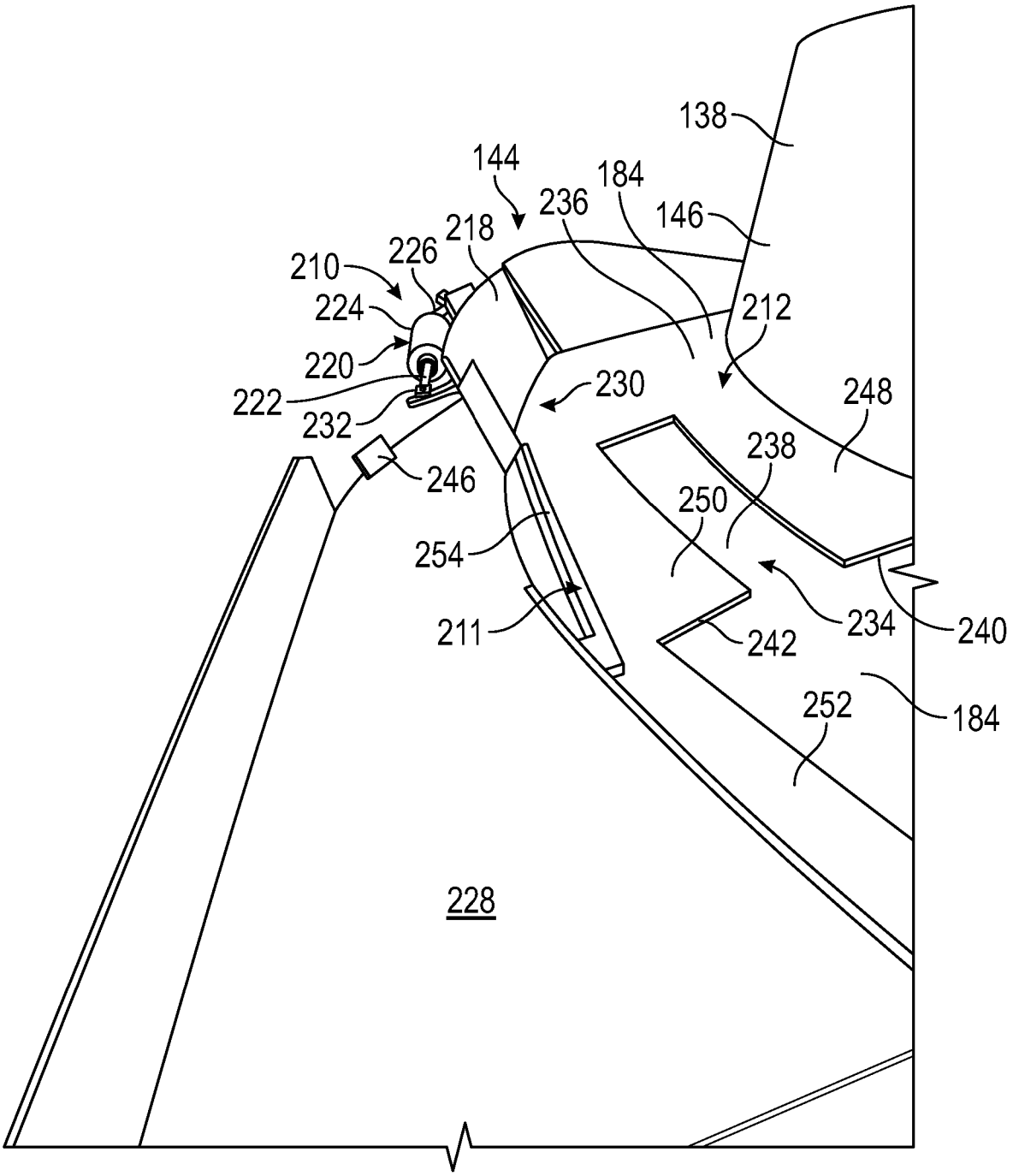
FIG. 14 shows a perspective view of a bypass diverter, a stacked tie plate diverter, and a first flip diverter, with a bypass door of the bypass diverter in a closed position, in accordance with an exemplary embodiment of the present disclosure.
Figure 15:
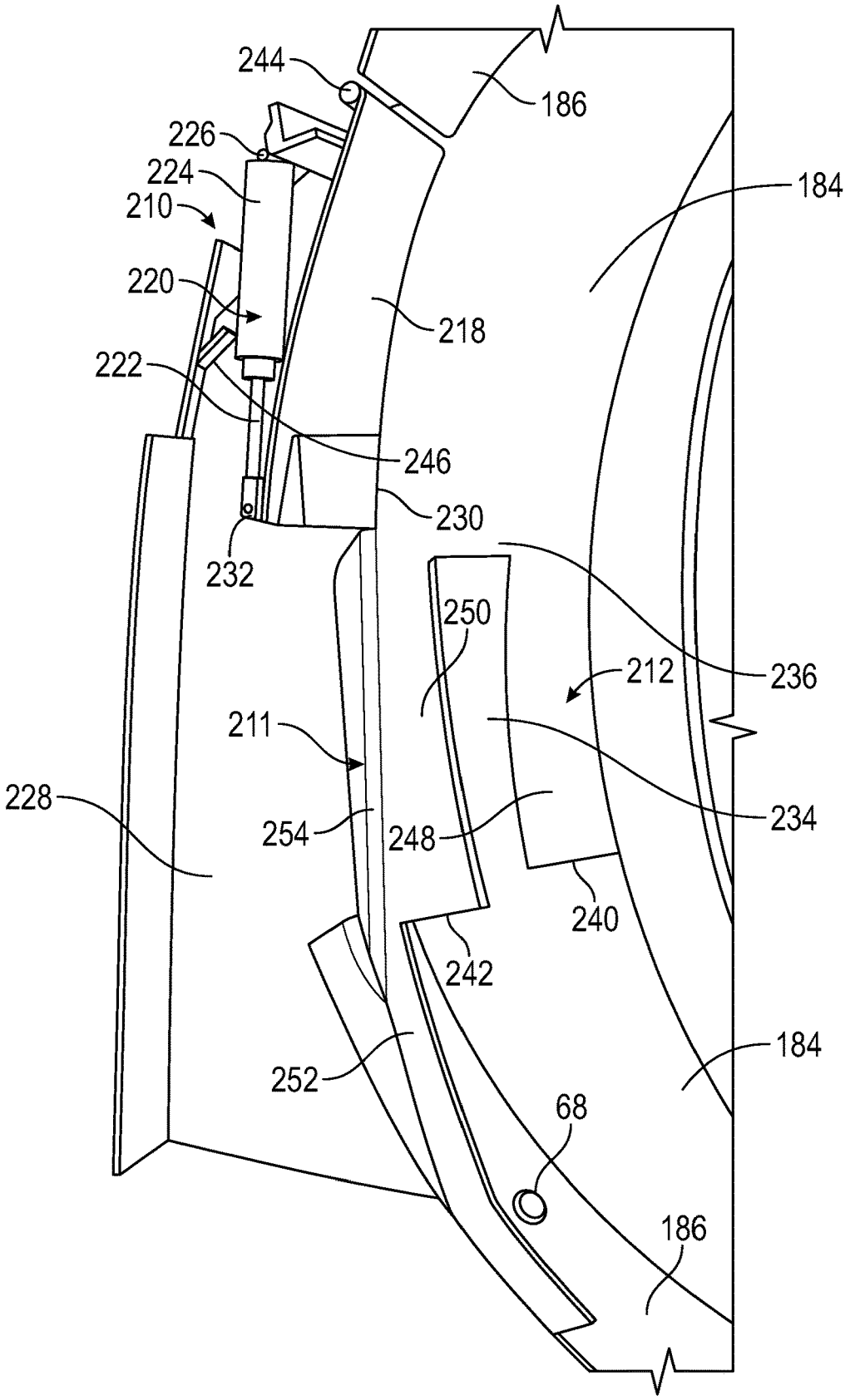
FIG. 15 shows a plan view of the bypass diverter, the stacked tie plate diverter, and the first flip diverter of FIG. 14.

First flip diverter 212 also includes a lower ramp bottom 238, which is also a part of ramp bottom 184, that is positioned a vertical spaced distance from upper ramp bottom 236. Lower ramp bottom 238 is approximately 2.5 inches below upper ramp bottom 236. Lower ramp bottom 238 is generally shaped as a "V" by ramp wall 186 and lower ramp bottom 184, as can be seen in FIGS. 14-16.

First diverter 212 works as follows. When tie plate distributor 142 is vibrated, the details of which are described in more detail elsewhere herein, tie plates 10 travel along ramp bottom 184 to upper ramp bottom 236. When one tie plate 10 encounters first diverter 212, initially tie plate 10 is supported by inner support 248 and outer support 252. As tie plate 10 continues to travel along ramp bottom 184/upper ramp bottom 236, and then to inner support 248 and outer support 252, an inner side of tie plate 10 begins passing circumferentially past an end of inner support 248. Since the ramps extend in a continuous curve, a front end of tie plate 10 is pushed inwardly toward vertical wall 146, and a back end of tie plate 10 is pushed outwardly toward ramp wall 186. As a back end of tie plate passes an end of upper ramp bottom, tie plate 10 moves outwardly, becoming supported by only outboard support 250 for approximately 30 degrees. As tie plate 10 travels along outer support 250 and to second outer support 252, the support is insufficient to keep tie plate 10 approximately parallel to upper ramp bottom 236, outer support 250, and second outer support 252, and the inner side of tie plate 10 drops onto lower ramp bottom 238 of ramp bottom 184, as shown in FIG. 15.

Figure 16:
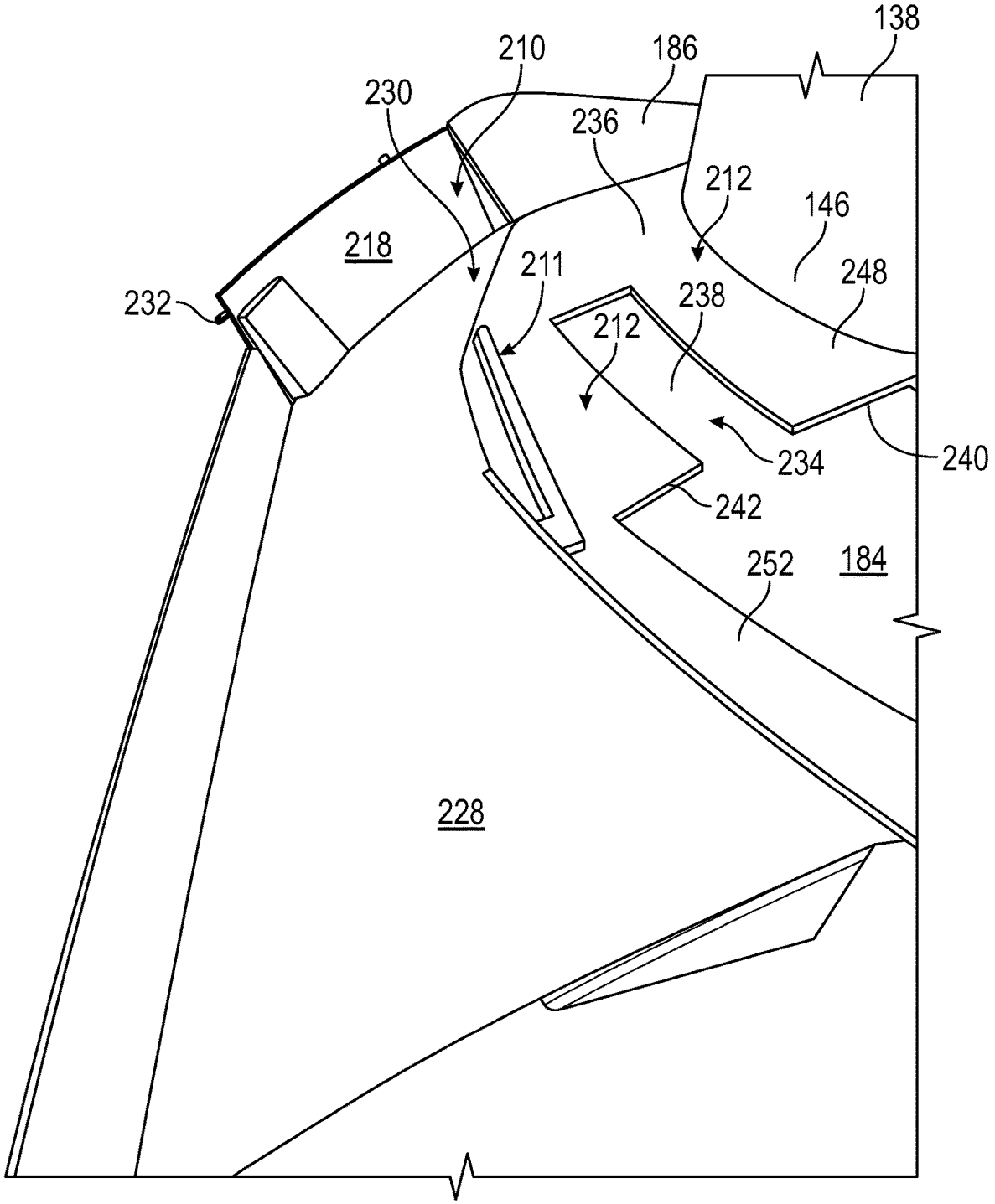
FIG. 16 shows a perspective view of the diverters of FIG. 14, with the bypass door in an open position.
Figure 17:
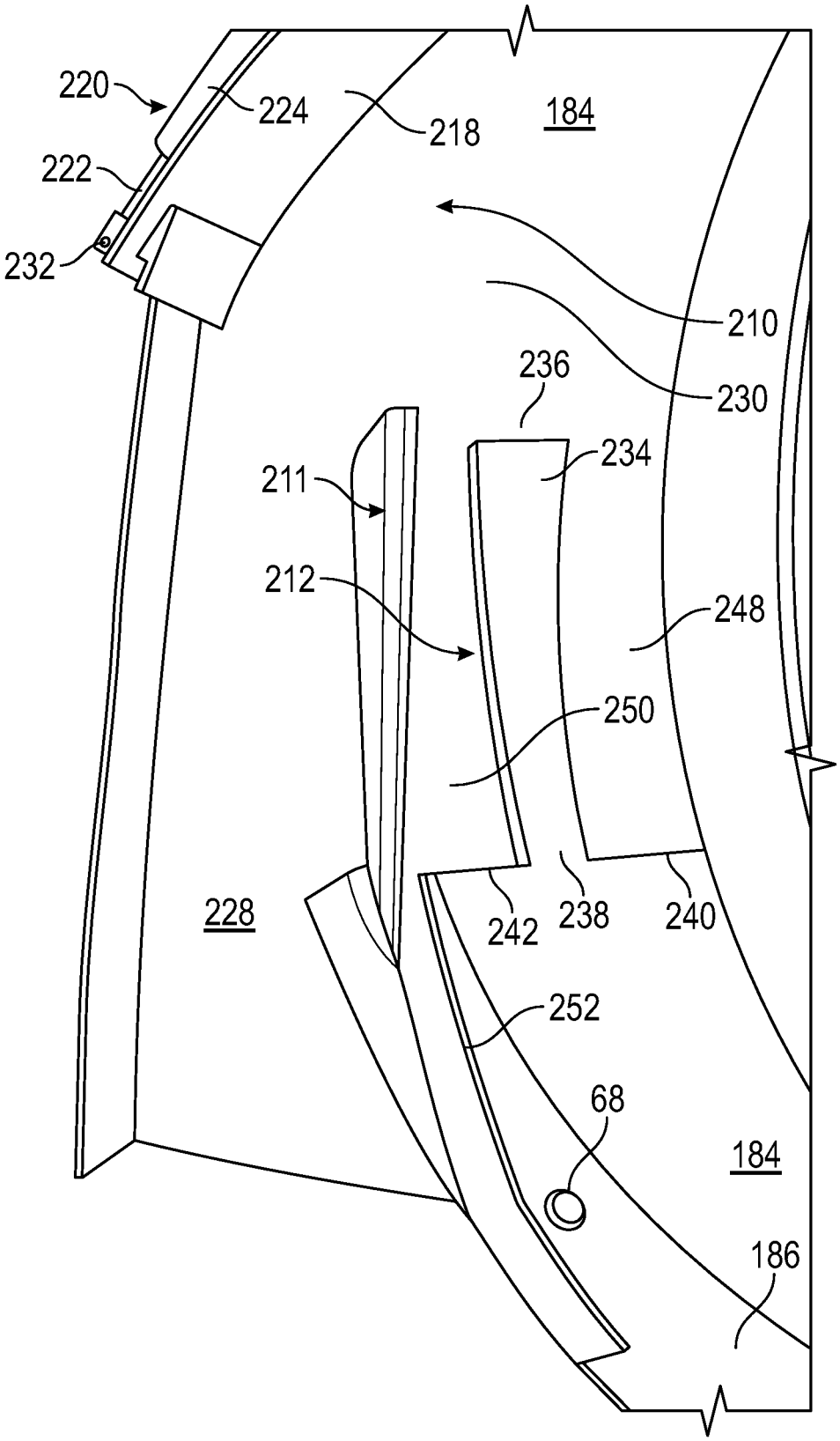
FIG. 17 shows a plan view similar to the view of FIG. 15, with the bypass door in an open position.
Figure 18:
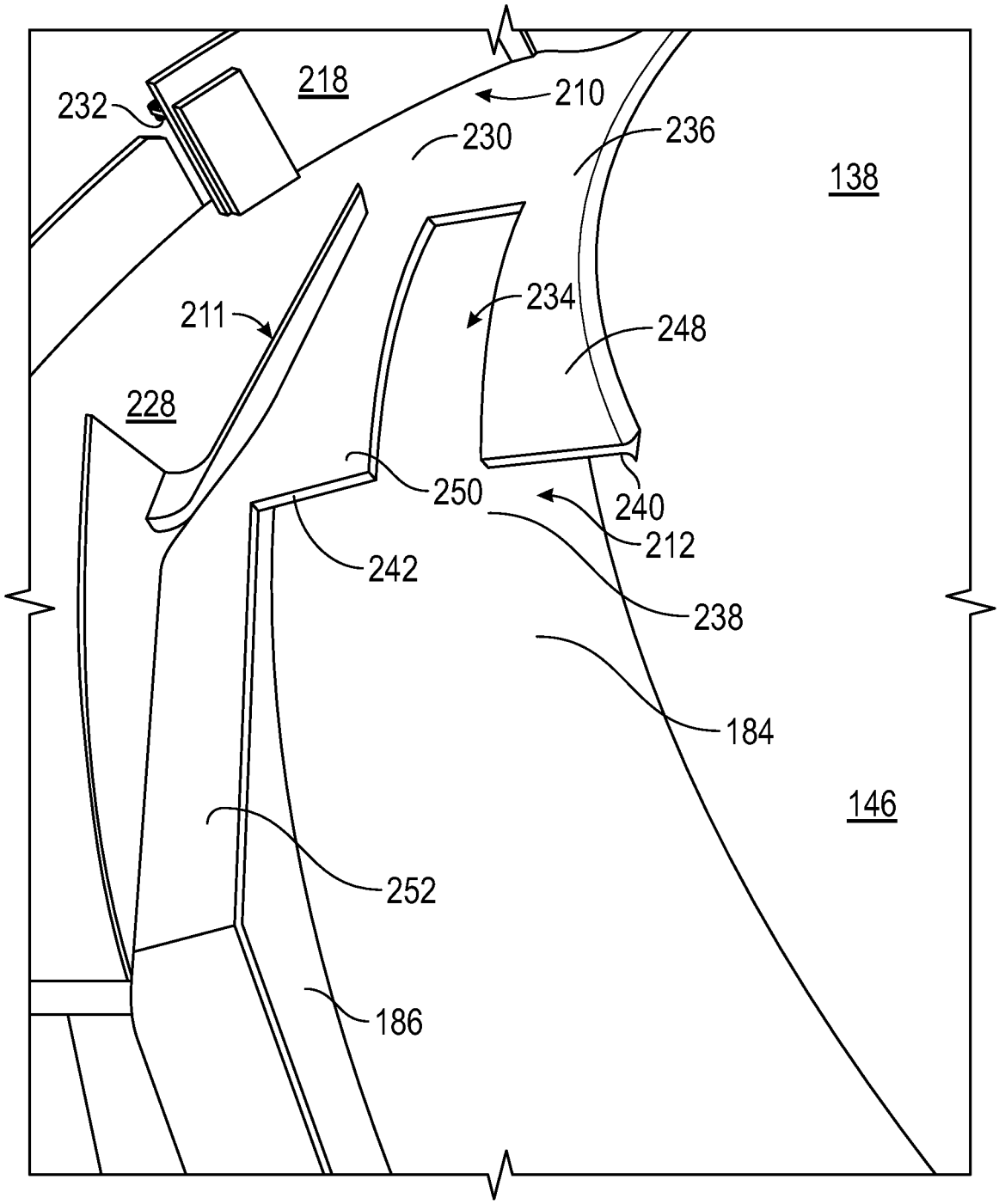
FIG. 18 shows another perspective view of the diverters of FIG. 14.
Figure 19:
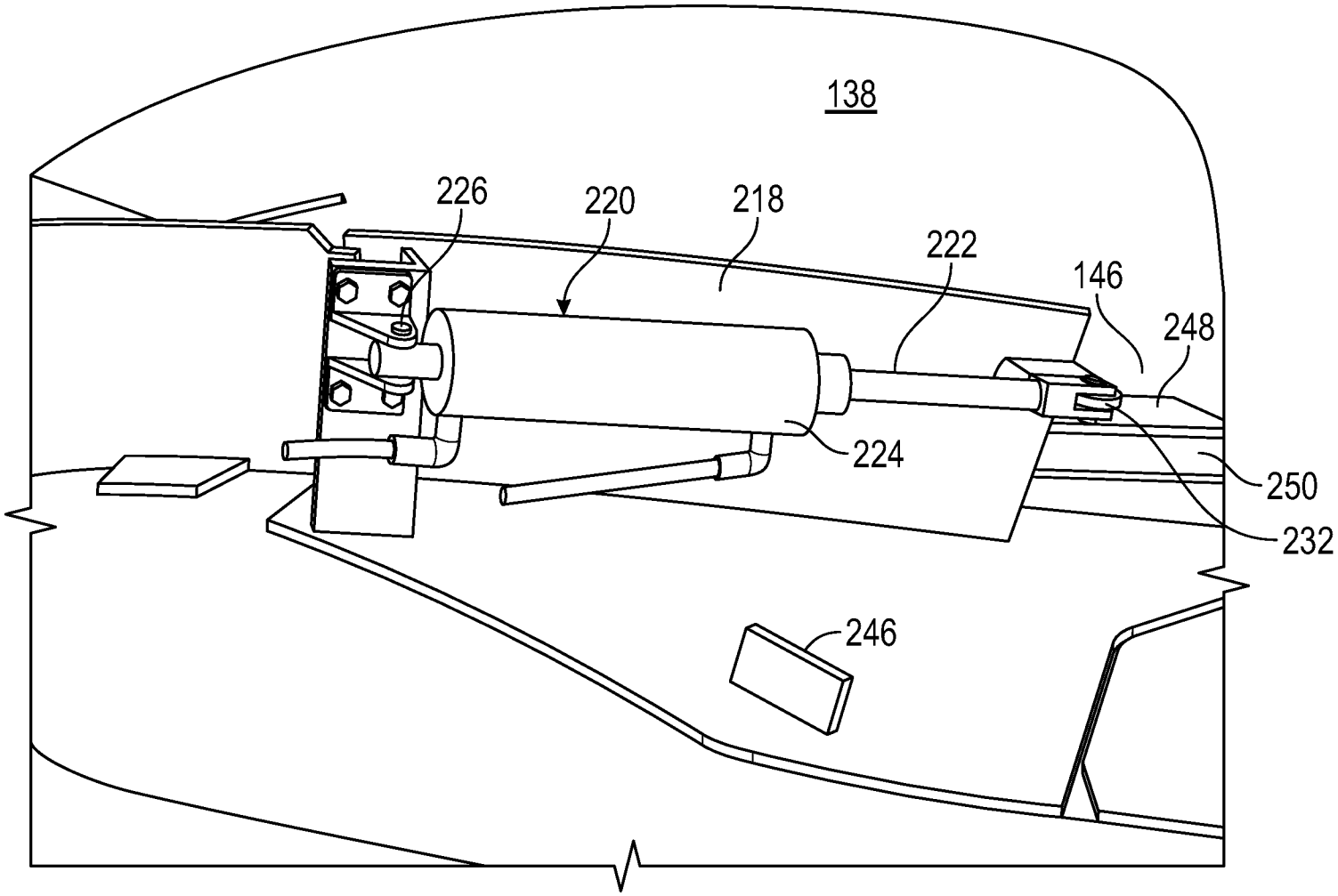
FIG. 19 shows a perspective view of a bypass door actuator in accordance with an exemplary embodiment of the present disclosure.
Figure 20:
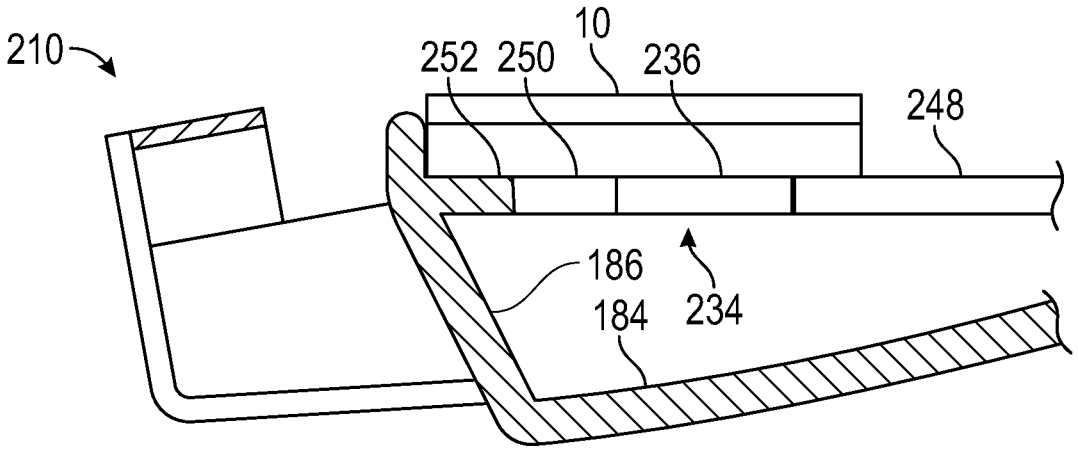
FIG. 20 shows a view of the tie plate diverters of FIG. 13 along the lines 20-20, with a tie plate positioned on an upper ramp bottom in accordance with an exemplary embodiment of the present disclosure.
Figure 21:
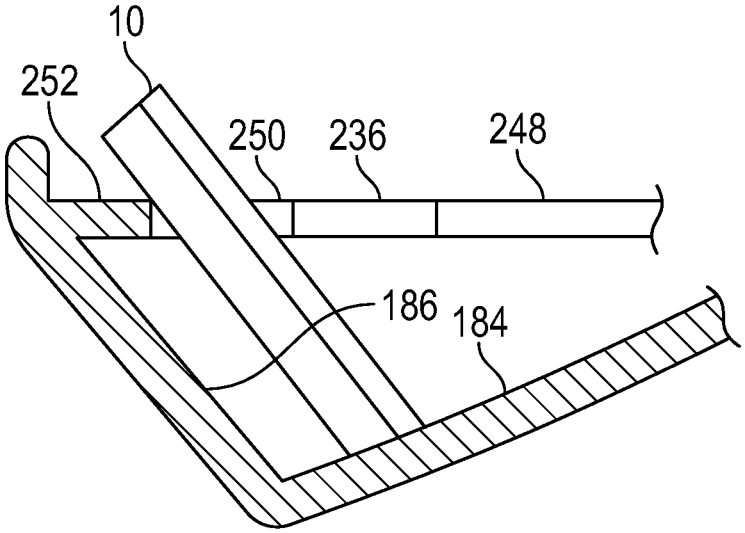
FIG. 21 shows a further view along the lines 20-20, with one side of the tie plate dropping from the upper ramp bottom to a lower ramp bottom in accordance with an exemplary embodiment of the present disclosure.
Figure 22:
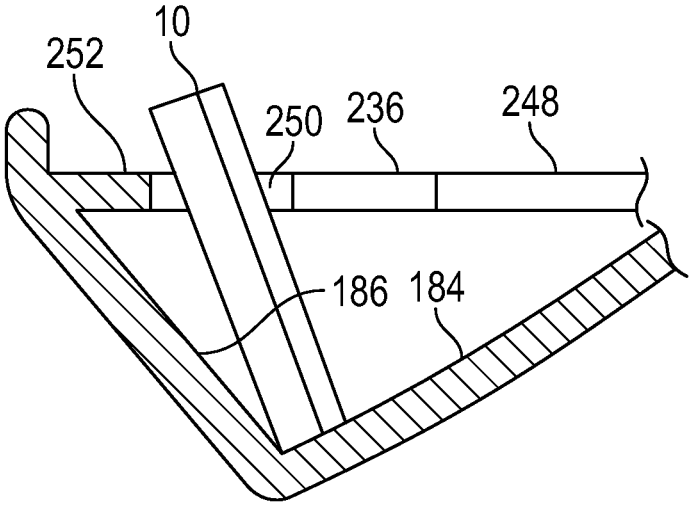
FIG. 22 shows a still further view along the lines 20-20, with the one side of the tie plate positioned at a joint formed between a ramp wall and the lower ramp bottom in accordance with an exemplary embodiment of the present disclosure.
Figure 23:
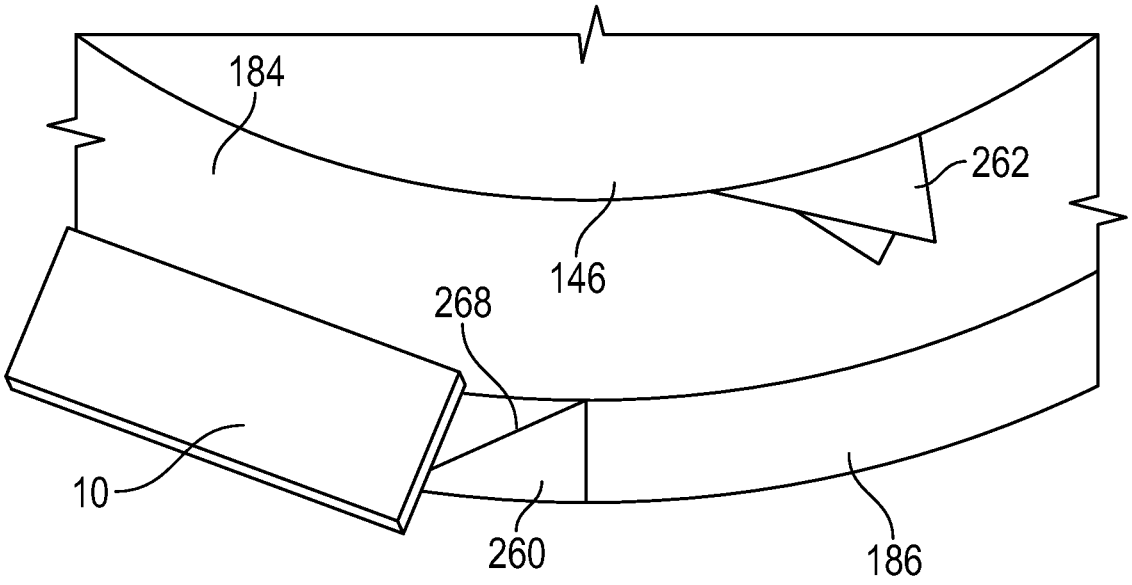
FIG. 23 shows a plan view of a portion of a second flip diverter with a tie plate traveling upside down toward the second flip diverter in accordance with an exemplary embodiment of the present disclosure.
Figure 24:
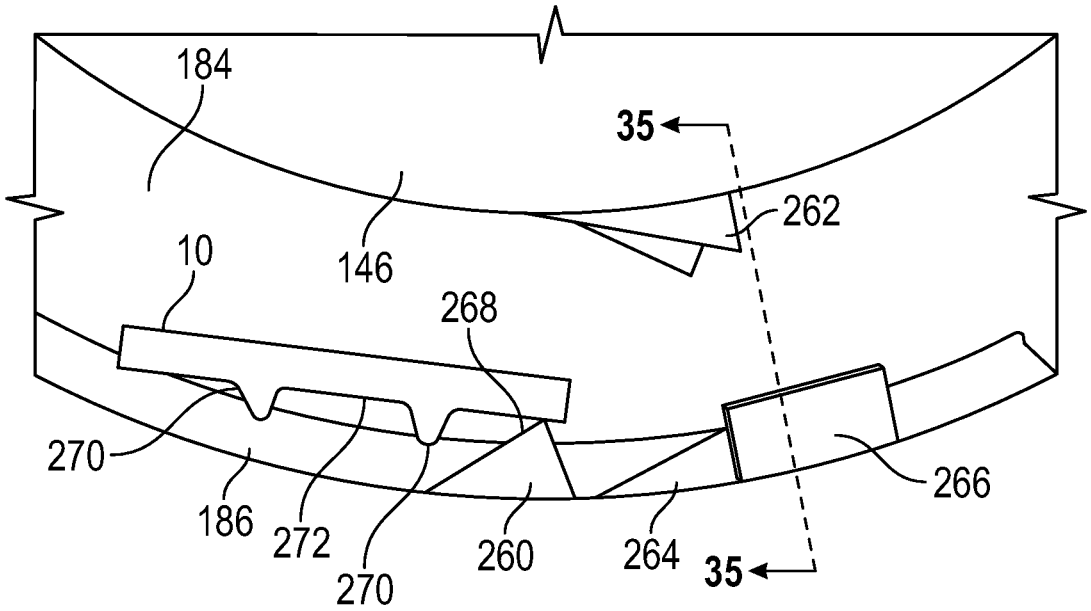
FIG. 24 shows another plan view of the second flip diverter of FIG. 23, with the tie plate travelling along a first protrusion of the second flip diverter.
Figure 25:
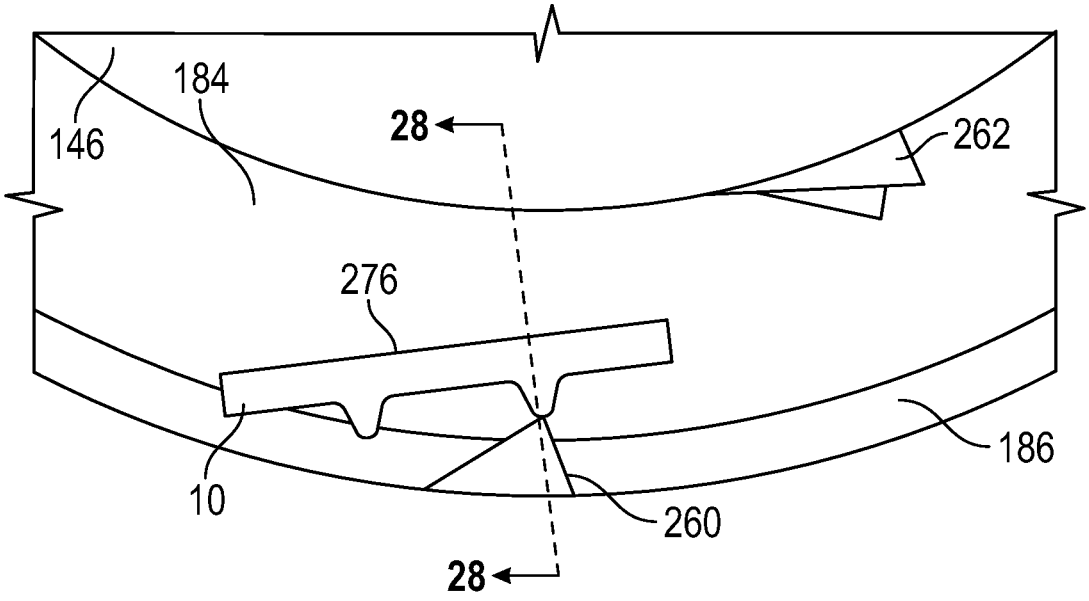
FIG. 25 shows still another plan view of the second flip diverter of FIG. 23, with a tie plate protrusion traveling along the first protrusion of the second flip diverter.
Figure 26:
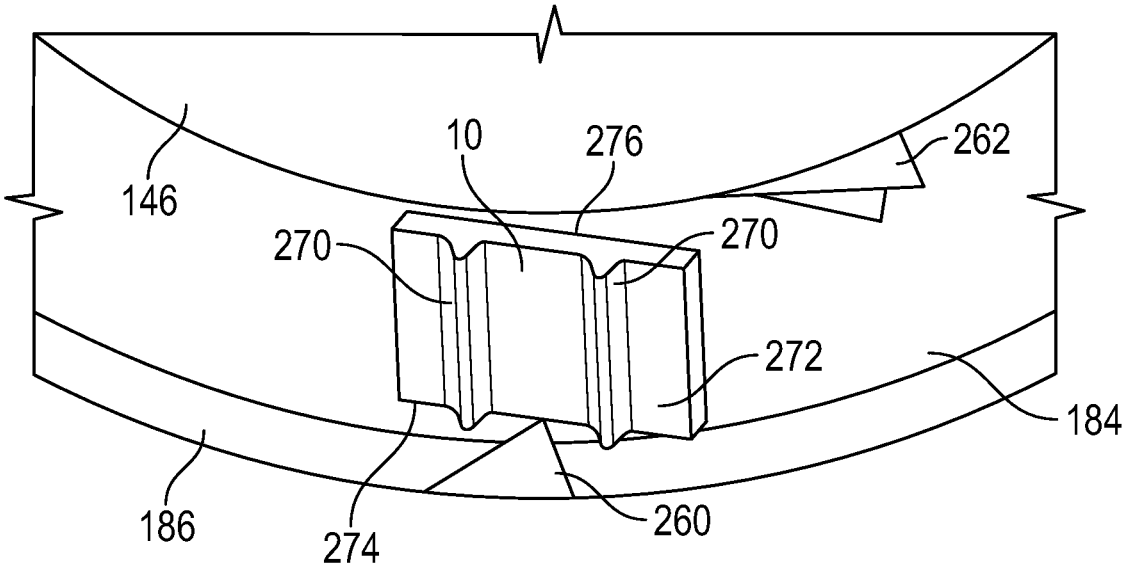
FIG. 26 shows yet another plan view of the second flip diverter of FIG. 23, with the tie plate pushed onto the bottom of the ramp in an upward orientation.
Figure 27:
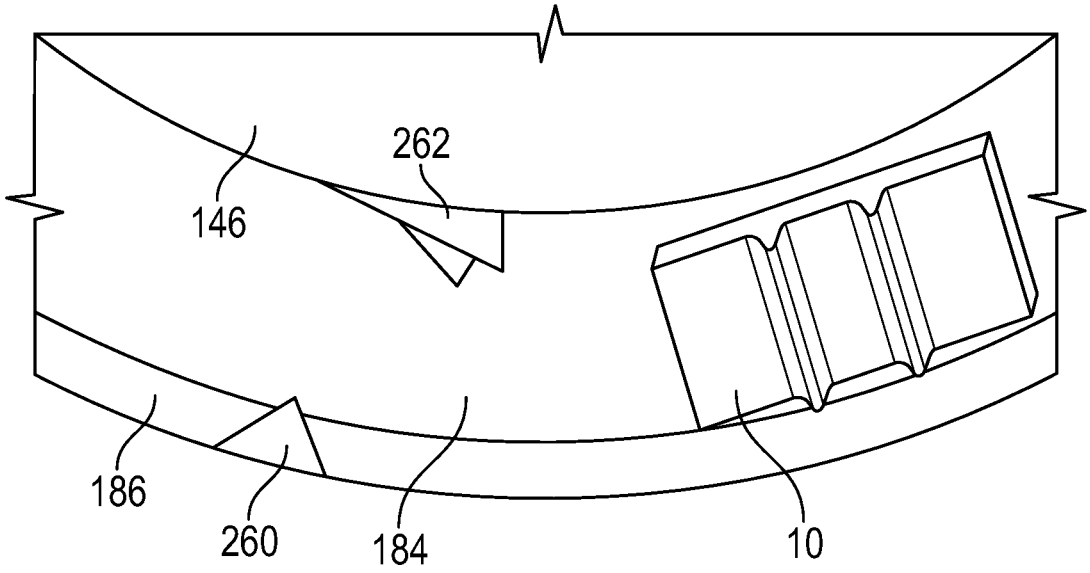
FIG. 27 shows an even further plan view of the second flip diverter of FIG. 23, with the tie plate having traveled along the bottom of the ramp a spaced distance from the first protrusion of the second flip diverter.

As tie plate 10 continues to travel along ramp bottom 184, the inner side of tie plate slides downwardly into the "V"

formed by ramp wall 186 and ramp bottom 184, as shown in FIG. 16. Tie plate 10 continues to move along ramp bottom 184 and ramp wall 186 in this orientation until tie plate 10 reaches second flip diverter 214.

As tie plate 10 travels along upper ramp bottom 236, a side of tie plate 10 closer to vertical wall 146 will be unsupported because upper ramp bottom 236 terminates at an inside end 240 that is spaced a distance from an outside end 242. As tie plate 10 continues to travel along upper ramp bottom 236, eventually an end of tie plate 10 will travel past inside end 240, and tie plate 10 will drop into an angle formed by ramp wall 186 and lower ramp bottom 238. In an exemplary embodiment, the angle formed by ramp wall 186 and lower ramp bottom 238 is approximately 55 degrees. Thus, tie plate 10 will be oriented slightly outwardly from a vertical direction against ramp wall 186, and thus tie plate 10 will travel stably from first flip diverter 212 to second flip diverter 214.

It should be understood that tie plate 10 leans against ramp wall 186 in an orientation that is parallel to ramp wall 186. Tie plate 10 can be oriented in one of two ways after first flip diverter 212. Tie plate 10 can either be oriented so that a surface where a rail is supported, which is an upper side of tie plate 10, is oriented toward, or faces, vertical wall 146, or tie plate 10 can be oriented so that the surface where the rail is supported faces ramp wall 186, or away from vertical wall 146. However, tie plate 10 needs to be oriented so the lower side of tie plate 10 that is on an opposite side of tie plate 10 from the upper face of tie plate 10 faces toward tramp bottom 184, and the upper side to tie plate 10 faces away from ramp bottom 184 prior to entry into field-gauge diverter 216. Changing the orientation of tie plate 10 from leaning against ramp wall 186 to lying on ramp bottom 184 with the lower side of tie plate 10 on ramp bottom 184 is a function of second flip diverter 214.

Referring to FIGS. 13 and 23-35, second flip diverter 214 includes a first protrusion 260, a second protrusion 262, a third protrusion 264, and a push plate 266. First protrusion 260, third protrusion 264, and push plate 266 all extend from ramp wall 186 radially toward vertical wall 146. Second protrusion 262 extends radially away from vertical wall 146 toward ramp wall 186. Accordingly, second protrusion 262 generally extends in a direction that is radially outward from axis of rotation 130, which is also radially outward from vertical wall 146, and first protrusion 260, third protrusion 264, and push plate 266 each extend radially inward from ramp wall 186, which is also radially toward axis of rotation 130 and radially toward vertical wall 146.

Figure 28:
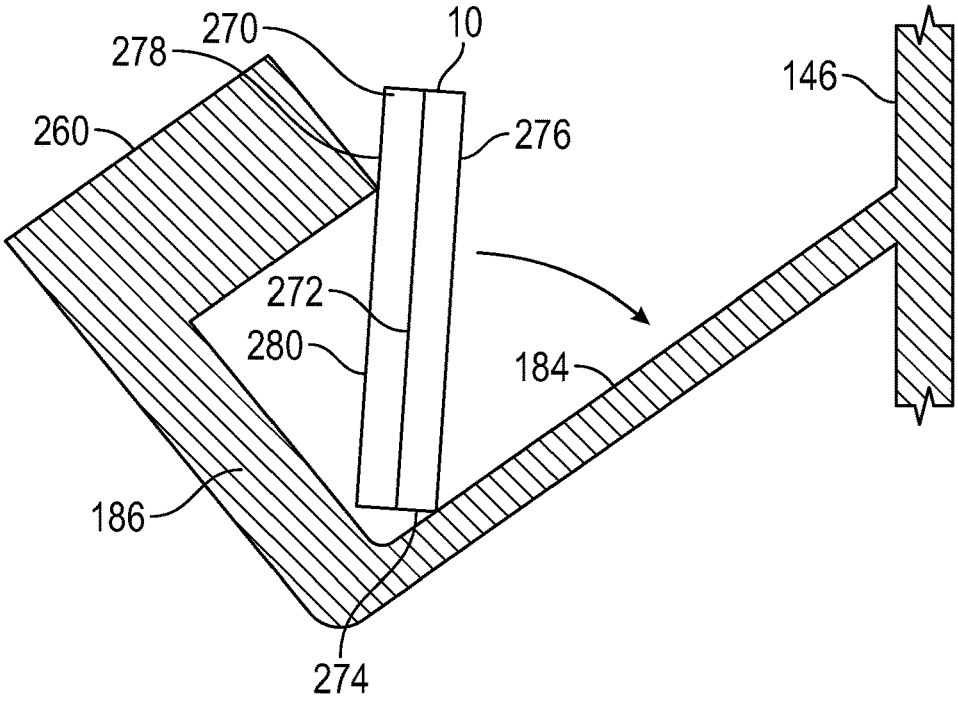
FIG. 28 shows a view of the first protrusion of the second flip diverter shown in FIG. 25 along the lines 28-28 with the tie plate upper or top surface oriented toward the first protrusion.

Under the action of gravity and the vibration of tie plate distributor 142, tie plate 10 travels along ramp 144 or 145 while leaning against ramp wall 186. Tie plate 10 then encounters first protrusion 260, which includes an angled edge 268. An upper half 278 of tie plate 10 rides along angled edge 268, and is pushed away from ramp wall 186 by contact with angled surface 268. If tie plate 10 is oriented such that upper surface or side of tie plate 10 is oriented toward ramp wall 186, then protrusions 270 extending from upper surface 272 of tie plate 10 reach a position on angled edge 268 that cause the center of gravity of tie plate 10 to be beyond a downwardly oriented edge 274 of tie plate 10, as shown in FIG. 28, at which point a bottom surface 276 included as a part of tie plate 10 falls inwardly toward and contacts ramp bottom 184. Tie plate 10 will then travel along ramp 144 or 145 to a bottom end of ramp 144 or 145 in this orientation until tie plate 10 reaches field-gauge diverter 216. It should be noted that positioning protrusion 260 and protrusion 262 to contact upper half 278 provides stable contact with tie plate 10 as opposed to a location on a lower half of tie plate 10. Further, contact at the highest location from side 274 is preferred for stability during travel of tie plate 10.

Figure 29:
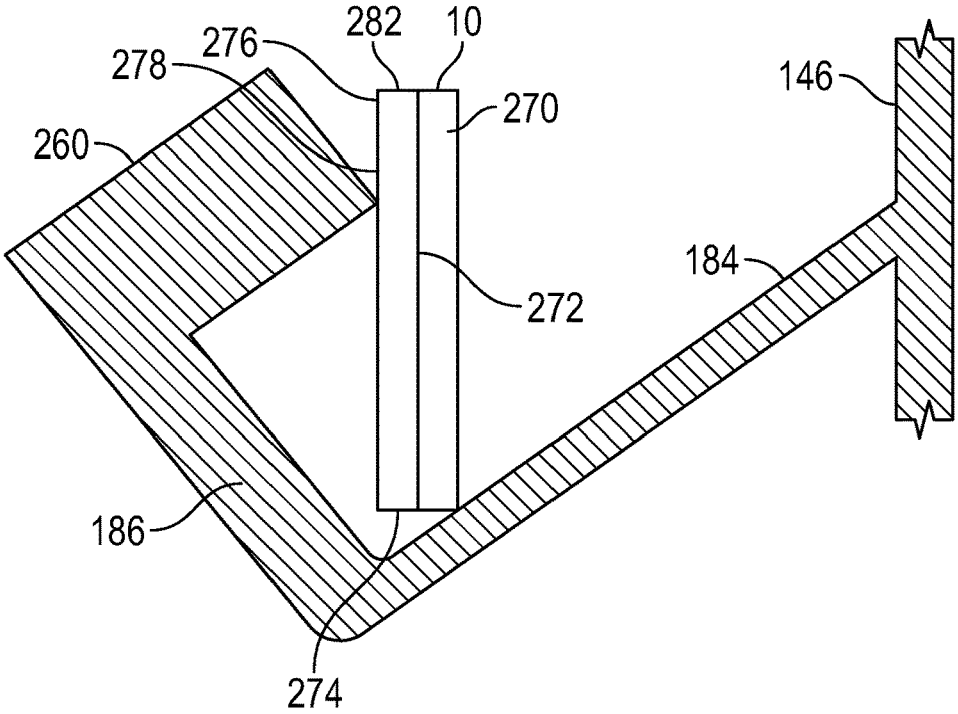
FIG. 29 shows another view similar to that of FIG. 28, with the tie plate upper or top surface oriented away from the first protrusion.
Figure 30:
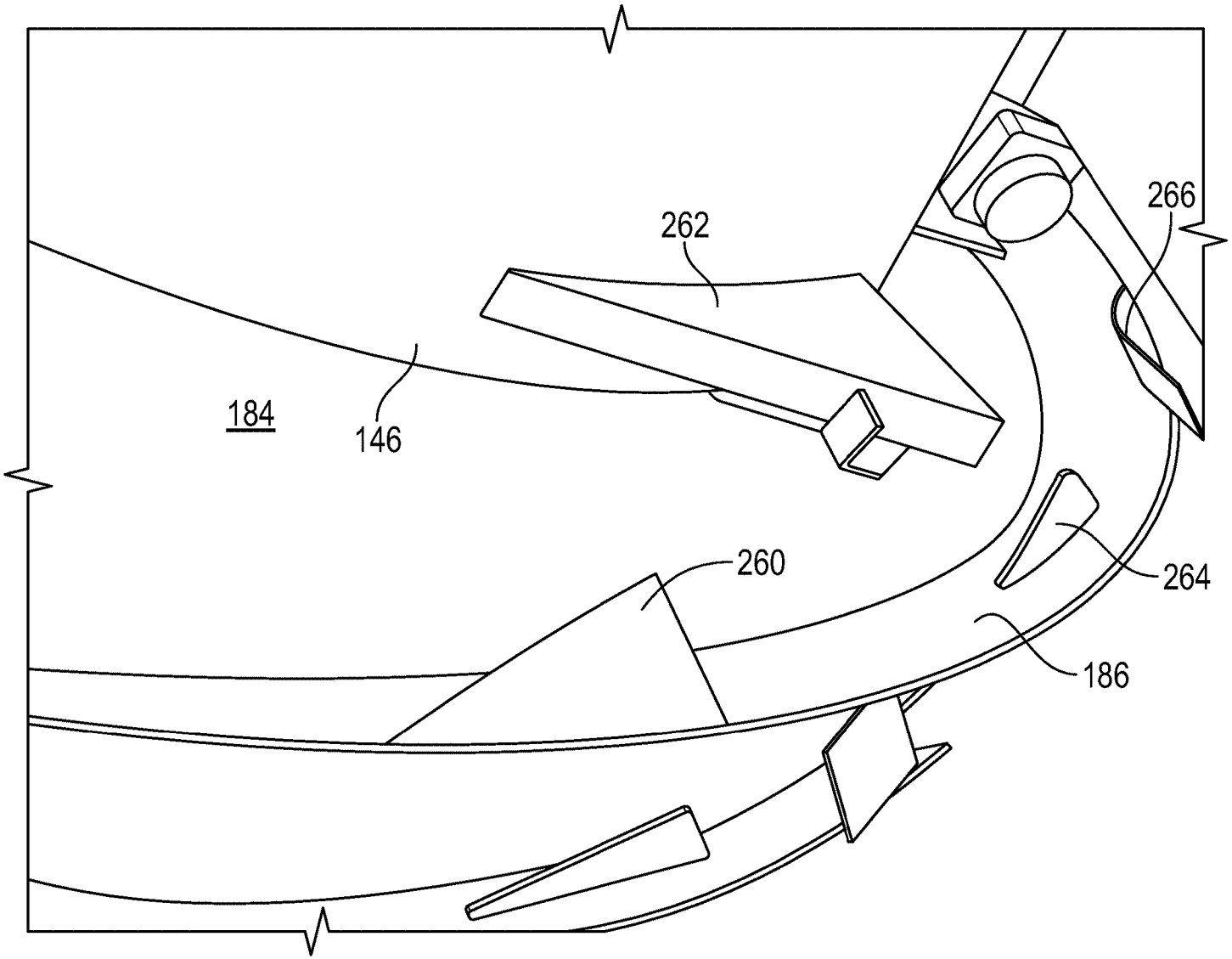
FIG. 30 shows a perspective view of the second flip diverter.
Figure 31:
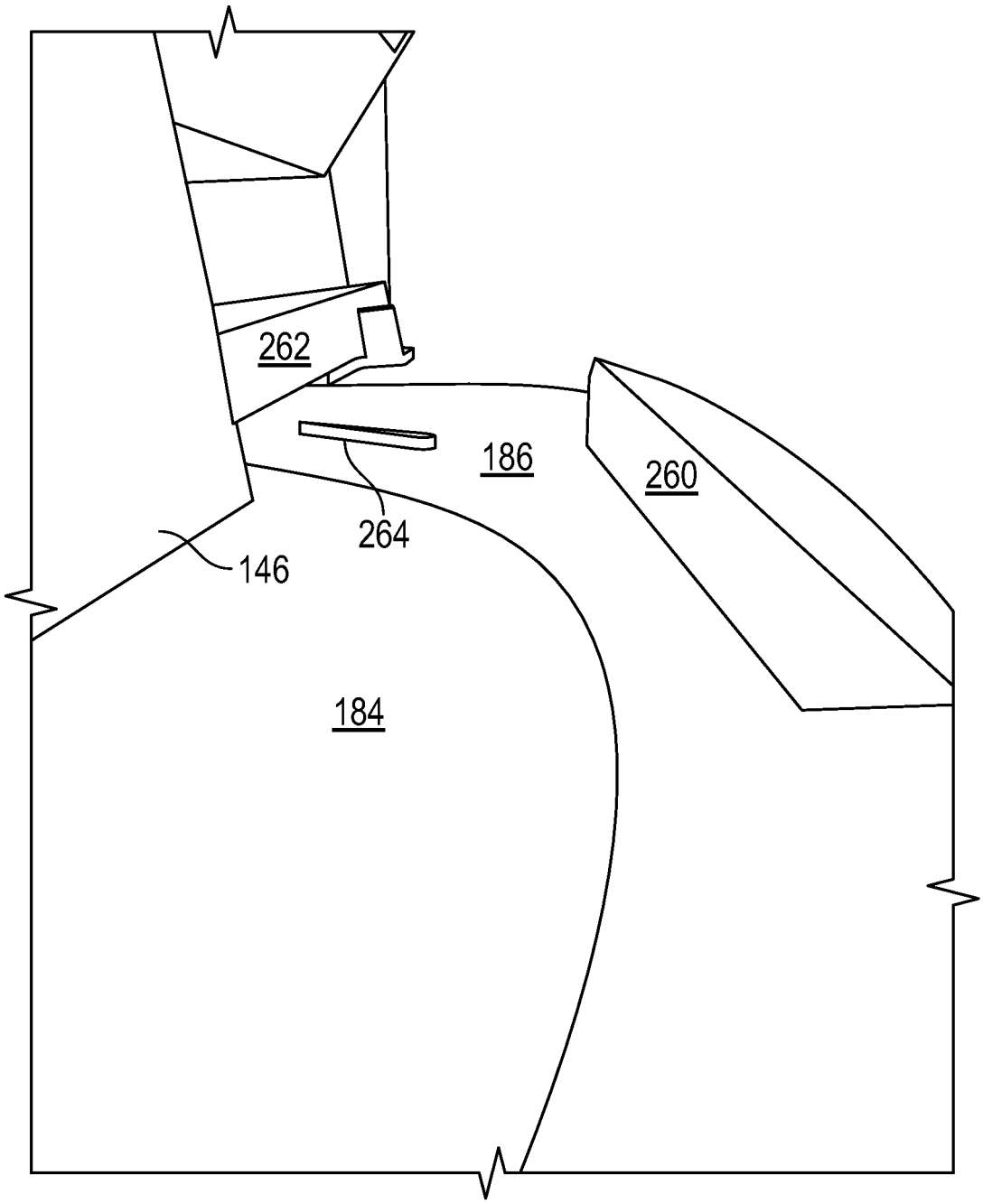
FIG. 31 shows a further perspective view of the second flip diverter.
Figure 32:
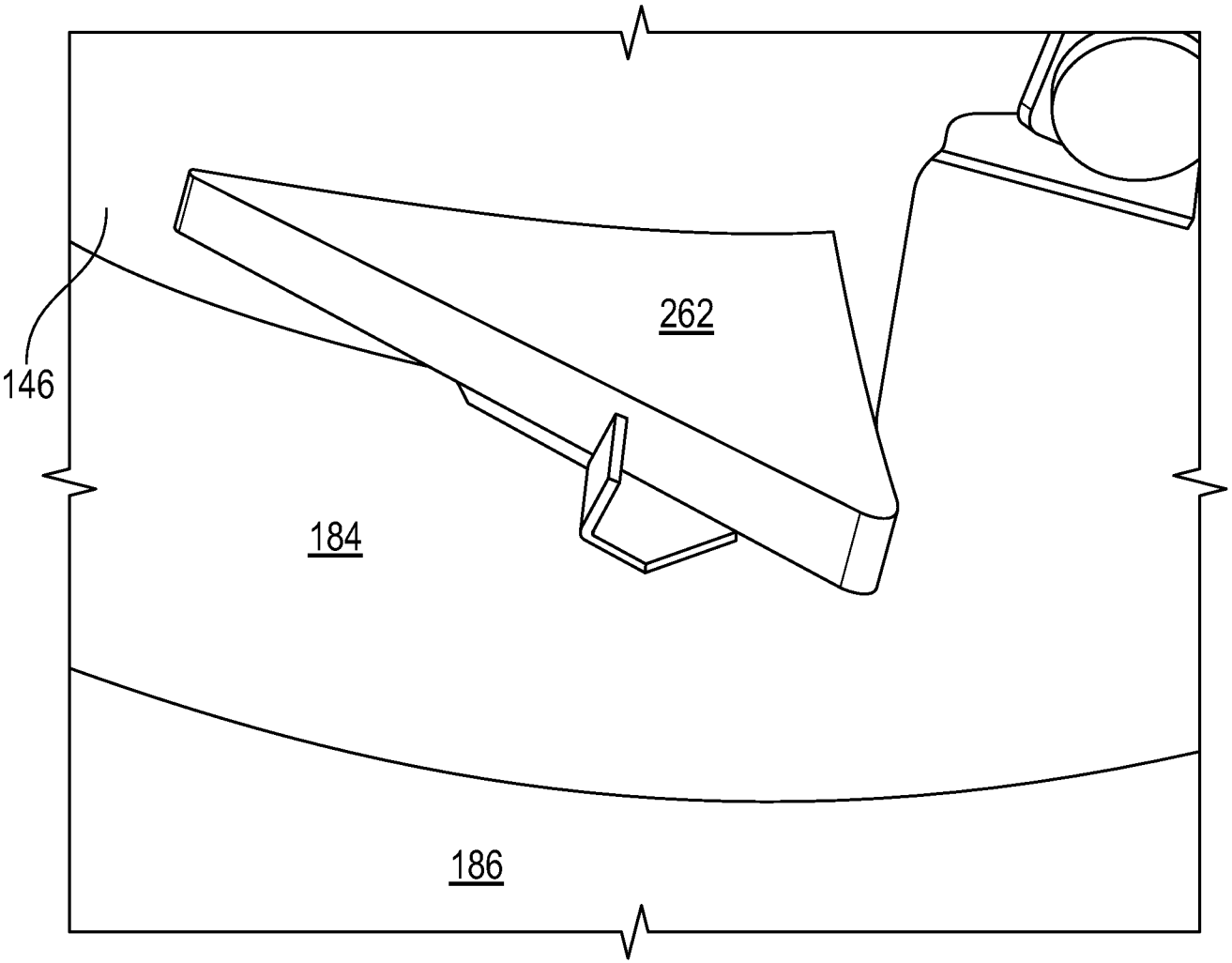
FIG. 32 shows a perspective view of a second protrusion of the second flip diverter.
Figure 33:
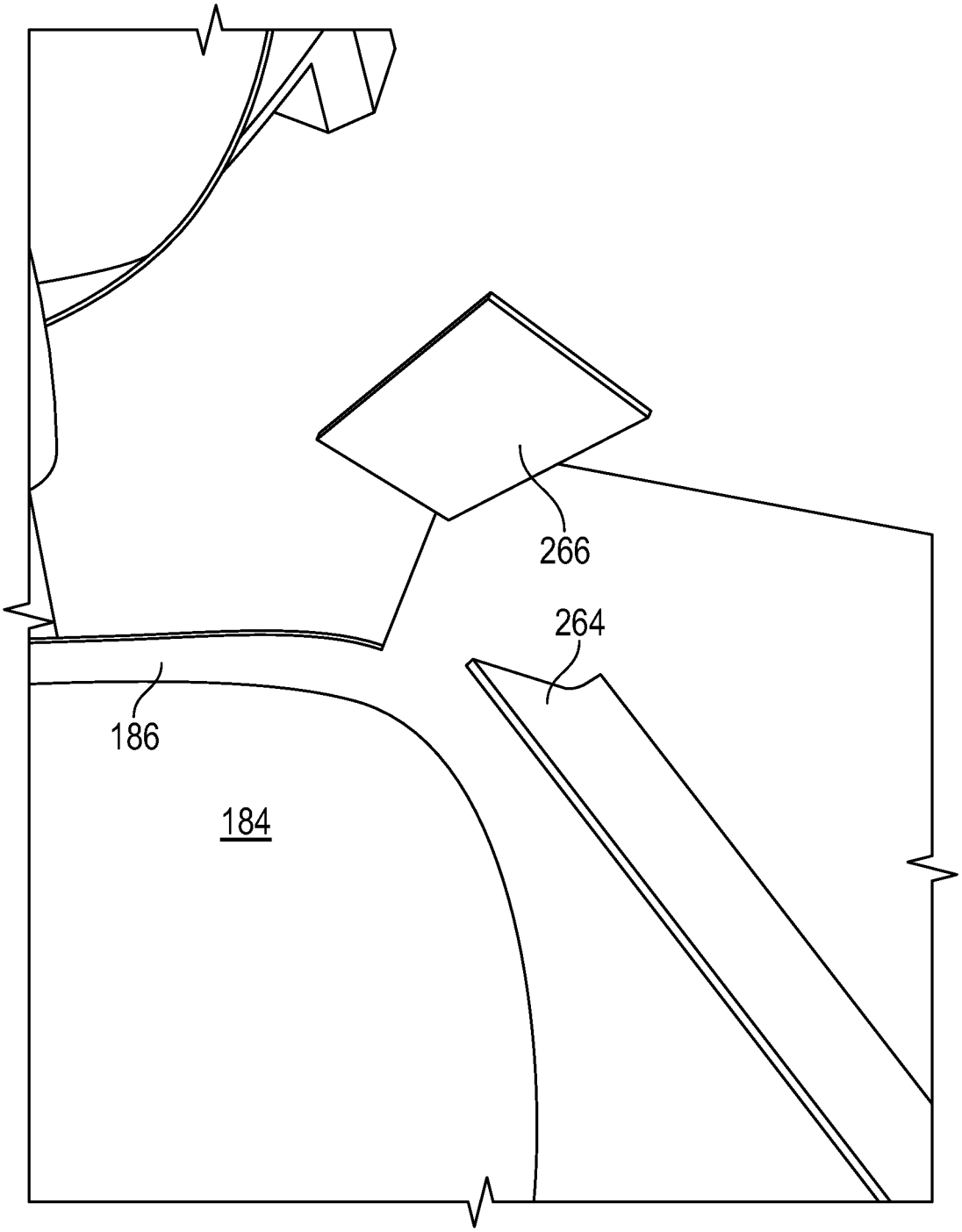
FIG. 33 shows a perspective view of a third protrusion and a push plate of the second flip diverter.
Figure 34:
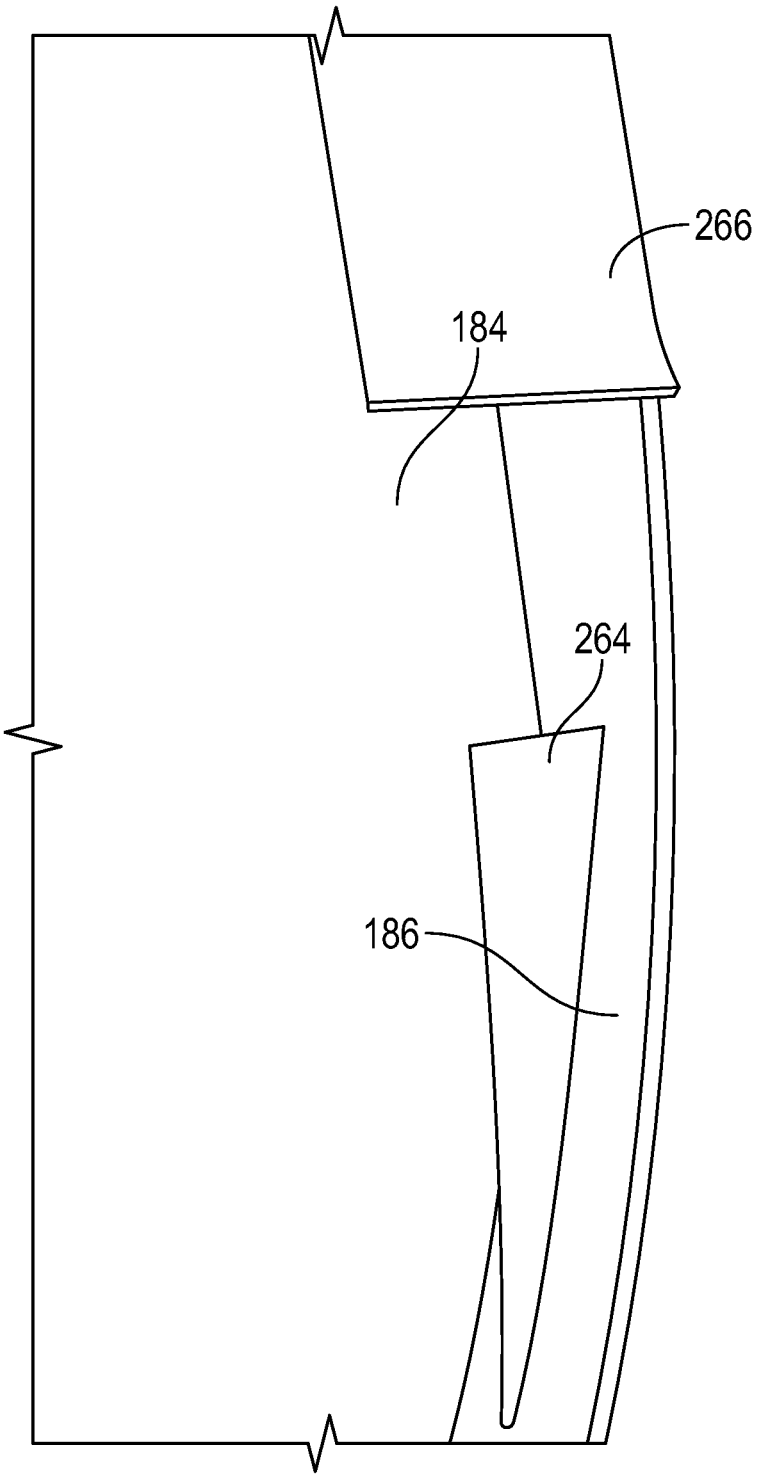
FIG. 34 shows a plan view of the third protrusion and the push plate of FIG. 33.

On the other hand, if protrusions 270 are oriented away from ramp wall 186 and toward vertical wall 146, as shown in FIG. 29, tie plate 10 passes by first protrusion 260 in a sideways orientation with edge 274 oriented downwardly. Should tie plate 10 be oriented as shown in FIG. 29, and should tie plate 10 begin to lean toward vertical wall 146, second protrusion 262 helps maintain the orientation of tie plate 10 with upper surface 272 facing away from ramp wall 186. In this same orientation, tie plate 10 reaches third protrusion 264.

Figure 35:
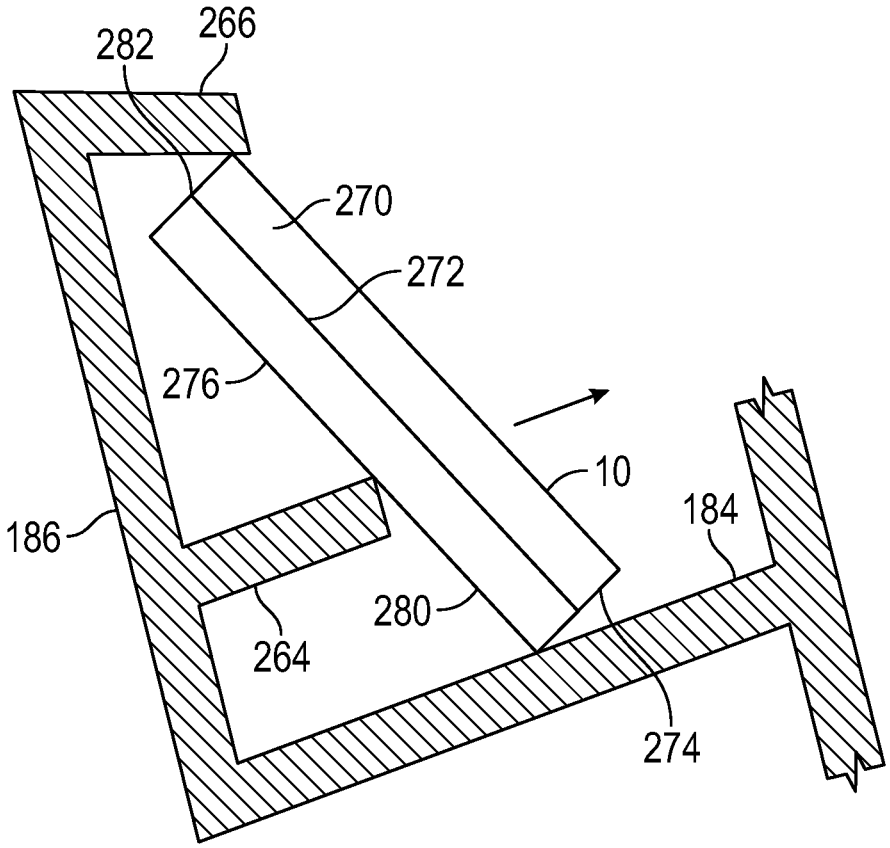
FIG. 35 shows a view of the third protrusion and the push plate along lines 35-35 of FIG. 24.
Figure 36:
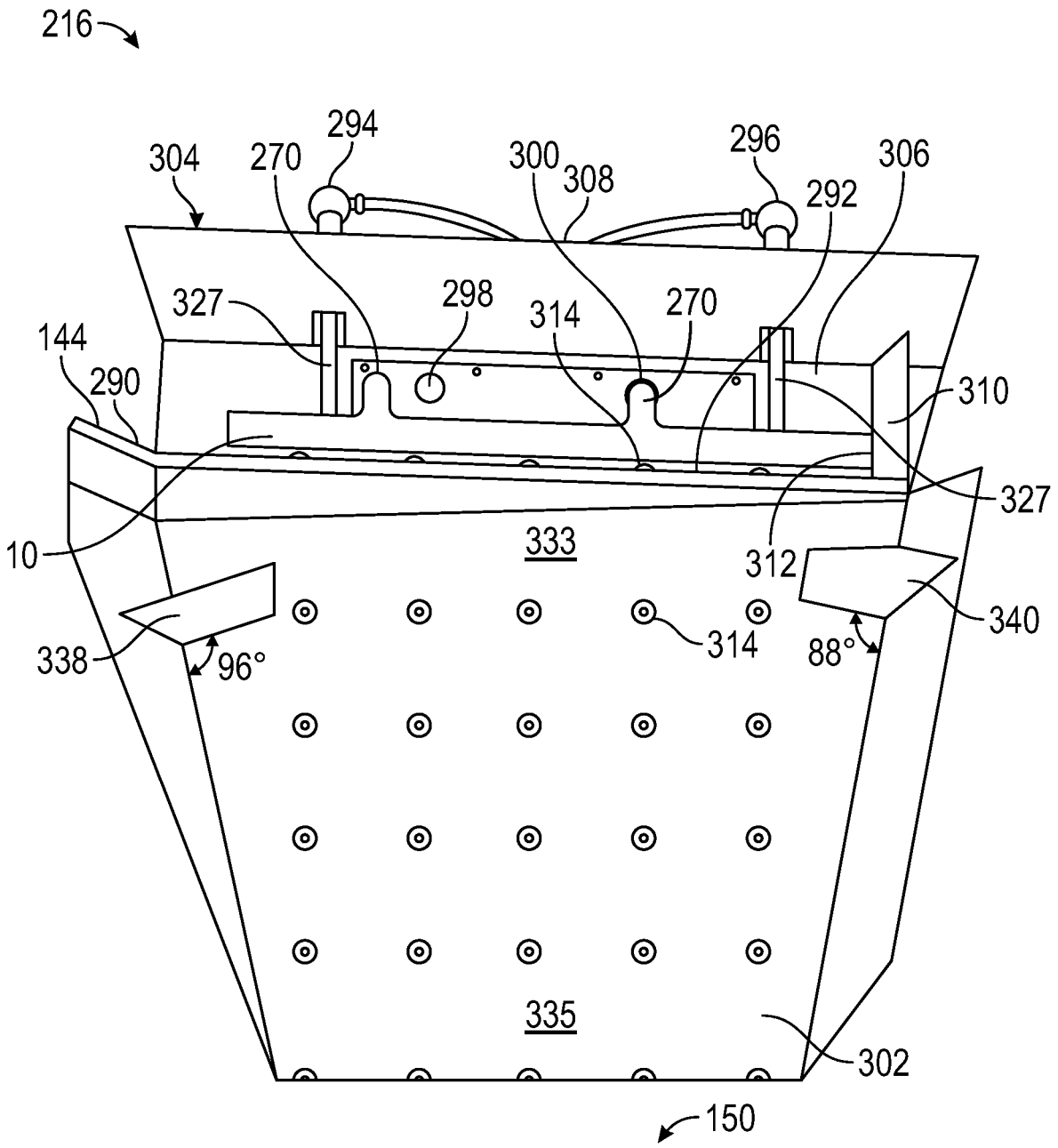
FIG. 36 shows an elevation view of a field-gauge diverter in accordance with an exemplary embodiment of the present disclosure.

Third protrusion 264 is positioned to contract lower half 280 of tie plate 10, forcing lower half 280 away from ramp wall 186. Tie plate 10 then contacts push plate 266, which is angled upwardly at about 24 degrees. Push plate 266 can contact an upper side 282 of tie plate 10, which is on a side opposite lower edge 274. As shown in FIG. 35, as third protrusion 264 pushes the bottom half of tie plate 10 away from ramp wall 186, push plate 266 pushes tie plate 10 down such that bottom surface 276 of tie plate 10 slides along ramp wall 186, which is oriented nearly 90 degrees from horizontal at the location of third protrusion 264, and bottom surface 276 drops onto ramp bottom surface 184.

It should be noted that second flip diverter 214 is positioned on tie plate distributor 142 as close to a centerline 105 of vehicle 102 as possible. The reason for such positioning is to minimize the effect of vehicle 102 angle as vehicle 102 travels through turns and up and down grades; e.g., up and down hills, through climbs and descents, etc.

In the following explanation, reference is made to ramp 144. However, it is to be understood that the explanation is similarly applicable to ramp 145.

Tie plate 10 now travels along ramp 144 with bottom surface 276 positioned or oriented downwardly on bottom surface 184 of ramp 144. Tie plate 10 is retained or positioned on bottom surface 184 of ramp 144 by ramp wall 184. As bottom surface 184 extends circumferentially around vertical wall 146, bottom surface 184 reverses angles from extending downwardly from vertical wall 146 to extending upwardly from vertical wall 146. The purpose of the reversal in angle is to slide tie plate 10 toward a back side of field-gauge diverter 216 for consistent ejection of tie plate 10 from field-gauge diverter 10.

Referring to FIGS. 13 and 36-38, at a bottom end 290 of ramp 144 is positioned field-gauge diverter 216. Field-gauge diverter 216 includes a receiving platform 292, a left or first actuator 294, a right or second actuator 296, a left or first sensor 298, a right or second sensor 300, and a magazine loader ramp 302. Field-gauge diverter 216 can also include a receiver housing 304. Housing 304 can include receiving platform 292, a back wall 306, a top wall or wall bracket 308, and a side wall 310 that extends from receiving platform 292 to top wall 308, connecting receiving platform 292 to top wall 308 and providing support for top wall 308.

Field-gauge diverter 216 can include a stop 312, that can be a separate element or can be part of side wall 310. Side wall 310 is positioned on an opposite side of field-gauge diverter 216 from bottom end 290 of ramp 144. Further, in the exemplary embodiment of FIG. 36, receiving platform 292 is positioned directly between side wall 310 and ramp 144. Still further, stop 312 is similarly positioned on an opposite side of receiving platform 292 from ramp 144.

In an exemplary embodiment, each of receiving platform 292 and magazine loader ramp 302 can include a plurality of bearings 314. Bearings 314 can be, for example, roller bearings.

Back wall 306 and/or top wall 308 can include support components configured to provide support for first actuator 294 and second actuator 296. For example, top wall 308 can include an actuator support 315 and a kicker support 317, each positioned at a respective end of an actuator, for example second actuator 296. Actuator support 315 can include a first pivot 319, which can be a pivot pin, for example, that rotatably or pivotally supports a first end 329 of second actuator 296.

Kicker support 317 can include a kicker or ejection lever 327, and a kicker pivot 321, which can be a pivot pin, for example, that rotatably or pivotally supports kicker lever 327. A second end 330 of second actuator 296 can be attached to an upper end of kicker lever 327 by way of a second pivot 325, which can be a pivot pin, for example, that rotatably or pivotally supports second end 330 of second actuator.

Left sensor 298 and right sensor 300 are positioned on or are supported by receiver housing 304, including being directly supported by receiver housing 304. As described herein, tie plate 10 includes tie plate protrusions 270. However, tie plate protrusions 270 are different distances from an end of tie plate 10 on the field side of tie plate 10 and on the gauge side of tie plate 10. Accordingly, left sensor 298, which can be, for example, an inductive sensor, is positioned to determine whether the field side tie plate protrusion 270 is adjacent or near to left sensor 298. Right sensor 300, which can also be, for example, an inductive sensor, is positioned to determine whether the field side tie plate protrusion 270 is adjacent or near to right sensor 300. After processor 74 determines the orientation of tie plate by signals received from left sensor 298 and right sensor 300, processor 74 can transmit a command to actuate left actuator 294 or right actuator 296, which extends actuator 296 to push kicker or kick lever 327 away from actuator 296.

Figure 37:
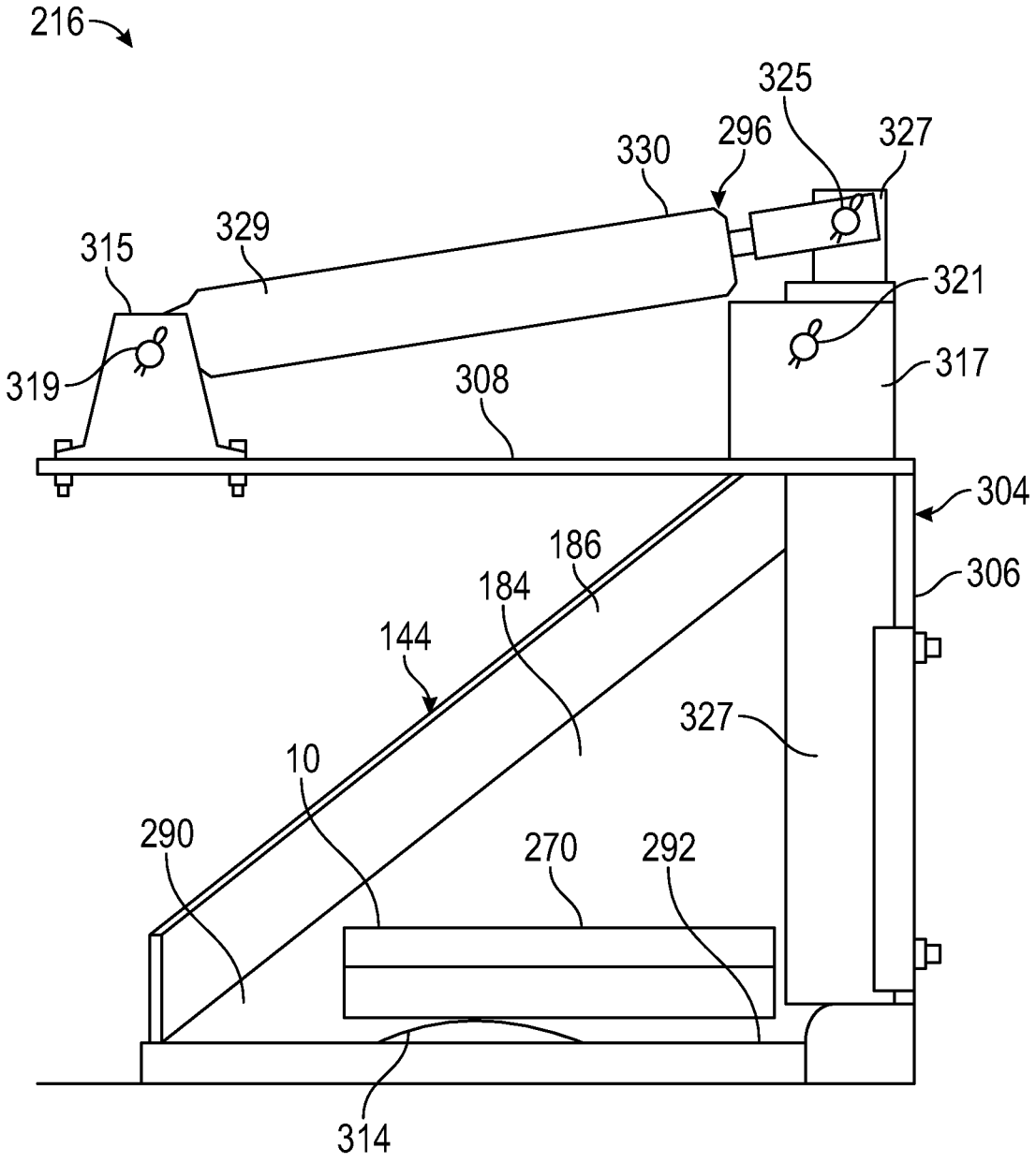
FIG. 37 shows another elevation view of the field-gauge diverter of FIG. 36, with a side wall of the field-gauge diverter removed and with kickers in a standby position in accordance with an exemplary embodiment of the present disclosure.
Figure 38:
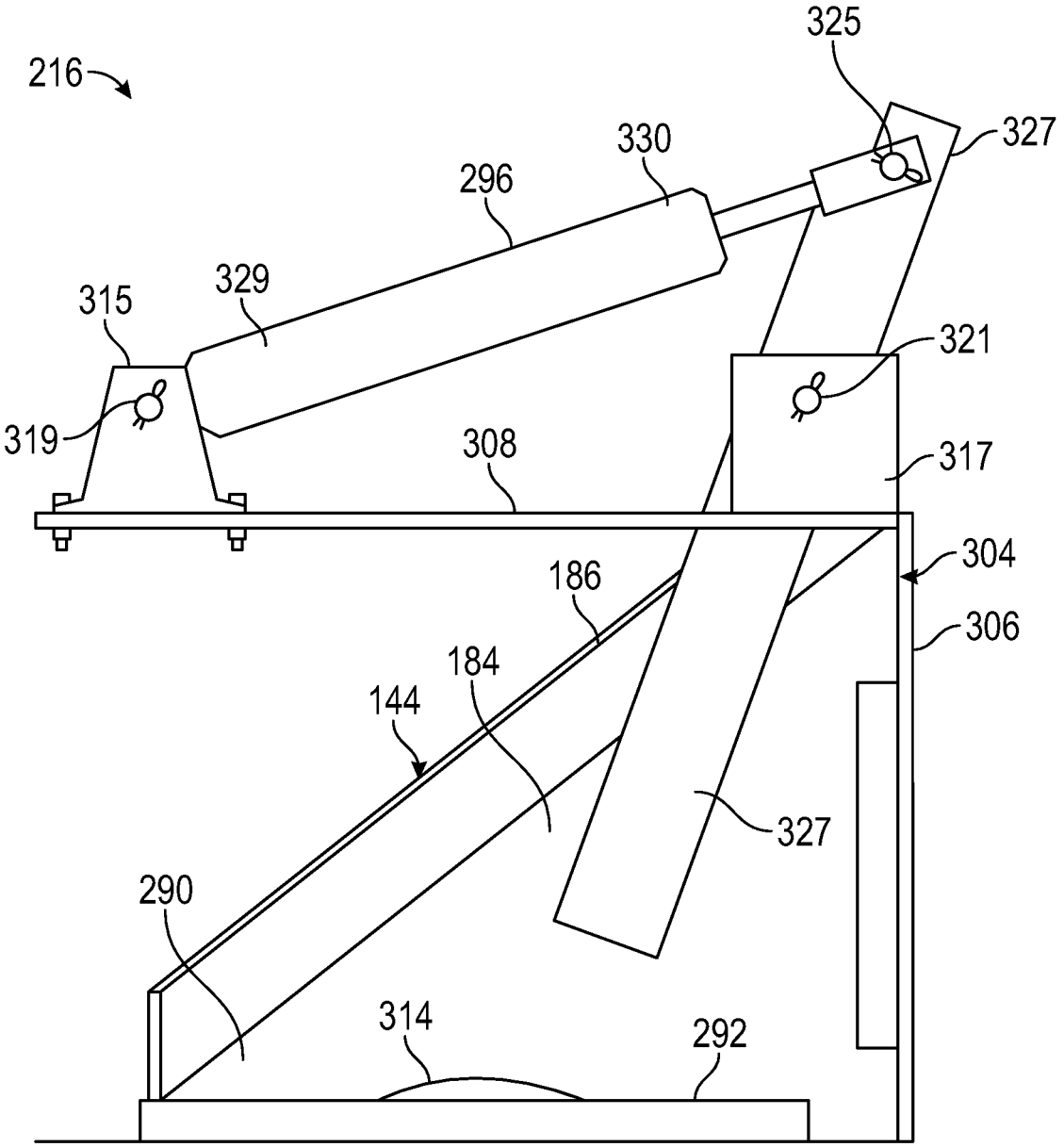
FIG. 38 shows the elevation view of FIG. 37, with one kicker in an engaged or actuated position in accordance with an exemplary embodiment of the present disclosure.
Figure 39:
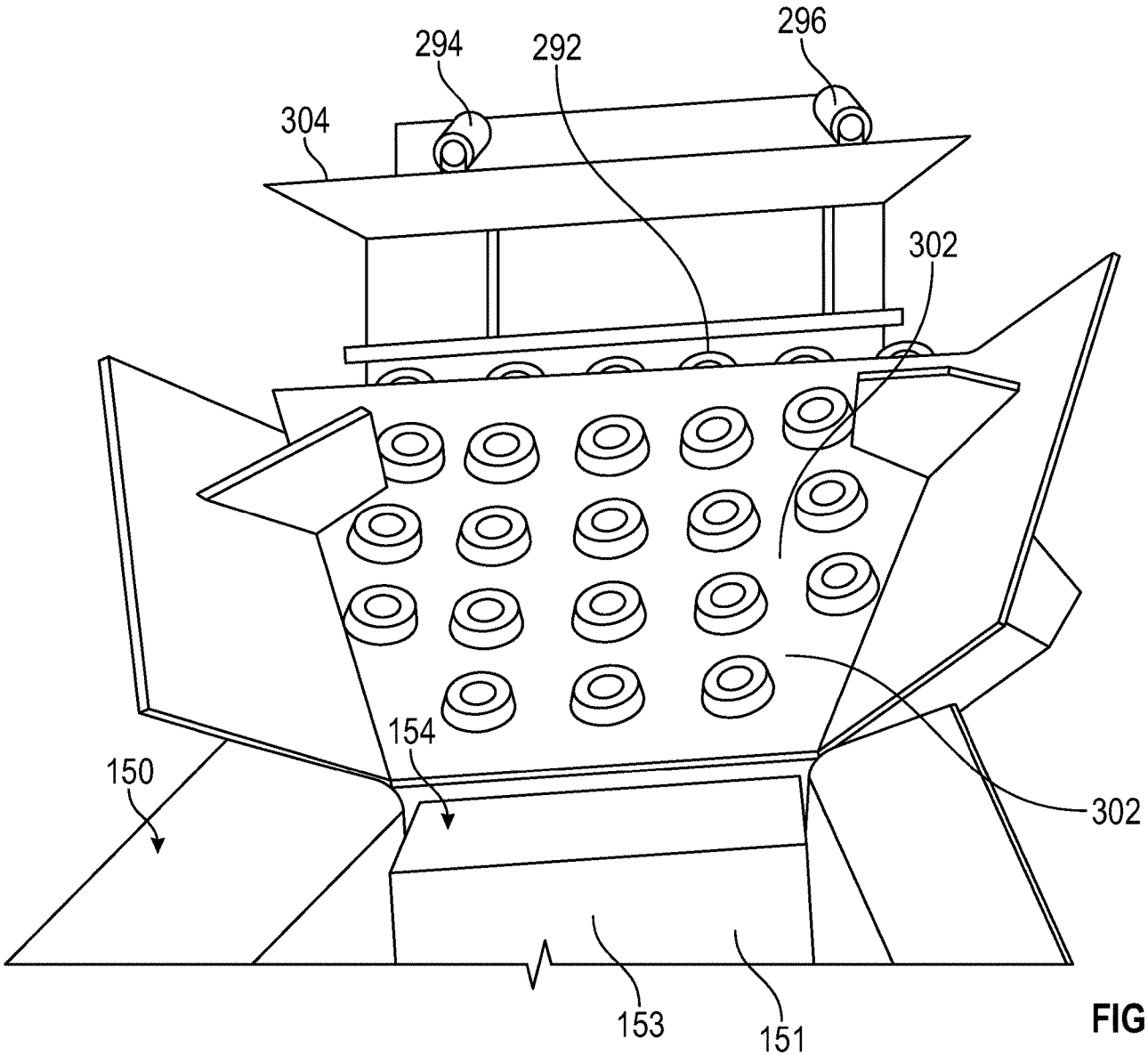
FIG. 39 shows an elevation view of the field-gauge diverter, a tie plate magazine, and a ramp that extends from the field-gauge diverter to the tie plate magazine in accordance with an exemplary embodiment of the present disclosure.
Figure 40:
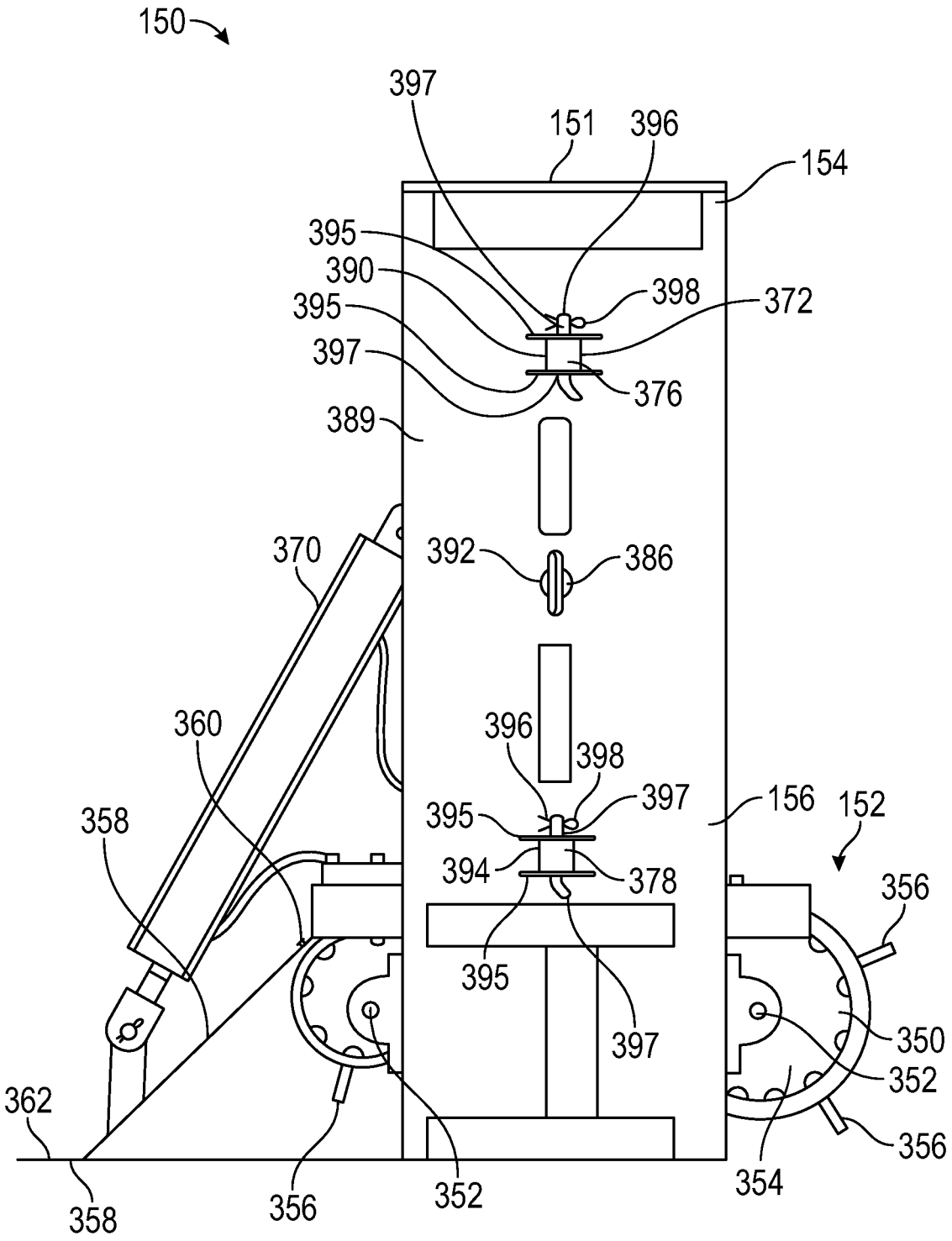
FIG. 40 shows an elevation view of a tie plate magazine, with a tie plate deposition ramp in a raised position in accordance with an exemplary embodiment of the present disclosure.
Figure 41:
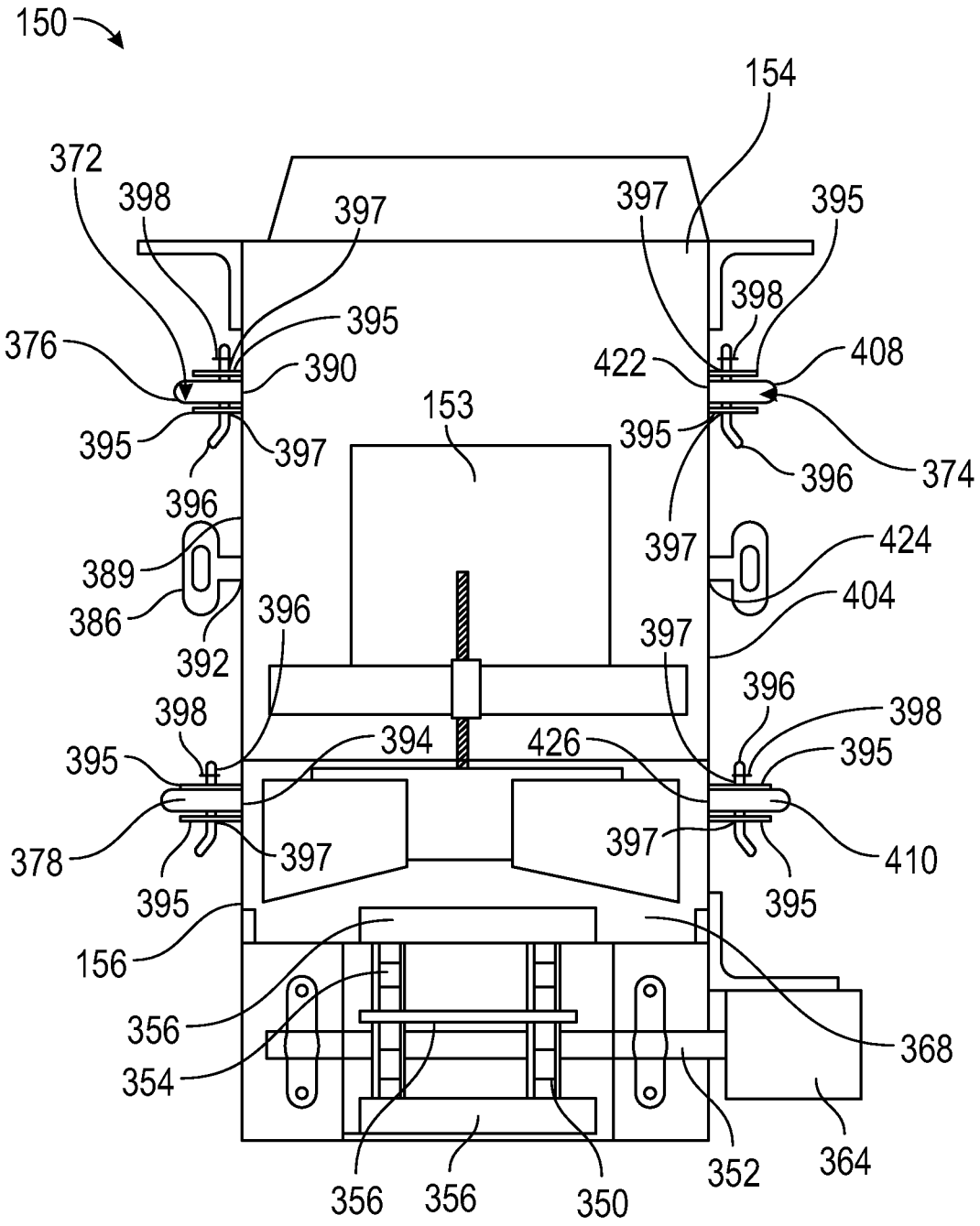
FIG. 41 shows an elevation view of the right side of the magazine shown in FIG. 40.

Because kicker 327 is constrained by kicker pivot 321, kicker 327 rotates around kicker pivot 321, forcing kicker 327 from the position shown in FIG. 37 to the position shown in FIG. 38. Because right actuator 296, which can be, for example, a pneumatic piston, actuates rapidly, a respective kicker 327 connected to right actuator 296 moves at sufficiently high velocity that a field end of tie plate 10 adjacent to kicker 327 is kicked in a direction that is generally away from receiver housing 304, particularly away from back wall 306. Tie plate 10 travels away from receiver housing 304 toward magazine loader ramp 302. Since magazine loader ramp 302 is angled downwardly, and tapers from a top 333 near receiver housing 304 to a bottom 335, tie plate 10 travels field side downwardly toward magazine 150. In an exemplary embodiment, a top end of magazine loader ramp 302 is about 22.5 inches across. Also, in an exemplary embodiment, a bottom of ramp 302 is about 9.5 inches across. An exemplary angle of ramp 302 from horizontal is about 27 degrees.

Magazine loader ramp 302 can include one or more guide plates to maintain orientation of tie plates 10. More specifically, as tie plate 10 is kicked or ejected by left or right kicker 327, tie plate 10 begins rotating, and would continue that rotation as tie plate 10 travels down magazine loader ramp 302. However, that rotation is arrested or constrained by a first guide plate 338 and/or a second guide plate 340. For example, if first actuator 294 forces left kicker 327 in FIG. 36 to impart a force to tie plate 10, tie plate 10 is ejected from field-gauge diverter 216 onto magazine loader ramp 302 such that the field side of tie plate 10 is oriented toward magazine 150. As tie plate 10 travels along magazine loader ramp 302, tie plate 10 tries to rotate counterclockwise as it travels down magazine loader ramp 302. However, the gauge end of tie plate 10 encounters first guide plate 338, oriented at approximately 96 degrees from a ramp wall. First guide plate 338 dampens the counterclockwise rotation of tie plate 10 sufficiently for tie plate 10 to travel along magazine loader ramp 302 in an orientation the enables tie plate 10 to enter magazine 150 without binding, and in the proper orientation. In an exemplary embodiment, the proper orientation is field side toward a forward and outboard end of magazine 150, forward being considered toward a front of truck 102, and outboard being considered away from centerline 105 of vehicle 102.

Referring to FIGS. 5, 39, and 41-43, once tie plate 10 enters magazine 150, tie plate 10 is oriented in magazine 150 so that field side **96*b* of tie plate 10 is angled outwardly from centerline 105 of vehicle 102, and gauge side 96*a* of tie plate 10 is angled inwardly toward centerline 105 from an orientation of tie plate 10 where the longest dimension of tie plate 10 is parallel to centerline 105**.

Tie plate magazine 150, which can also be described as a transport magazine, or transport box 150, includes upper end 154, which in an exemplary embodiment is positioned either at approximately a same level with truck bed 116, or lower than or below truck bed 116. In the context of this disclosure, magazine 150 includes an opening 151 that serves as an entrance for tie plates 10 into an interior of magazine 150, and it is the position of opening 151 with respect to truck bed 116 that is either at approximately the same level of truck bed 116 or below truck bed 116 in exemplary embodiments, but is generally sufficiently near to truck bed 116 that ramp 302 extending between receiving platform 292 and magazine 150 terminates alongside opening 151.

The interior of tie plate magazine 150 includes a cavity 153 that extends downwardly from opening 151 to tie plate transfer 152. Tie plates 10 entering magazine 150 by way of opening 151 travel through cavity 153 under the force of gravity until reaching tie plate transfer 152, which is positioned to restrain or retain tie plates 10 in cavity 153.

Once railroad tie plates 10 drop to second or lower end 156, they are positioned adjacent to tie' plate transfer 152. Plate transfer 152 includes a flanged drive wheel 350, a plurality of shafts 352, and a paddle drive or chain drive 354. Chain drive 354 includes a plurality of push plates or paddles 356 that each push or move a single railroad tie plate 10 from second, lower end 156 of transport magazine or box 150 either directly to railway or railroad bed 58 in an exemplary embodiment, or to a depositor ramp 358 that is included in tie plate depositor 148 in another exemplary embodiment. If tie plate depositor 148 does not include a depositor ramp 358, in an exemplary embodiment tie plate depositor 148 is positioned to drop tie plates outside the gauge, meaning at a location that is outside the pair of rails 60. If tie plate depositor 148 includes a depositor ramp 358, depositor ramp 358 receives a tie plate 10 from a first location 360 that is outside the gauge, and depositor ramp 358 terminates at a second location 362 that is inside the gauge, such that tie plate 10 is deposited from depositor ramp 358 to a location that is in the gauge, or between rails 60.

To move tie plate 10 from magazine 150 to depositor ramp 358, paddle or chain drive 354 is driven by a motor 364 that is included as part of tie plate depositor 148 in an exemplary embodiment. Motor 364 can be, for example, an electric, hydraulic, or mechanical motor. Motor 364 drives or rotates shafts 352, which then moves or drives paddle or chain drive 354. Push plates 356 of paddle or chain drive 354 can, in exemplary embodiments, be attached by, for example, fasteners, welding, and the like to paddle or chain drive 354. The rotation of shafts 352 by motor 364 causes chain drive 354 to move. As chain drive 354 moves, one push plate 356, which extend in a direction that is perpendicular to the direction of movement of chain drive 354, contacts a next tie plate 10 located within magazine 150. Since push plate 356 is shorter in height than tie plate 10, push plate 356 pushes tie plate 10 in a direction that is transverse to the vertical direction through a magazine exit opening 368.

Figure 42:
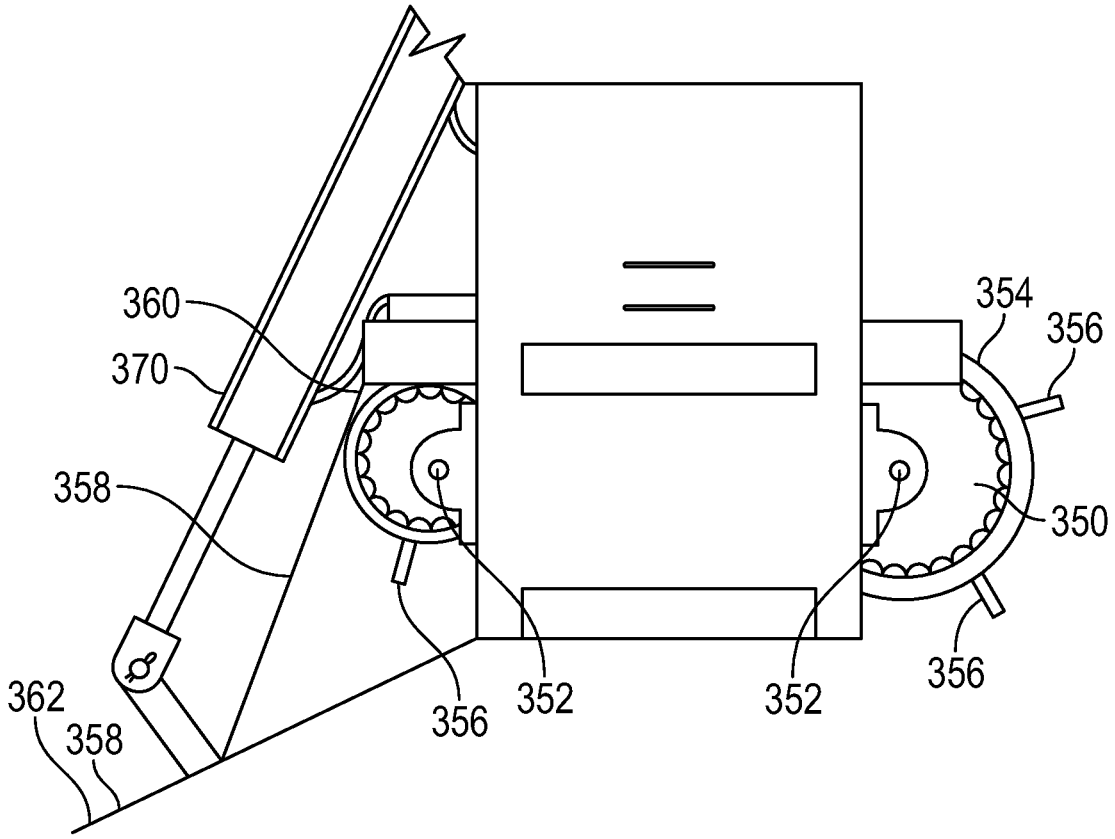
FIG. 42 shows a view of a lower portion of the tie plate magazine of FIG. 40, with the tie plate deposition ramp in a lowered position in accordance with an exemplary embodiment of the present disclosure.
Figure 43:
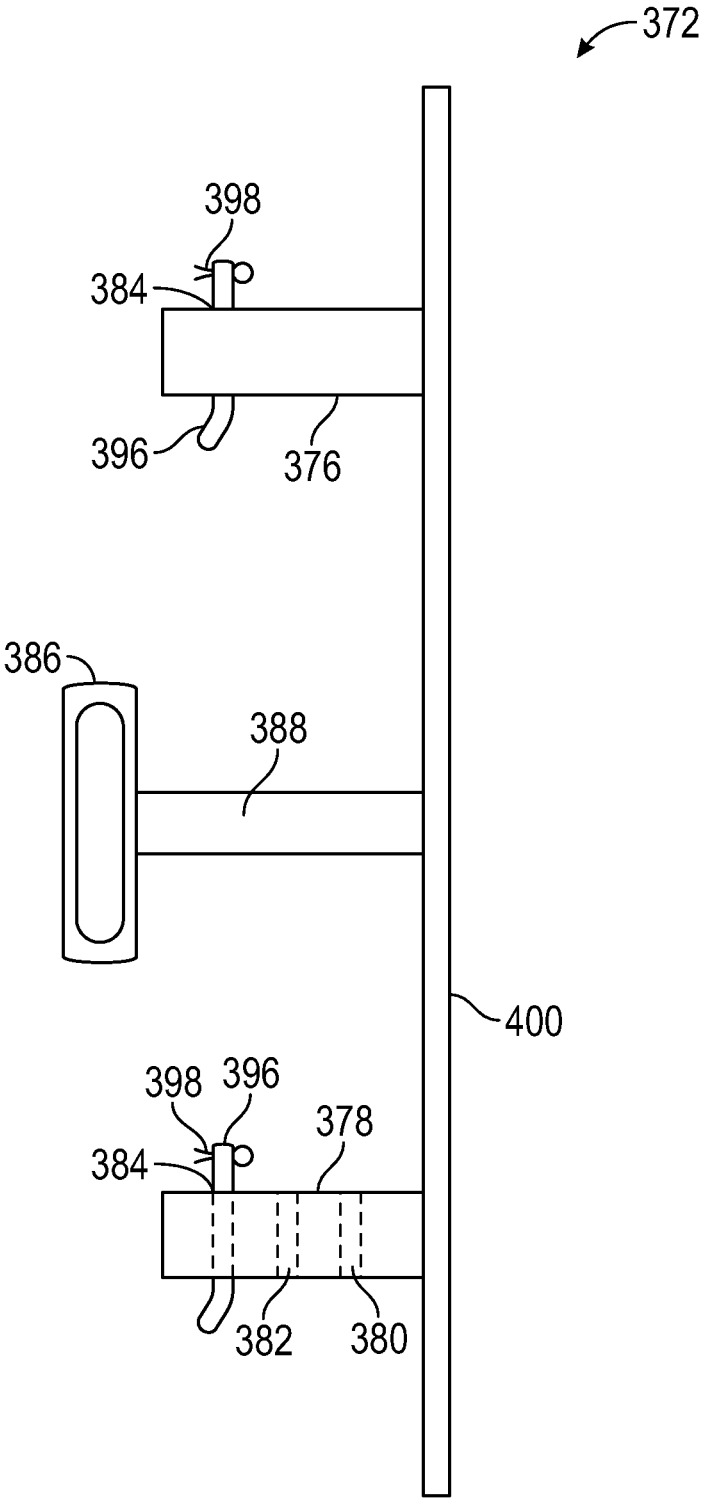
FIG. 43 shows an elevation view of a first spacer of the tie plate magazine of FIG. 40 in accordance with an exemplary embodiment of the present disclosure.
Figure 44:
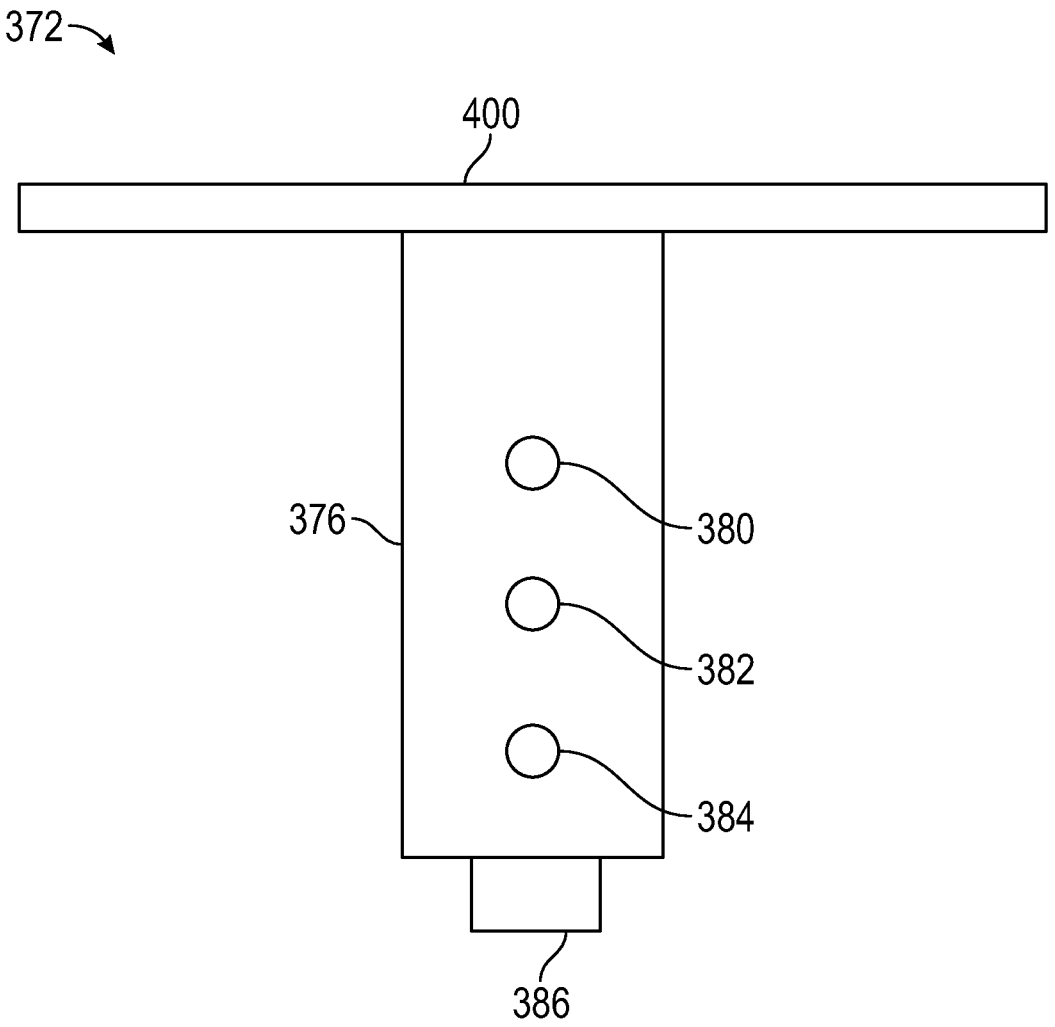
FIG. 44 shows a top view of the first spacer of FIG. 43.
Figure 45:
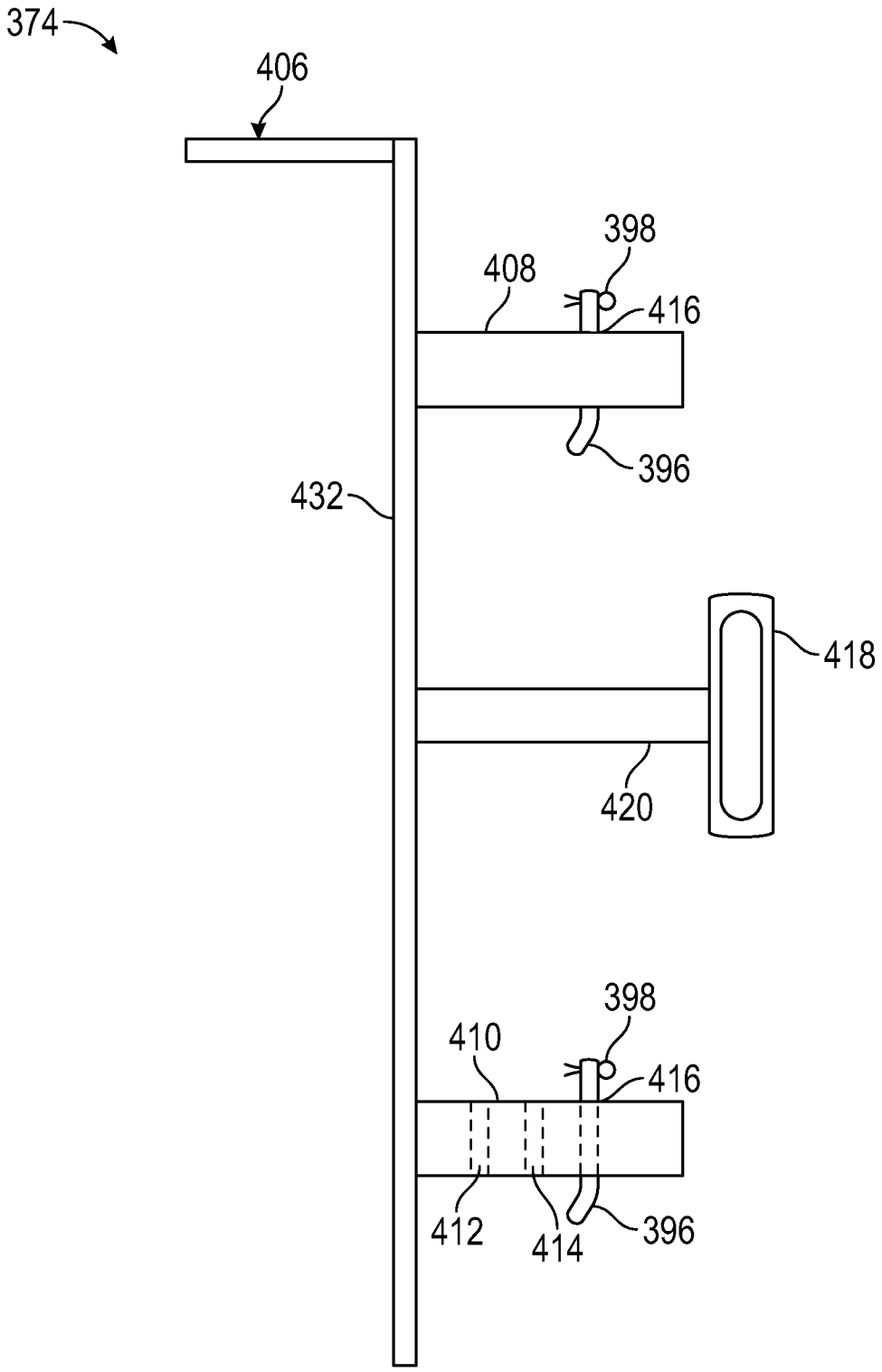
FIG. 45 shows an elevation view of a second spacer of the tie plate magazine of FIG. 40 in accordance with an exemplary embodiment of the present disclosure.
Figure 46:
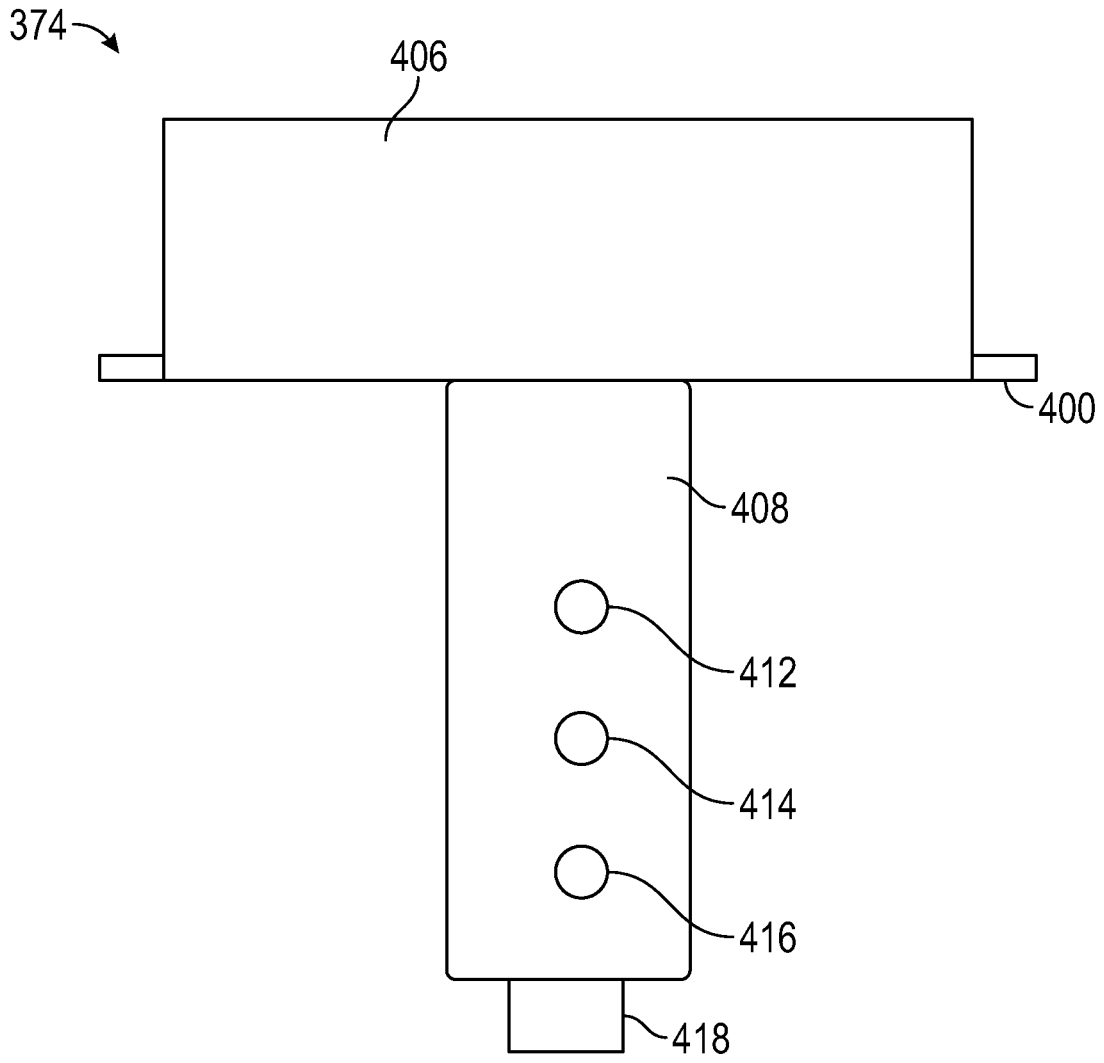
FIG. 46 shows a top view of the second spacer of FIG. 45.
Figure 47:
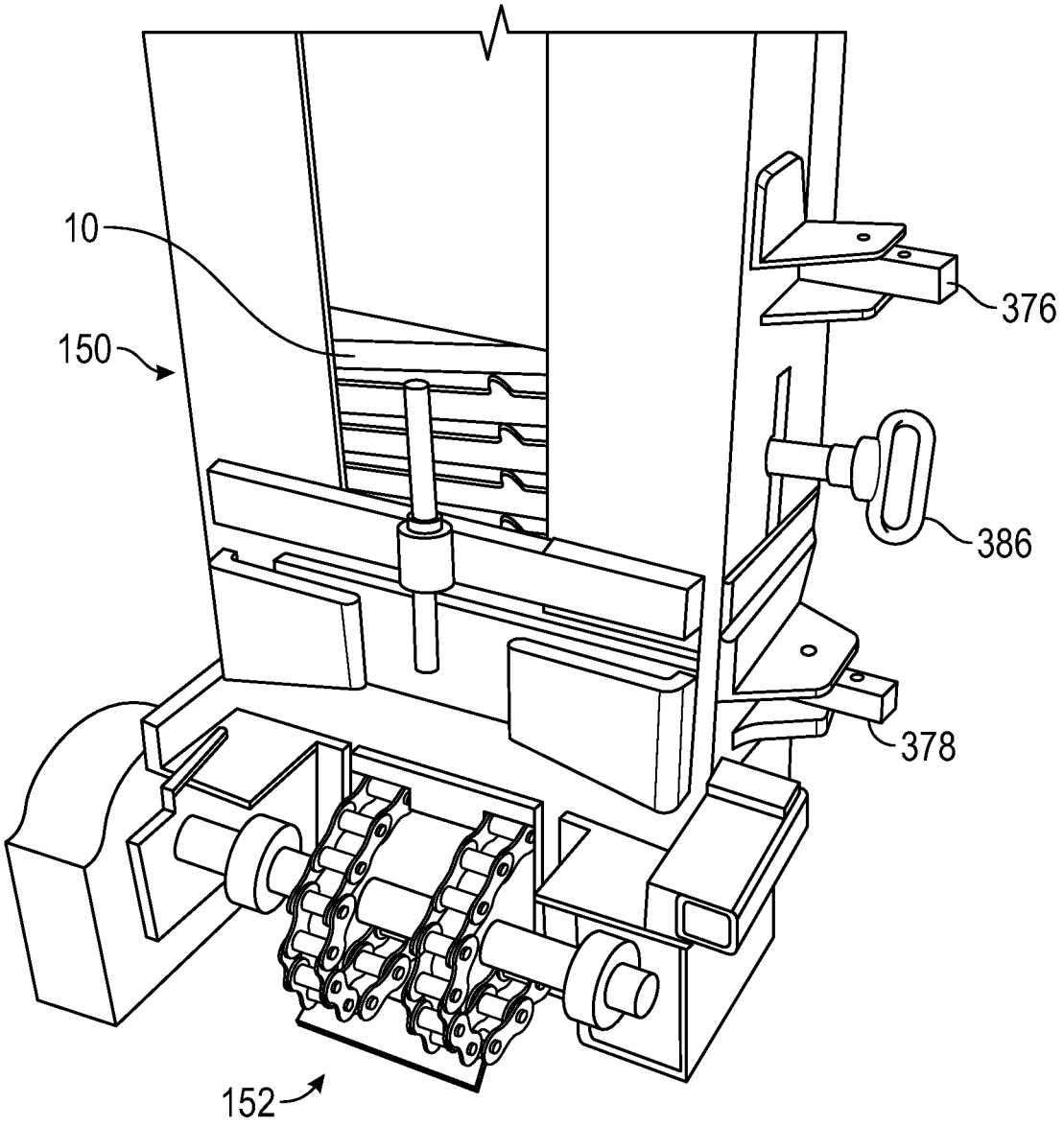
FIG. 47 shows a perspective view of the tie plate magazine of FIG. 40.

In an exemplary embodiment, motor 364 can be operated bi-directionally. Referring to FIG. 42, depositor ramp 358 is aimed to be in the gauge, i.e., between rails 60. Thus, if motor 364 is operated to drive in a counterclockwise direction, tie plate 10 drops onto depositor ramp 358 at first, upper location 360, and slides along depositor ramp 358 to second, lower location 362, after which depositor ramp 358 terminates, at which point tie plate 10 drops onto railway bed 58 at a location that is in the gauge. It should be noted that in an exemplary embodiment, depositor ramp 358 can be raised or lowered by an actuator 370. Actuator 370 can be, for example, a ball screw linear actuator (BSLA), a pneumatic piston, a hydraulic piston, and other devices configured to raise and lower devices such as ramps.

Through extensive testing and experimentation, it has been determined that it is preferred to position tie plate 10 so that tie plate 10 is centered on chain drive 354 and push plate 356. Without such centering, tie plate 10 tends to rotate or cant in plan view, which can lead to binding of tie plate 10 with internal walls of magazine 150. Centering of tie plate 10 on chain drive 354 provides a push force generally near a center of tie plate 10 in a longitudinal or long direction, minimizing binding of tie plate 10 with interior walls of magazine 150 as tie plate 10 is pushed from magazine 150. However, magazine 150 is configured to accept plural lengths of tie plates 10, including 14, 16, and 18 inch tie plates, and if magazine 150 is configured to accept tie plate 10 having a length of 16 inches, smaller tie plates having length of 14 and 16 inches may not be centered in a same opening. Accordingly, in an exemplary embodiment, magazine 150 can include adjustable spacers or positioners on each end of magazine 150.

Referring to FIGS. 41-50, magazine 150 includes two adjustable spacers. A first spacer 372 is positioned on a forward and field side of magazine 150 in plan view, such as that of FIG. 5. A second spacer 374 is positioned on a rear and gauge side of magazine 150. First spacer 372 includes a first spacer wall 400, a first positioner 376, and a second positioner 378. Since first spacer 372 is oriented in a direction that extends vertically, first positioner 376 can also be described as a top or upper positioner, and second positioner 378 can also be described as a bottom or lower positioner. Each positioner 376 and 378 includes a plurality of holes or openings that an extend entirely through a respective positioner 376 or 378. For example, first positioner 376 includes a first hole or opening 380 to position first positioner 376 in magazine 150 to accommodate 18 inch long tie plates, a second hole or opening 382 to position first positioner 376 in magazine 150 to accommodate 16 inch long tie plates, and a third hole or opening 384 to position first position 376 in magazine 150 to accommodate 14 inch long tie plates. First spacer 372 can also include a handle 386 positioned on a handle support 388. While a primary purpose for handle support 388 is to provide a location for handle 386, handle support 388 can also be described as a third, middle, or central positioner 388 that is positioned between or directly between first positioner 376 and second positioner 378.

Each of handle support 388, first positioner 376, and second positioner 378 extend generally perpendicularly to spacer wall 400. Each of handle support 388, first positioner 376, and second positioner 378 can be attached to spacer wall 400 by way of, for example, welding or fasteners.

Magazine 150 includes a front, outboard, side wall 389. Side wall 389 is a wall of magazine 150 that extends in a vertical direction and is a wall of magazine 150 that is positioned furthest from magazine loader ramp 302. Side wall 389 includes a first opening 390, a second opening 392, and a third opening 394 that extend entirely through side wall 389. First opening 390 is closer to upper end 154 than to lower end 156 of magazine 150, and third opening 394 is closer to lower end 156 than to upper end 154. The spacing of first opening 390, second opening 392, and third opening 394 helps provide support for spacer wall 400 when first spacer 372 is positioned and locked into magazine 150, particularly when tie plates 10 are loaded into magazine 150, at which point or time tie plates 10 will exert some force on spacer wall 400.

Side wall 389 includes a plurality of clevis plates 395, two of which are positioned on opposite sides of first opening 390 and two of which are positioned on opposite sides of third opening 394. Each clevis plate 395 includes a vertically oriented hole or opening 397. Holes or openings 397 in adjacent clevis plates 395 are aligned along a same vertical axis. First positioner 376 is inserted into first magazine hole 390, second positioner 378 is inserted into third magazine hole 394, and handle support 388 is inserted into second magazine hole 392 from inside of cavity 153. Once first positioner 376 is inserted as described, clevis or other type of pins 396 are inserted through a first clevis plate hole 397 of a first clevis plate 395 into a selected one of first hole 380, second hole 382, and third hole 384 of first positioner 376, and then through a second clevis plate hole 397 of a second, adjacent clevis plate 395, which is separated from first clevis plate by a width that is slightly greater than a width of first positioner 376. Cotter pins 398 can then be inserted into each pin 396 to prevent pins 396 from being removed or retracted from the selected one of first hole 380, second hole 382, and third hole 384 and adjacent clevis plate holes 397.

As indicated hereinabove, second positioner 378 also includes holes comparable to first hole 380, second hole 382, and third hole 384. Indeed, in an exemplary embodiment, second positioner 378 is configured the same as first positioner 376. Accordingly, second positioner 378 also includes first hole 380, second hole 382, and third hole 384 to enable positioning an upper end of first spacer 372 and a lower end of first spacer 372 such that first spacer 372 extends vertically and is positioned a same distance from an interior wall of magazine 150 at the bottom and top of magazine 150. Thus, clevis pins 396 are inserted through clevis plate holes 397 in two clevis plates 397 located on either side of third hole 394 and through a selected one of first hole 380, second hole 382, and third hole 384 in second positioner 378 to lock the lower end of first spacer 372 into place on magazine 150.

In an exemplary embodiment, handle 386 is attached to handle support 388 after handle support 388 is positioned in second hole 392. Such attachment can be by the way of a fastener, or a thread integrally formed as part of handle 386.

Once first spacer 372 is positioned in magazine 150, the position of first spacer 372 can be adjusted when magazine 150 is empty by removing cotter pins 398 and pins 396, and then sliding first spacer 372, including spacer wall 400, deeper into cavity 153, or less deeply into cavity 153. Pins 396 are then reinserted as described hereinabove and cotter pins 398 are reinstalled to maintain respective pins 396 in place.

Second spacer 374 includes a second spacer wall 432, a first positioner 408, and a second positioner 410. Since second spacer 374 is oriented in a direction that extends vertically, first positioner 408 can also be described as a top or upper positioner, and second positioner 410 can also be described as a bottom or lower positioner. Each positioner 408 and 410 includes a plurality of holes or openings that an extend entirely through a respective positioner 408 or 410. For example, first positioner 408 includes a first hole or opening 412 to position first positioner 408 in magazine 150 to accommodate 18 inch long tie plates, a second hole or opening 414 to position first positioner 408 in magazine 150 to accommodate 16 inch long tie plates, and a third hole or opening 416 to position first positioner 408 in magazine 150 to accommodate 14 inch long tie plates. Second spacer 374 can also include a handle 418 positioned on a handle support 420. While a primary purpose for handle support 420 is to provide a location for handle 418, handle support 420 can also be described as a third, middle, or central positioner 420 that is positioned between or directly between first positioner 408 and second positioner 410.

Each of handle support 420, first positioner 408, and second positioner 410 extend generally perpendicularly to spacer wall 400. Each of handle support 420, first positioner 408, and second positioner 410 can be attached to spacer wall 400 by way of, for example, welding or fasteners.

Magazine 150 includes a second, rear wall 404 on an opposite side of magazine 150 from front wall 389. It should be apparent that cavity 153 is formed in part by interiors of front wall 389 and rear wall 404. Side wall 404 is a wall of magazine 150 that extends in a vertical direction and is a vertical wall of magazine 150 that is positioned closest to magazine loader ramp 302. Side wall 404 includes a first opening 422, a second opening 424, and a third opening 426 that extend entirely through side wall 404. First opening 422 is closer to upper end 154 than to lower end 156 of magazine 150, and third opening 426 is closer to lower end 156 than to upper end 154. The spacing of first opening 422, second opening 424, and third opening 426 helps provide support for spacer wall 432 when second spacer 374 is positioned and locked into magazine 150, particularly when tie plates 10 are loaded into magazine 150, at which point or time tie plates 10 will exert some force on spacer wall 432.

Side wall 404 includes a plurality of clevis plates 395, two of which are positioned on opposite sides of first opening 422 and two of which are positioned on opposite sides of third opening 426. Each clevis plate 395 includes a vertically oriented hole or opening 397. Holes or openings 397 in adjacent clevis plates 395 are aligned along a same vertical axis. First positioner 408 is inserted into first magazine hole 422, second positioner 410 is inserted into third magazine hole 426, and handle support 420 is inserted into second magazine hole 424 from inside of cavity 153. Once first positioner 408 is inserted as described, clevis or other type of pins 396 are inserted through a first clevis plate hole 397 of a first clevis plate 395 into a selected one of first hole 412, second hole 414, and third hole 416 of first positioner 408, and then through a second clevis plate hole 397 of a second, adjacent clevis plate 395, which is separated from first clevis plate by a width that is slightly greater than a width of first positioner 408. Cotter pins 398 can then be inserted into each pin 396 to prevent pins 396 from being removed or retracted from the selected one of first hole 412, second hole 414, and third hole 416 and adjacent clevis plate holes 397.

As indicated hereinabove, second positioner 410 also includes holes comparable to first hole 412, second hole 414, and third hole 416. Indeed, in an exemplary embodiment, second positioner 410 is configured the same as first positioner 408. Accordingly, second positioner 410 also includes first hole 412, second hole 414, and third hole 416 to enable positioning an upper end of second spacer 374 and a lower end of second spacer 374 such that second spacer 374 extends vertically and is positioned a same distance from an interior wall of magazine 150 at the bottom and top of magazine 150. Thus, clevis pins 396 are inserted through clevis plate holes 397 in two clevis plates 397 located on either side of third hole 426 and through a selected one of first hole 412, second hole 414, and third hole 416 in second positioner 410 to lock the lower end of second spacer 374 into place on magazine 150. Handle 418 is also attached to handle support 420 after handle support 420 is positioned in second hole 424. Such attachment can be by the way of a fastener, or a thread integrally formed as part of handle 418.

Once second spacer 374 is positioned in magazine 150, the position of second spacer 374 can be adjusted when magazine 150 is empty by removing cotter pins 398 and pins 396, and then sliding second spacer 374, including spacer wall 432, deeper into cavity 153, or less deeply into cavity 153. Pins 396 are then reinserted as described hereinabove and cotter pins 398 are reinstalled to maintain respective pins 396 in place.

While a primary purpose for handle support 420 is to provide a location for handle 418, handle support 420 can also be described as a third, middle, or central positioner 420 that is positioned between or directly between first positioner 408 and second positioner 410.

Figure 48:
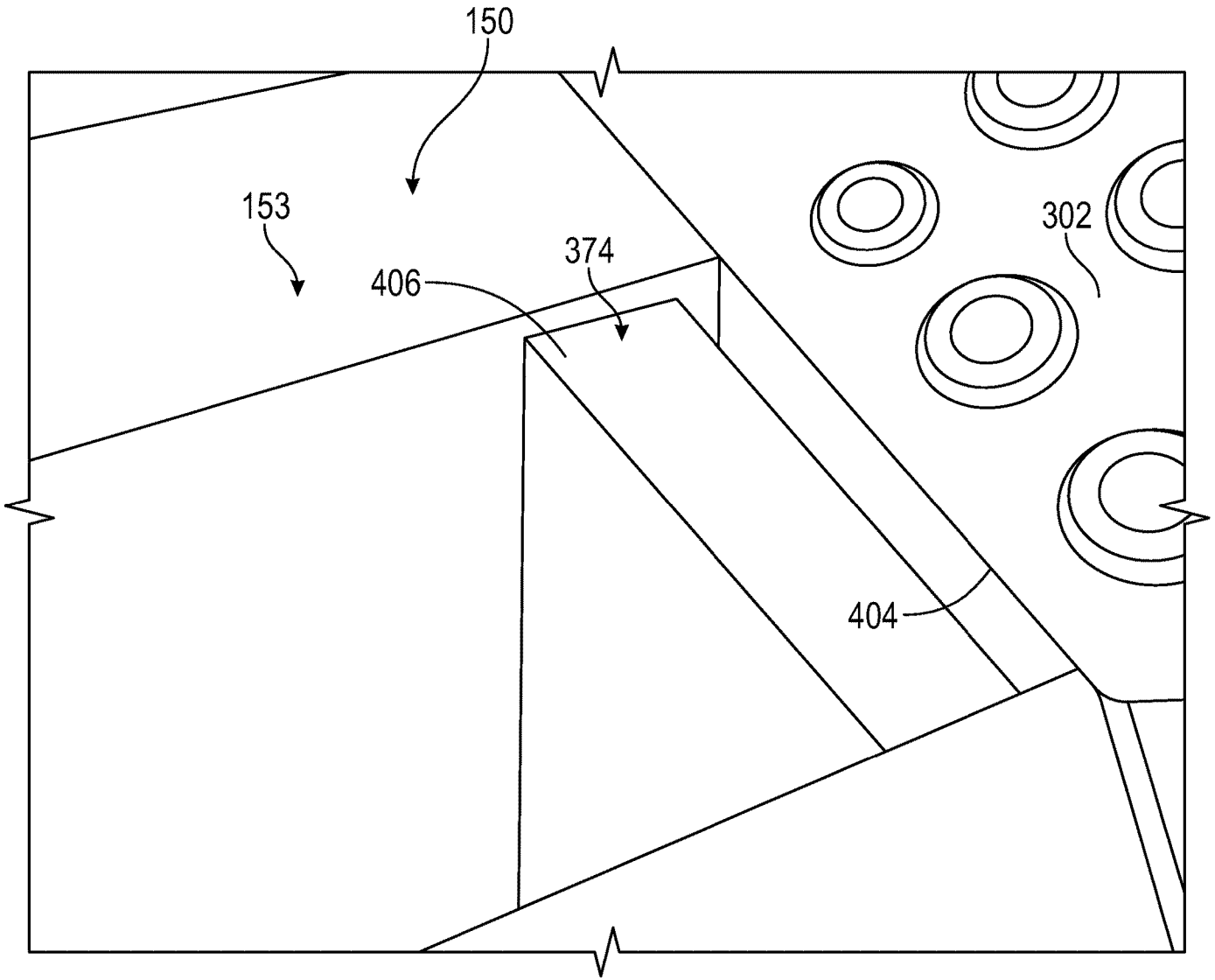
FIG. 48 shows a perspective view of the second spacer of FIG. 45 in position in the tie plate magazine.
Figure 49:
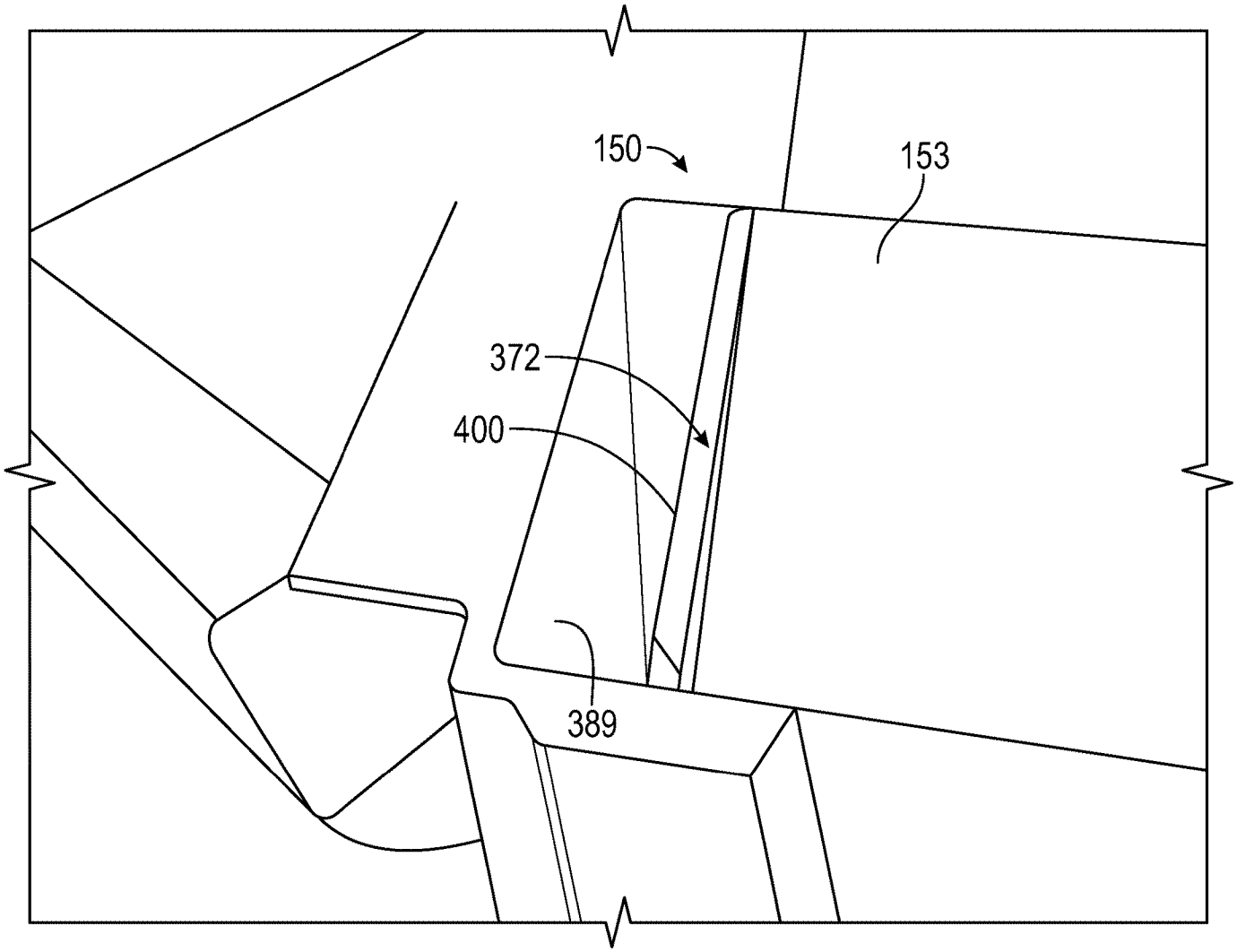
FIG. 49 shows a perspective view of the first spacer of FIG. 43 in position in the tie plate magazine.
Figure 50:
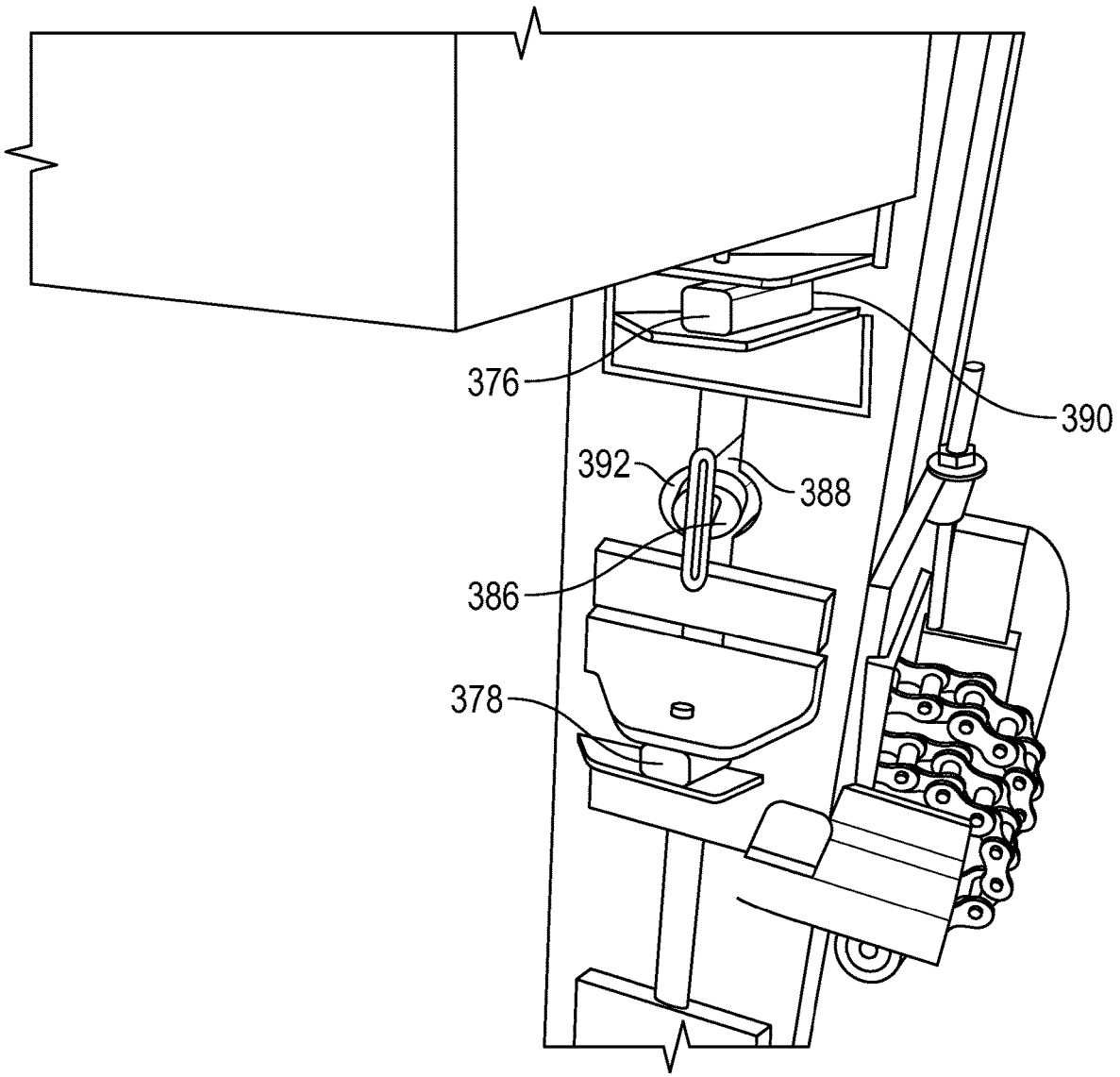
FIG. 50 shows a perspective view of a bottom end of the tie plate magazine.
Figure 51:
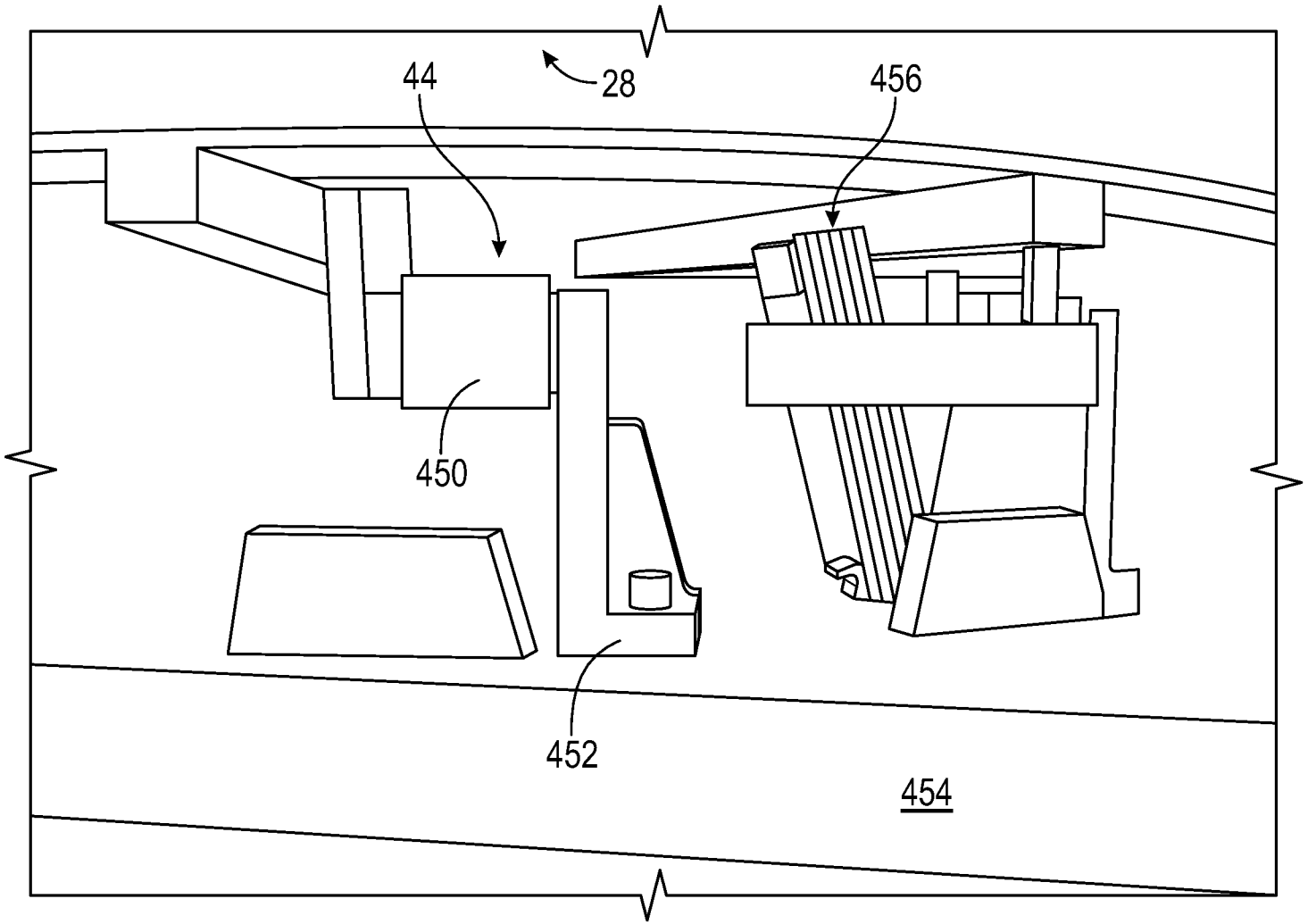
FIG. 51 shows an elevation view of electromagnetic vibrators in accordance with an exemplary embodiment of the present disclosure.
Figure 52:
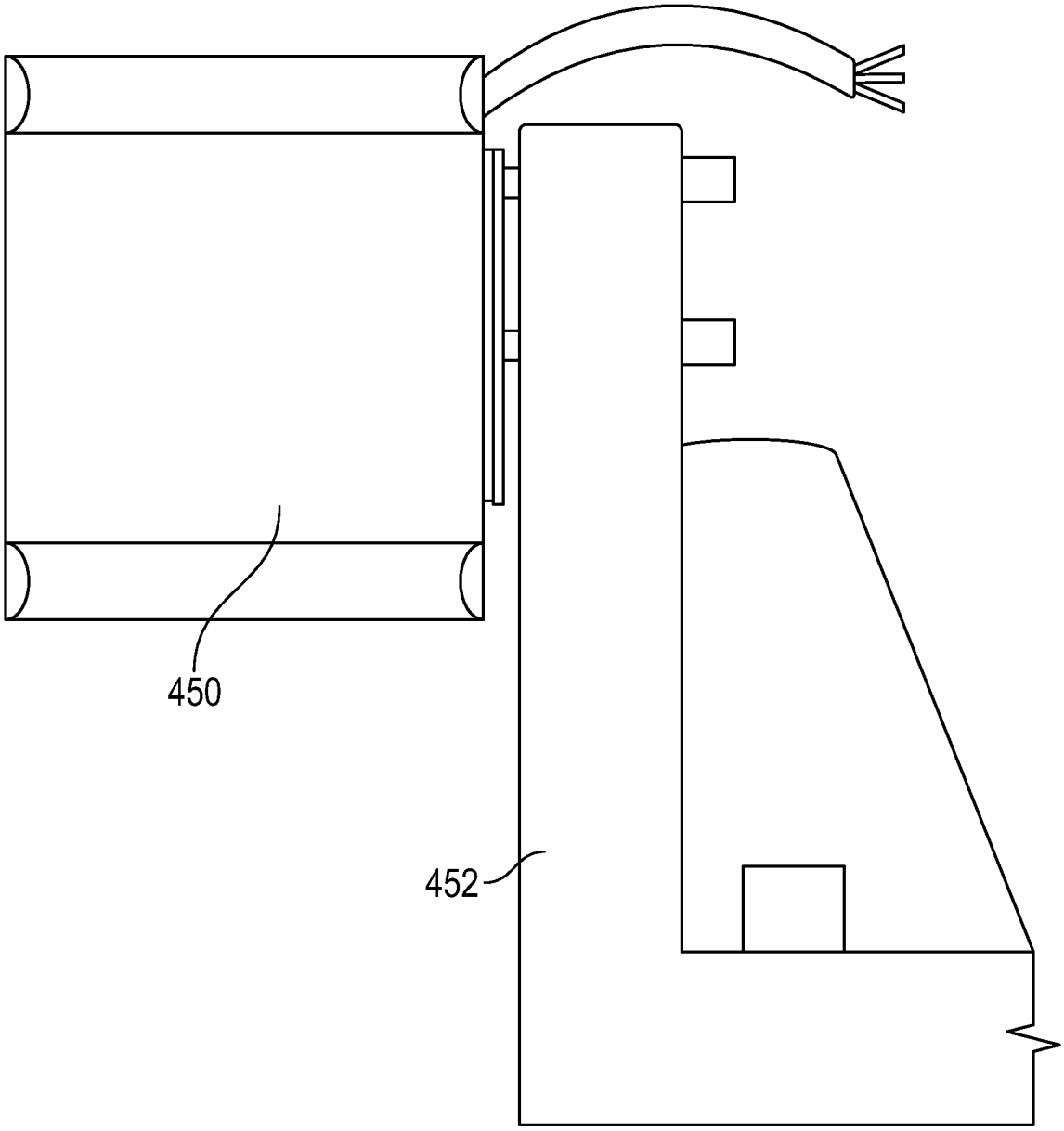
FIG. 52 shows an elevation view of a single electromagnetic vibrator on a vibration support in accordance with an exemplary embodiment of the present disclosure.
Figure 53:
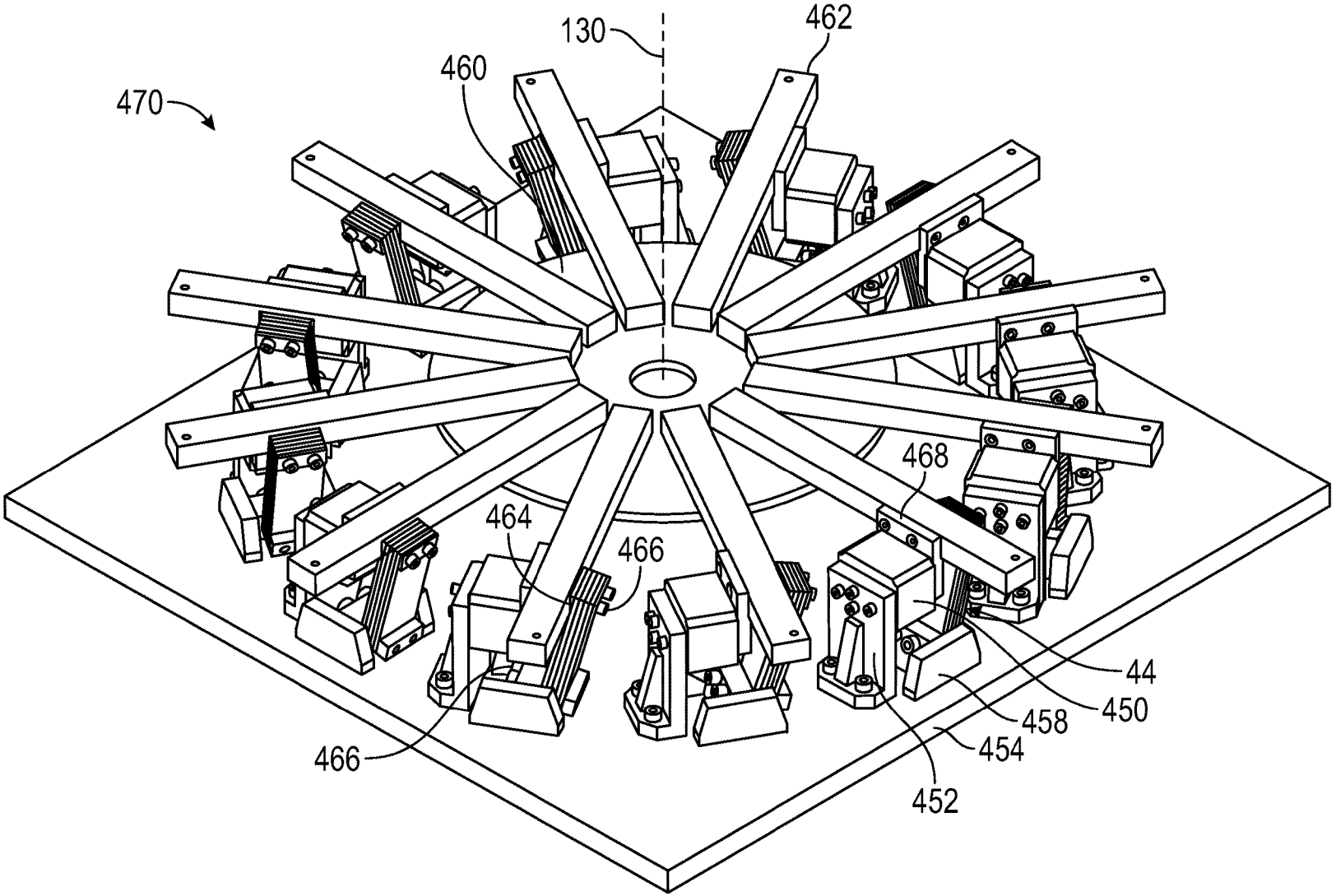
FIG. 53 shows a perspective view of an electromagnetically vibrated tie plate distributor base in accordance with an exemplary embodiment of the present disclosure.
Figure 54:
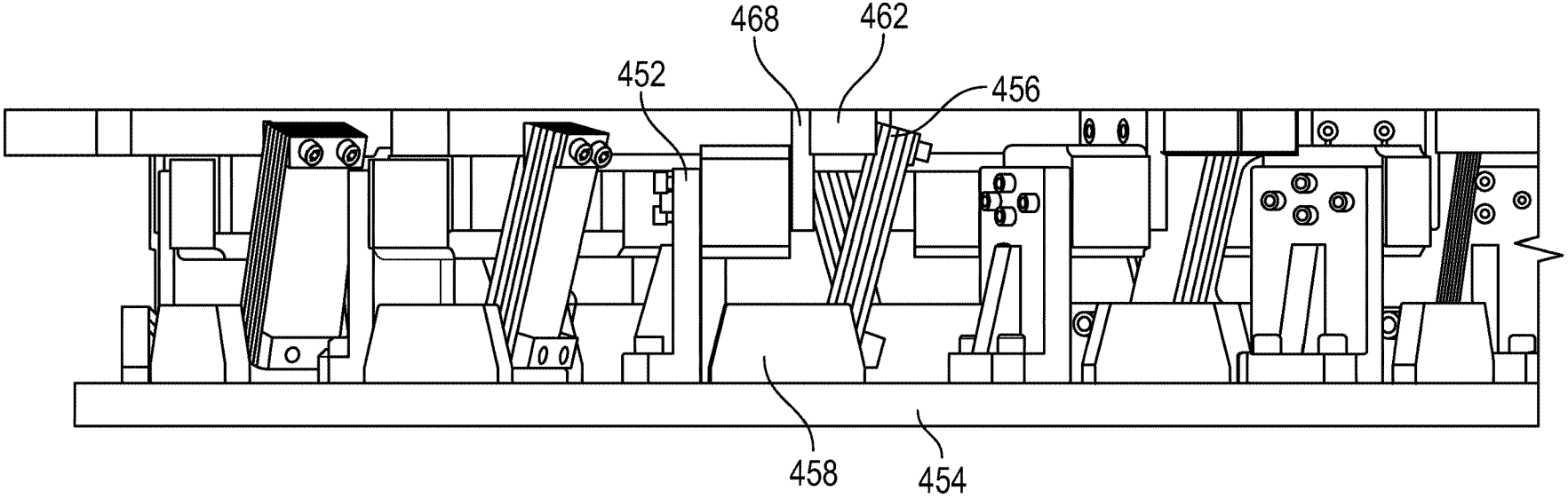
FIG. 54 shows an elevation view of a portion of the electromagnetically vibrated tie plate distributor base of FIG. 53.
Figure 55:
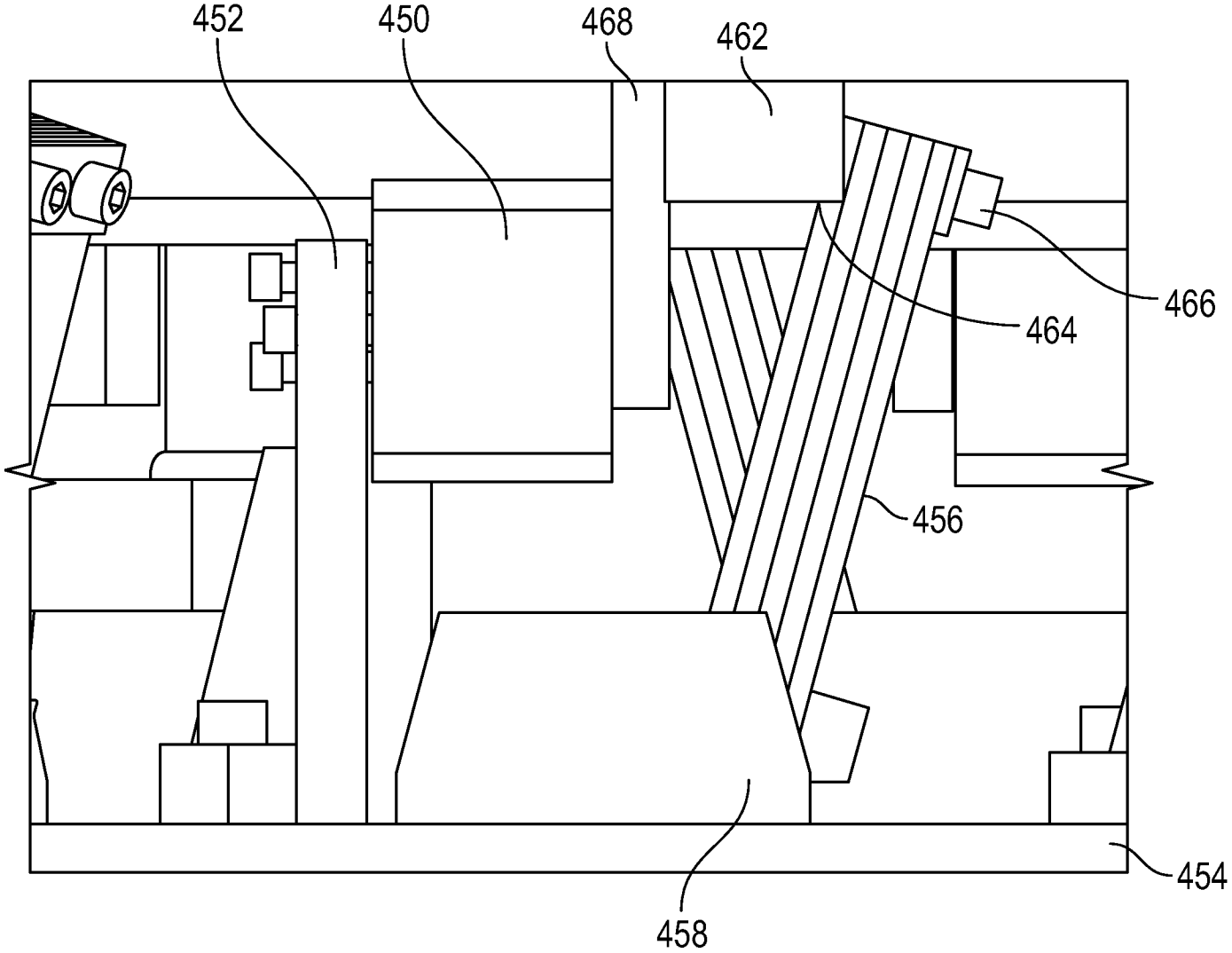
FIG. 55 shows a view of an electromagnet and return spring of the electromagnetically vibrated tie plate distributor base of FIG. 53.

Second spacer wall 432 includes a spacer shelf or lip 406, which extends in a transverse direction from vertically-extending second spacer wall 432. Referring to FIG. 48, spacer lip 406 provides a surface for tie plates 10 sliding along ramp 302 to slide across upper end of second spacer 374 to reach cavity 153, where tie plate 10 drops onto a top of tie plate 10 closest to upper end 154 of magazine 150.

Referring to FIGS. 51-55, railroad tie plate delivery system 100 includes a plurality of electromagnets 450, a plurality of electromagnet support brackets 452, a support plate 454, a plurality of springs 456, which can also be described as a spring pack 456, a spring support base 458, an arm support 460, a plurality of radially extending arms 462, and a plurality of striker plates 468. Arms 462 are attached to arm support 460, which in an exemplary embodiment can be by welding. Arms 462 are positioned such that each arm 462 extends in a same plane along a line with a center at a center of rotation of arm support 460.

Each arm 462 includes an angled cutout 464, and one spring pack 456 interfaces with each angled cutout 464. Further, each spring pack 456 is attached at an upper end to a respective arm 462, which in an exemplary embodiment can be by fasteners. Each spring pack 456 is also attached at a lower end to spring support base 458, which can be directly supported on support plate 454. Spring pack 456 can be attached to spring support base 458 by, for example, fasteners such as fasteners 466. Spring support base 458 can be attached to support plate 454 by fasteners, welding, or the like.

An entirety of tie plate intake 26 and tie plate distributor 28 rest on, and are attached to arms 462. Each striker plate 468 is attached to a respective arm 462. When electromagnets 450 are not actuated, engaged, turned on, or powered, each striker plate 468 is positioned a spaced distance from a respective electromagnet 450. In an exemplary embodiment, the spaced distance can be about 0.375 inches. Thus, all the weight of tie plate intake 26, tie plate distributor 28, arm support 460, and arms 462 is entirely supported by spring packs 456. When electromagnets 450 are turned on, powered on, engaged, or actuated, electromagnets 450 cause arms 462, and all elements supported directly or indirectly by arms 462, to rotate about the center of arm support 460, which is also the axial center 130 in a plan view of tie plate intake 26 and tie plate distributor 28. When electromagnet 450 is disengaged, turned off, or powered off, spring packs 456 force arms 462, and all elements supported directly or indirectly by arms 462, back to their original position. The movement of arms 462 causes striker plates 468 to move toward a respective electromagnet 450, and then away from a respective electromagnet 450, cause a shaking or vibration of tie plate intake 26 and tie plate distributor 28, and thus all elements associated with tie plate intake 26 and tie plate distributor 28, which cause tie plate 10 to move along ramps 144, as described hereinabove.

It should be apparent that vibrators 44 in an exemplary embodiment are assemblies that include electromagnet 450. Support plate 454 is positioned on truck bed 116. In an exemplary embodiment, there are 12 electromagnets 450 positioned on support plate 454. Support plate 454, which in an exemplary embodiment is approximately four inches thick in the vertical direction, helps to isolate the vibrations caused by electromagnets 450 from being transmitted into truck bed 116 and then into mobile platform or truck 102.

In order for the counterclockwise rotation to occur, a drive unit 470 is comprised of base or support plate 454, spring packs 456, arms 462, striker plates 468, electromagnets 450, brackets 453, and spring support bases 458 for attaching spring packs. Arms 462 are configured in such a way to radiate out from the center point of drive unit 470. There is one arm 462 per electromagnet 450. Each arm 462 has one striker plate 468 bolted on to act as a pull plate for the pulsing of electromagnet 450. On the opposite side of striker plate 468 is a number of stacked springs to make up spring pack 456. In an exemplary embodiment, each spring pack 456 includes a 7⅜ inch thick spring. These springs are what supports all the weight from arms 462 and above. The weight of tie plate intake 26, tie plate distributor 28, arm support 460, and arms 462 is entirely supported by spring packs 456. Movement in tie plate intake 26 and tie plate distributor 28 is done by the pull of electromagnet 450 on striker plate 468 which moves arms 462 closer to respective electromagnets 450 and "flexes" spring pack 456. This flexing causes not only a horizontal movement in tie plate intake 26 and tie plate distributor 28, but a vertical movement one as well. The combination of the vertical movement, horizontal movement and the frequency all create the vibration necessary to achieve movement of tie plates 10 down ramp 144 and 145.

Electromagnets 450 are controlled by a set of frequency controllers configured in a master/slave operational setup. The frequency controllers can be included as a part of control system 32, and may be positioned internal to a housing from control system 32. A total of twelve electromagnets 450 run on 240 VAC current supplied at 60 Hz. The frequency controllers control six electromagnets 450 each. The frequency controllers convert the 60 HZ input to an output of 45 HZ in operating conditions. The 45 Hz allows the electromagnets to pulse at a rate of 45 times per second. This pulse gives a pull on striker plates 468 attached to a drive unit 470 to allow a counter-clockwise rotation of approximately 0.375 inches per pulse. This pulse rate coupled with the deflection of drive unit 470 allows for the proper vibration to move plates down the ramp. The weight of the tie plate distributor 28 is about 2,700 lbs., the weight of drive unit 470 is about 6,600 lbs. A minimum ratio of 2:1 in relation to drive unit 470 and tie plate distributor 28 is preferable in an exemplary embodiment to properly operate the reciprocally vibratory system. However, other ratios are possible depending on the diameter of tie plate distributor 28 and the length of ramps 144.

While various embodiments of the disclosure have been shown and described, it should be understood that these embodiments are not limited thereto. The embodiments may be changed, modified, and further applied by those skilled in the art. Therefore, these embodiments are not limited to the detail shown and described previously, but also include all such changes and modifications.

I claim:

1. A railroad tie plate placement system comprising:

a vehicle configured to travel on a railroad track having a pair of railroad rails supported by a plurality of railroad ties;

a vibratory tie plate distributor, the vibratory tie plate distributor including an input, a bottom end, a ramp, a first diverter, and a second diverter, the input disposed at an upper end of the vibratory tie plate distributor, the ramp extending around a periphery of the vibratory tie plate distributor, the ramp connecting the input to the bottom end, the first diverter configured to rotate a tie plate in a first direction as the tie plate travels along the tie plate distributor, the second diverter disposed downstream of the first diverter and configured to rotate the tie plate in the first direction, or a second direction opposite the first direction, as the tie plate travels along the tie plate distributor; and a tie plate ejector positioned adjacent to the bottom end, and the tie plate ejector configured to eject the tie plate in a predetermined orientation of a field end of the tie plate independent of an orientation of the tie plate when the tie plate is positioned in the tie plate ejector.

2. The railroad tie plate placement system of claim 1, wherein the tie plate ejector ejects the field end of the tie plate.

3. The railroad tie plate placement system of claim 1, including a tie plate magazine configured to hold a plurality of tie plates, and the tie plate is ejected into the tie plate magazine.

4. The railroad tie plate placement system of claim 3, including a ramp extending from the tie plate magazine to a location underneath the vehicle.

5. The railroad tie plate placement system of claim 1, including a third diverter positioned along the ramp and a storage area positioned on the vehicle, and the third diverter is configured to eject a tie plate stacked on top of another tie plate into the storage area.

6. The railroad tie plate placement system of claim 1, wherein the second diverter includes a first protrusion configured to engage an upper half of the tie plate, and a second protrusion configured to engage a lower half of the tie plate.

7. A railroad tie plate placement system comprising:

a vehicle configured to travel on a railroad track having a pair of railroad rails supported by a plurality of railroad ties, the vehicle having a bed having a maximum width;

a first tie plate magazine attached to the vehicle at a location within the bed maximum width, the first tie plate magazine extending vertically such that a top end of the first tie plate magazine is located near the vehicle bed and a bottom end of the first tie plate magazine is located below the vehicle bed; and a tie plate distributor configured to deposit tie plates into the top end of the first tie plate magazine, the tie plate distributor including a first diverter and a second diverter, the first diverter configured to rotate a tie plate in a first direction as the tie plate travels along the tie plate distributor, the second diverter disposed downstream of the first diverter and configured to rotate the tie plate in the first direction, or a second direction opposite the first direction, as the tie plate travels along the tie plate distributor.

8. The railroad tie plate placement system of claim 7, wherein the tie plate distributor deposits the tie plate into the first tie plate magazine such that a field end of the tie plate is oriented in a direction away from the tie plate distributor.

9. The railroad tie plate placement system of claim 7, wherein the tie plate distributor is cylindrically shaped and includes a ramp positioned around a periphery of the tie plate distributor, and tie plates are moved along the ramp by reciprocal movement of the tie plate distributor.

10. The railroad tie plate placement system of claim 7, including a second tie plate magazine positioned within the maximum width of the bed.

11. The railroad tie plate placement system of claim 10, including a first ramp connected to the bottom end of the first tie plate magazine and a second ramp connected to a bottom end of the second tie plate magazine, each of the first ramp and the second ramp having an end for dropping a respective tie plate onto a railroad bed, and the ends are positioned underneath the bed.

12. The railroad tie plate placement system of claim 7, wherein the second diverter includes a first protrusion configured to engage an upper half of the tie plate, and a second protrusion configured to engage a lower half of the tie plate.

13. A railroad tie plate placement system comprising:

a vehicle configured to travel on a railroad track having a pair of railroad rails supported by a plurality of railroad ties; and a tie plate distributor configured to receive tie plates at a first end and to distribute tie plates at a second end, the tie plate distributor including a plurality of diverters, the plurality of diverters including a first diverter, a second diverter, and a third diverter, the first diverter configured to rotate a tie plate in a first direction as the tie plate travels along the tie plate distributor, the second diverter disposed downstream of the first diverter and configured to rotate the tie plate in the first direction, or a second direction opposite the first direction, as the tie plate travels along the tie plate distributor, and the third diverter to orient the tie plate in a predetermined orientation as the tie plate is ejected by the tie plate distributor.

14. The railroad tie plate placement system of claim 13, wherein the third diverter orients the tie plate such that a field end of the tie plate is positioned in a location away from the third diverter.

15. The railroad tie plate placement system of claim 13, including a tie plate magazine configured to hold a plurality of tie plates, and the tie plate is ejected into the tie plate magazine by the third diverter.

16. The railroad tie plate placement system of claim claim 15, including a ramp extending from the tie plate magazine to a location underneath the vehicle.

17. The railroad tie plate placement system of claim 13, including a fourth diverter and a storage area positioned on the vehicle, and the fourth diverter is configured to eject a tie plate stacked on top of another tie plate into the storage area.

18. The railroad tie plate placement system of claim 13, wherein the tie plate distributor is cylindrically shaped and includes a ramp positioned around a periphery of the tie plate distributor, and the tie plate is moved along the ramp by reciprocal movement of the tie plate distributor.

19. The railroad tie plate placement system of claim 18, wherein the first diverter is positioned along the ramp.

20. The railroad tie plate placement system of claim 18, including a third diverter positioned along the ramp, a tie plate magazine configured to receive tie plate magazines from the tie plate distributor, and a storage area positioned on the vehicle, and the third diverter is configured to direct a tie plate from the ramp to the storage area when the tie plate magazine is loaded to a predetermined level.

21. The railroad tie plate placement system of claim 13, wherein the second diverter includes a first protrusion configured to engage an upper half of the tie plate, and a second protrusion configured to engage a lower half of the tie plate.

* * * * *